US007272556B1

(12) United States Patent
Aguilar et al.

(10) Patent No.: US 7,272,556 B1
(45) Date of Patent: Sep. 18, 2007

(54) SCALABLE AND EMBEDDED CODEC FOR SPEECH AND AUDIO SIGNALS

(75) Inventors: Joseph Gerard Aguilar, Lawrenceville, NJ (US); David A. Campana, Princeton, NJ (US); Raymond Chen, Neshanic Station, NJ (US); Robert B. Dunn, Quincy, MA (US); Robert J. McAulay, Lexington, MA (US); Xiaoquin Sun, Plainsboro, NJ (US); Wei Wang, Plainsboro, NJ (US); Craig Watkins, Hamilton (AT); Robert W. Zopf, Lawrenceville, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/159,481

(22) Filed: Sep. 23, 1998

(51) Int. Cl.
*G10L 21/00* (2006.01)

(52) U.S. Cl. ..... 704/230; 704/226; 704/201

(58) Field of Classification Search ..... 704/201, 704/500–504, 226, 230
See application file for complete search history.

(56) References Cited

U.S. PATENT DOCUMENTS 4,972,484 A * 11/1990 Theile et al. ..... 704/200.1
5,864,800 A * 1/1999 Imai et al. ..... 704/229
5,926,788 A * 7/1999 Nishiguchi ..... 704/265
5,956,674 A * 9/1999 Smyth et al. ..... 704/200.1
5,974,380 A * 10/1999 Smyth et al. ..... 704/229
5,978,762 A * 11/1999 Smyth et al. ..... 704/229
6,018,707 A * 1/2000 Nishiguchi et al. ..... 704/222
6,092,039 A * 7/2000 Zingher ..... 704/221
6,098,039 A * 8/2000 Nishida ..... 704/229
6,243,672 B1 * 6/2001 Iijima et al. ..... 704/207
6,278,387 B1 * 8/2001 Rayskiy ..... 341/61
6,438,317 B1 * 8/2002 Imahashi et al. ..... 386/109
6,449,596 B1 * 9/2002 Ejima ..... 704/501
6,487,535 B1 * 11/2002 Smyth et al. ..... 704/500
6,658,382 B1 * 12/2003 Iwakami et al. ..... 704/224
6,961,432 B1 * 11/2005 Sinha et al. ..... 381/2

* cited by examiner

*Primary Examiner*—Michael N. Opsasnick

(57) ABSTRACT

A system and method for processing of audio and speech signals is disclosed, which provide compatibility over a range of communication devices operating at different sampling frequencies and/or bit rates. The analyzer of the system divides the input signal in different portions, at least one of which carries information sufficient to provide intelligible reconstruction of the input signal. The analyzer also encodes separate information about other portions of the signal in an embedded manner, so that a smooth transition can be achieved from low bit-rate to high bit-rate applications. Accordingly, communication devices operating at different sampling rates and/or bit-rates can extract corresponding information from the output bit stream of the analyzer. In the present invention embedded information generally relates to separate parameters of the input signal, or to additional resolution in the transmission of original signal parameters. Non-linear techniques for enhancing the overall performance of the system are also disclosed. Also disclosed is a novel method of improving the quantization of signal parameters. In a specific embodiment the input signal is processed in two or more modes dependent on the state of the signal in a frame. When the signal is determined to be in a transition state, the encoder provides phase information about N sinusoids, which the decoder end uses to improve the quality of the output signal at low bit rates.

20 Claims, 46 Drawing Sheets

Decoder: Synthesis every M ms.

F0 = 203.9 Frame #2278/3925 "Views Only"

$$\hat{AS}(i) = \sum_{j=1}^{i-1} \hat{a}_{ij} = \tilde{AS}(j)$$

$$\begin{bmatrix} \hat{AS}(1) \\ \hat{AS}(2) \\ \vdots \\ \hat{AS}(12) \end{bmatrix} = \begin{bmatrix} 0 & 0 & 0 & \cdots & 0 \\ a_{21} & 0 & & & \\ a_{31} & a_{32} & & & \\ \vdots & & & & \\ a_{12,1} & a_{12,2} & \cdots & & a_{12,11} \end{bmatrix} \begin{bmatrix} \tilde{AS}(1) \\ \tilde{AS}(2) \\ \vdots \\ \tilde{AS}(11) \end{bmatrix}$$

12x1 12x11 1x1

Fixed Store

Scatter Plot of 20ms Phase and 10ms Phase Prediction Error

Scatter plot (gray dots) of 4th pair of ASIN(dc) intra-frame prediction error, the histogram along each direction, and the corresponding 1st-stage 5-bit VQ codebook and Voronoi regions.

Scatter plot of 1st pair of ASIN(k) (gray dots) and 1st-stage VQ codebook (small circles) and the corresponding voronoi cells Without hand-tuned rotation angles
inner cells 1st-stage VQ of 1st pair of ASIN(k)

With hand-tuned rotation angles
inner cells of 1st-stage VQ of 1st pair ASIN(k)

Inner-cell 1st-stage VQ error vector distribution (gray dots) (hand tuning) and corresponding 2nd stage VQ codebook (small circles) for 1st pair of ASIN(k)

Outer-cell 1st-stage VQ error vector distribution
and corresponding 2nd-stage VQ codebook (small circle)
for 1st pair of ASIN(k)

SCALABLE AND EMBEDDED CODEC FOR SPEECH AND AUDIO SIGNALS

FIELD OF THE INVENTION

The present invention relates to audio signal processing and is directed more particularly to a system and method for scalable and embedded coding of speech and audio signals.

BACKGROUND OF THE INVENTION

The explosive growth of packet-switched networks, such as the Internet, and the emergence of related multimedia applications (such as Internet phones, videophones, and video conferencing equipment) have made it necessary to communicate speech and audio signals efficiently between devices with different operating characteristics. In a typical Internet phone application, for example, the input signal is sampled at a rate of 8,000 samples per second (8 kHz), it is digitized, and then compressed by a speech encoder which outputs an encoded bit-stream with a relatively low bit-rate. The encoded bit-stream is packaged into data "packets", which are routed through the Internet, or the packet-switched network in general, until they reach their destination. At the receiving end, the encoded speech bit-stream is extracted from the received packets, and a decoder is used to decode the extracted bit-stream to obtain output speech. The term speech "codec" (coder and decoder) is commonly used to denote the combination of the speech encoder and the speech decoder in a complete audio processing system. To implement a codec operating at different sampling and/or bit rates, however, is not a trivial task.

The current generation of Internet multimedia applications typically uses codecs that were designed either for the conventional circuit-switched Public Switched Telephone Networks (PSTN) or for cellular telephone applications and therefore have corresponding limitations. Examples of such codecs include those built in accordance with the 13 kb/s (kilobits per second) GSM full-rate cellular speech coding standard, and ITU-T standards G.723.1 at 6.3 kb/s and G.729 at 8 kb/s. None of these coding standards was specifically designed to address the transmission characteristics and application needs of the Internet. Speech codecs of this type generally have a fixed bit-rate and typically operate at the fixed 8 kHz sampling rate used in conventional telephony.

Due to the large variety of bit-rates of different communication links for Internet connections, it is generally desirable, and sometimes even necessary, to link communication devices with widely different operating characteristics. For example, it may be necessary to provide high-quality, high bandwidth speech (at sampling rates higher than 8 kHz and bandwiths wider than the typical 3.4 kHz telephone bandwidth) over high-speed communication links, and at the same time provide lower-quality, telephone-bandwidth speech over slow communication links, such as low-speed modem connections. Such needs may arise, for example, in tele-conferencing applications. In such cases, when it is necessary to vary the speech signal bandwidth and transmission bit-rate in wide ranges, a conventional, although inefficient solution is to use several different speech codecs, each one capable of operating at a fixed pre-determined bit-rate and a fixed sampling rate. A disadvantage of this approach is that several different speech codecs have to be implemented on the same platform, thus increasing the complexity of the system and the total storage requirement for software and data used by these codecs. Furthermore, if the application requires multiple output bit-streams at multiple bit-rates, the system needs to run several different speech codecs in parallel, thus increasing the computational complexity.

The present invention addresses this problem by providing a scalable codec, i.e., a single codec architecture that can scale up or down easily to encode and decode speech and audio signals at a wide range of sampling rates (corresponding to different signal bandwidths) and bit-rates (corresponding to different transmission speed). In this way, the disadvantages of current implementations using several different speech codecs on the same platform are avoided.

The present invention also has another important and desirable feature: embedded coding, meaning that lower bit-rate output bit-streams are embedded in higher bit-rate bit-streams. For example, in an illustrative embodiment of the present invention, three different output bit-rates are provided: 3.2, 6.4, and 10 kb/s; the 3.2 kb/s bit-stream is embedded in (i.e., is part of) the 6.4 kb/s bit-stream, which itself is embedded in the 10 kb/s bit-stream. A 16 kHz sampled speech (the so-called "wideband speech", with 7 kHz speech bandwidth) signal can be encoded by such a scalable and embedded codec at 10 kb/s. In accordance with the present invention the decoder can decode the full 10 kb/s bit-stream to produce high-quality 7 kHz wideband speech. The decoder can also decode only the first 6.4 kb/s of the 10 kb/s bit-stream, and produce toll-quality telephone-bandwidth speech (8 kHz sampling), or it can decode only the first 3.2 kb/s portion of the bit-stream to produce good communication-quality, telephone-bandwidth speech. This embedded coding scheme enables this embodiment of the present invention to perform a single encoding operation to produce a 10 kb/s output bit-stream, rather than using three separate encoding operations to produce three separate bit-streams at three different bit-rates. Furthermore, in a preferred embodiment the system is capable of dropping higher-order portions of the bit-stream (i.e., the 6.4 to 10 kb/s portion and the 3.2 to 6.4 kb/s portion) anywhere along the transmission path. The decoder in this case is still able to decode speech at the lower bit-rates with reasonable quality. This flexibility is very attractive from a system design point of view.

Scalable and embedded coding are concepts that are generally known in the art. For example, the ITU-T has a 0.727 standard, which specifies a scalable and embedded ADPCM codec at 16, 24 and 32 kb/s. Another prior art is Phillips' proposal of a scalable and embedded CELP (Code Excited Linear Prediction) codec architecture for 14 to 24 kb/s [1997 IEEE Speech Coding Workshop]. However, the prior art only discloses the use of a fixed sampling rate of 8 kHz, and is designed for high bit-rate waveform codecs. The present invention is distinguished from the prior art in at least two fundamental aspects.

First, the proposed system architecture allows a single codec to easily handle a wide range of speech sampling rates, rather than a single fixed sampling rate, as in the prior art. Second, rather than using high bit-rate waveform coding techniques, such as ADPCM or CELP, the system of the present invention uses novel parametric coding techniques to achieve scalable and embedded coding at very low bit-rates (down to 3.2 kb/s and possibly even lower) and as the bit-rate increases enables a gradual shift away from parametric coding toward high-quality waveform coding. The combination of these two distinct speech processing paradigms, parametric coding and waveform coding, in the system of the present invention is so gradual that it forms a continuum between the two and allows arbitrary intermediate bit-rates to be used as possible output bit-rates in the embedded output bit-stream.

Additionally, the proposed system and method use in a preferred embodiment classification of the input signal frame into a steady state or a transition state modes. In a transition state mode, additional phase parameters are transmitted to the decoder to improve the quality of the synthesized signal.

Furthermore, the system and method of the present invention also allows the output speech signal to be easily manipulated in order to change its characteristics, or the perceived identity of the talker. For prior art waveform codecs of the type discussed above, it is nearly impossible or at least very difficult to make such modifications. Notably, it is also possible for the system and method of the present invention to encode, decode and otherwise process general audio signals other than speech.

For additional background information the reader is directed, for example, to prior art publications, including: Speech Coding and Synthesis, W. B. Kleijn, K. K. Paliwal, Chapter 4, R. J. McAulay and T. F Quatieri, Elsevier 1995; S. Furui M. M. Sondhi, Advances in Speech Signal Processing, Chapter 6, R. J. McAulay and T. F Quatieri, Marcel Dekker, Inc. 1992; D. B. Paul "The Spectral Envelope Estimation Vocoder", IEEE Trans. on Signal Processing, ASSP-29, 1981, pp 786-794; A. V. Oppenheim and R. W. Schafer, "Discrete-Time Signal Processing", Prentice Hall, 1989; L. R. Rabiner and R. W. Schafer, "Digital Processing of Speech Signals", Prentice Hall, 1978; L. Rabiner and B. H. Juang, "Fundamentals of Speech Recognition", page 116, Prentice Hall, 1983; A. V. McCree, "A new LPC vocoder model for low bit rate speech coding", Ph.D. Thesis, Georgia Institute of Technology, Atlanta, Ga., August 1992; R. J. McAulay and T. F. Quatieri, "Speech Analysis-Synthesis Based on a Sinusoidal Representation", IEEE Trans. Acoustics, Speech and Signal Processing, ASSP-34, (4), 1986, pp. 744-754.; R. J. McAulay and T. F. Quatieri, "Sinusoidal Coding", Chapter 4, Speech Coding and Synthesis, W. B. Kleijn and K. K. Paliwal, Eds, Elsevier Science B. V., New York, 1995; R. J. McAulay and T. F. Quatieri, "Low-rate Speech Coding Based on the Sinusoidal Model", Advances in Speech Signal Processing, Chapter 6, S. Furui and M. M. Sondhi, Eds, Marcel Dekker, New York, 1992; R. J. McAulay and T. F. Quatieri, "Pitch Estimation and Voicing Detection Based on a Sinusoidal Model", Proc, IEEE Int. Conf. Acoust., Speech and Signal Processing, Albuquerque, N. Mex., Apr. 3-6, 1990, pp. 249-252. and other references pertaining to the art.

SUMMARY OF THE INVENTION

Accordingly, it is an object of the present invention to overcome the deficiencies associated with the prior art.

Another object of the present invention is to provide a basic architecture, which allows a codec to operate over a range of bit-rate and sampling-rate applications in an embedded coding manner.

It is another object of the present invention to provide a codec with scalable architecture using different sampling rates, the ratios of which are powers of 2.

Another object of this invention is to provide an encoder (analyzer) enabling smooth transition from parametric signal representations, used for low bit-rate applications, into high bit-rate applications by using progressively increased number of parameters and increased accuracy of their representation.

Yet another object of the present invention is to provide a transform codec with multiple stages of increasing complexity and bit-rates.

Another object of the present invention is to provide non-linear signal processing techniques and implementations for refinement of the pitch and voicing estimates in processing of speech signals.

Another object of the present invention is to provide a low-delay pitch estimation algorithm for use with a scalable and embedded codec.

Another object of the present invention is to provide an improved quantization technique for transmitting parameters of the input signal using interpolation.

Yet another object of the present invention is to provide a robust and efficient multi-stage vector quantization (VQ) method for encoding parameters of the input signal.

Yet another object of the present invention is to provide an analyzer that uses and transmits mid-frame estimates of certain input signal parameters to improve the accuracy of the reconstructed signal at the receiving end.

Another object of the present invention is to provide time warping techniques for measured phase STC systems, in which the user can specify a time stretching factor without affecting the quality of the output speech.

Yet another object of the present invention is to provide an encoder using a vocal fry detector, which removes certain artifacts observable in processing of speech signals.

Yet another object of the present invention is to provide an analyzer capable of packetizing bit stream information at different levels, including embedded coding of information in a single packet, where the router or the receiving end of the system, automatically extract the required information from packets of information.

Alternatively it is an object of the present invention to provide a system, in which the output bit stream from the system analyzer is packetized in different priority-labeled packets, so that communication system routers, or the receiving end, can only select those priority packets which correspond to the communication capabilities of the receiving device.

Yet another object of the present invention is to provide a system and method for audio signal processing in which the input speech frame is classified into a steady state or a transition state modes. In a transition state mode, additional measured phase information is transmitted to the decoder to improve the signal reconstruction accuracy.

These and other objects of the present invention will become apparent with reference to the following detailed description of the invention and the attached drawings.

In particular, the present invention describes a system for processing audio signals comprising: (a) a splitter for dividing an input audio signal into a first and one or more secondary signal portions, which in combination provide a complete representation of the input signal, wherein the first signal portion contains information sufficient to reconstruct a representation of the input signal; (b) a first encoder for providing encoded data about the first signal portion, and one or more secondary encoders for encoding said secondary signal portions, wherein said secondary encoders receive input from the first signal portion and are capable of providing encoded data regarding the first signal portion; and (c) a data assembler for combining encoded data from said first encoder and said secondary encoders into an output data stream. In a preferred embodiment dividing the input signal is done in the frequency domain, and the first signal portion corresponds to the base band of the input signal. In a specific embodiment the signal portions are encoded at sampling rates different from that of the input signal. Preferably, embedded coding is used. The output data stream in a preferred embodiment comprises data packets suitable for transmission over a packet-switched network.

In another aspect, the present invention is directed to a system for embedded coding of audio signals comprising: (a) a frame extractor for dividing an input signal into a plurality of signal frames corresponding to successive time intervals; (b) means for providing parametric representations of the signal in each frame, said parametric representations being based on a signal model; (c) means for providing a first encoded data portion corresponding to a user-specified parametric representation, which first encoded data portion contains information sufficient to reconstruct a representation of the input signal; (d) means for providing one or more secondary encoded data portions of the user-selected parametric representation; and (e) means for providing an embedded output signal based at least on said first encoded data portion and said one or more secondary encoded data portions of the user-selected parametric representation. This system further comprises in various embodiments means for providing representations of the signal in each frame, which are not based on a signal model, and means for decoding the embedded output signal.

Another aspect of the present invention is directed to a method for multistage vector quantization of signals comprising: (a) passing an input signal through a first stage of a multistage vector quantizer having a predetermined set of codebook vectors, each vector corresponding to a Voronoi cell, to obtain error vectors corresponding to differences between a codebook vector and an input signal vector falling within a Voronoi cell; (b) determining probability density functions (pdfs) for the error vectors in at least two Voronoi cells; (c) transforming error vectors using a transformation based on the pdfs determined for said at least two Voronoi cells; and (d) passing transformed error vectors through at least a second stage of the multistage vector quantizer to provide a quantized output signal. The method further comprises the step of performing an inverse transformation on the quantized output signal to reconstruct a representation of the input signal.

Yet another aspect of the present invention is directed to a system for processing audio signals comprising (a) a frame extractor for dividing an input audio signal into a plurality of signal frames corresponding to successive time intervals; (b) a frame mode classifier for determining if the signal in a frame is in a transition state; (c) a processor for extracting parameters of the signal in a frame receiving input from said classifier, wherein for frames the signal of which is determined to be in said transition state said extracted parameters include phase information; and (d) a multi-mode coder in which extracted parameters of the signal in a frame are processed in at least two distinct paths dependent on whether the frame signal is determined to be in a transition state.

Further, the present invention is directed to a system for processing audio signals comprising: (a) a frame extractor for dividing an input signal into a plurality of signal frames corresponding to successive time intervals; (b) means for providing a parametric representation of the signal in each frame, said parametric representation being based on a signal model; (c) a non-linear processor for providing refined estimates of parameters of the parametric representation of the signal in each frame; and (d) means for encoding said refined parameter estimates. Refined estimates computed by the non-linear processor comprise an estimate of the pitch; an estimate of a voicing parameter for the input speech signal; and an estimate of a pitch onset time for an input speech signal.

BRIEF DESCRIPTION OF THE DRAWINGS

FIG. 4A shows an embodiment in which data generated at different stages of the embedded codec is assembled in a single packet. FIG. 4B shows a priority-based packaging scheme in which signal portions having different priority are transmitted by separate packets.

DETAILED DESCRIPTION OF THE INVENTION

A. Underlying Principles (1) Scalability Over Different Sampling Rates

Figure 1A:
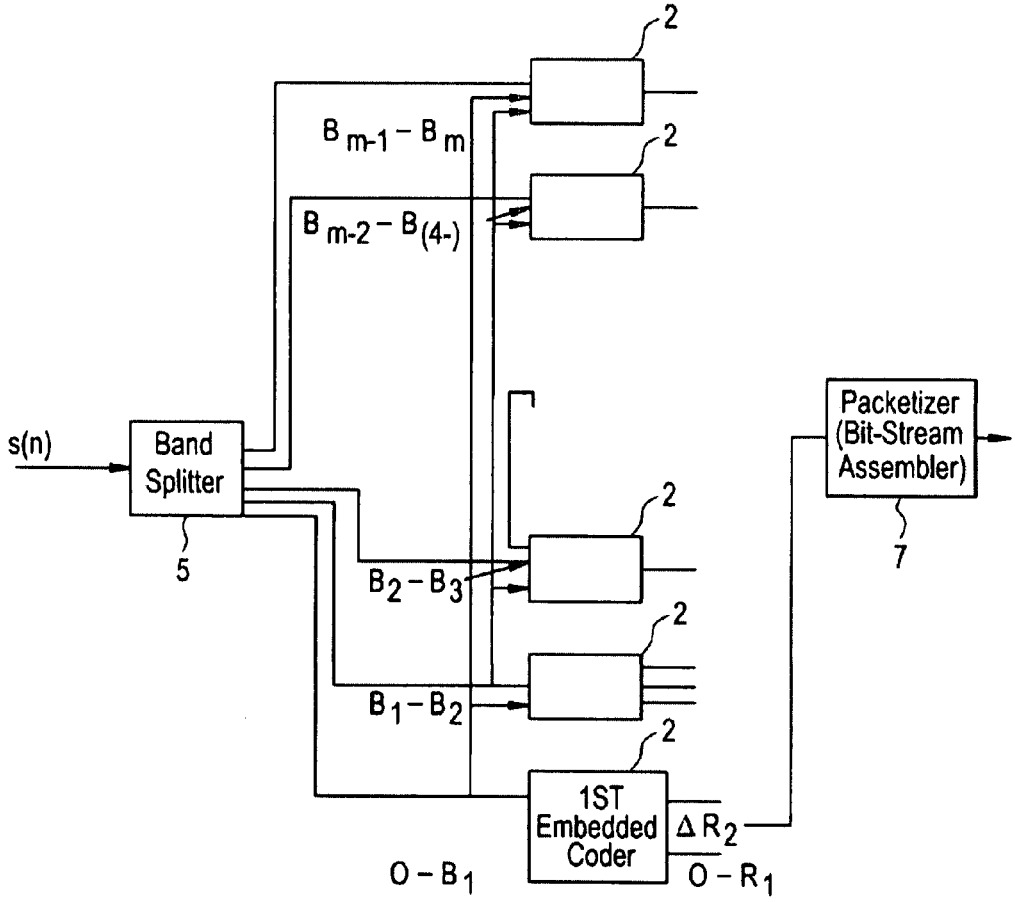
FIG. 1A is a block diagram of a generic scalable and embedded encoding system providing output bit stream suitable for different sampling rates.

FIG. 1A is a block diagram of a generic scalable and embedded encoding system in accordance with the present invention, providing output bit stream suitable for different sampling rates. The encoding system comprises 3 basic building blocks indicated in FIG. 1A as a band splitter 5, a plurality of (embedded) encoders 2 and a bit stream assembler or packetizer indicated as block 7. As shown in FIG. 1A, band splitter 5 operates at the highest available sampling rate and divides the input signal into two or more frequency "bands", which are separately processed by encoders 2. In accordance with the present invention, the band splitter 5 can be implemented as a filter bank, an FFT transform or wavelet transform computing device, or any other device that can split a signal into several signals representing different frequency bands. These several signals in different bands may be either in the time domain, as is the case with filter bank and subband coding, or in the frequency domain, as is the case with an FFT transform computation, so that the term "band" is used herein in a generic sense to signify a portion of the spectrum of the input signal.

Figure 1B:
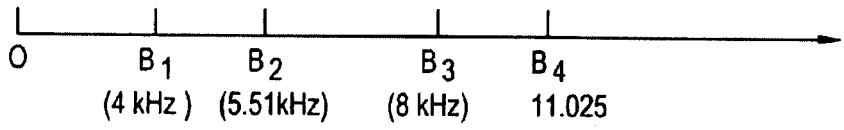
FIG. 1B shows an example of possible frequency bands that may be suitable for audio signal processing in commercial applications.

FIG. 1B shows an example of the possible frequency bands that may be suitable for commercial applications. The spectrum band from 0 to B1 (4 kHz) is of the type used in typical telephony applications. Band 2 between B1 and B2 in FIG. 1B may, for example, span the frequency band of 4 kHz to 5.5125 kHz (which is ⅛ of the sampling rate used in CD players). Band 3 between B2 and B3 may be from 5.5125 kHz to 8 kHz, for example. The following bands may be selected to correspond to other frequencies used in standard signal processing applications. Thus, the separation of the frequency spectrum in bands may be done in any desired way, preferably in accordance with industry standards.

Again with reference to FIG. 1A, the first embedded encoder 2, in accordance with the present invention, encodes information about the first band from 0 to B1. As shown in the figure, this encoder preferably is of embedded type, meaning that it can provide output at different bit-rates, dependent on the particular application, with the lower bit-rate bit-streams embedded in (i.e., "part of") the higher bit-rate bit-streams. For example, the lowest bit-rate provided by this encoder may be 3.2 kb/s shown in FIG. 1A as bit-rate R1. The next higher level corresponds to bit-rate R2 equal to bit-rate R1 plus an increment delta R2. In a specific application, R2 is 6.4 kb/s.

As shown in FIG. 1A, additional (embedded) encoders 2 are responsible for the remaining bands of the input signal. Notably, each next higher level of coding also receives input from the lower signal bands, which indicates the capability of the system of the present invention to use additional bits in order to improve the encoding of information contained in the lower bands of the signal. For example, using this approach, each higher level (of the embedded) encoder 2 may be responsible for encoding information in its particular band of the input signal, or may apportion some of its output to more accurately encode information contained in the lower band(s) of the encoder, or both.

Finally, information from all M encoders is combined in the bit-stream assembler or packetizer 7 for transmission or storage.

Figure 2A:
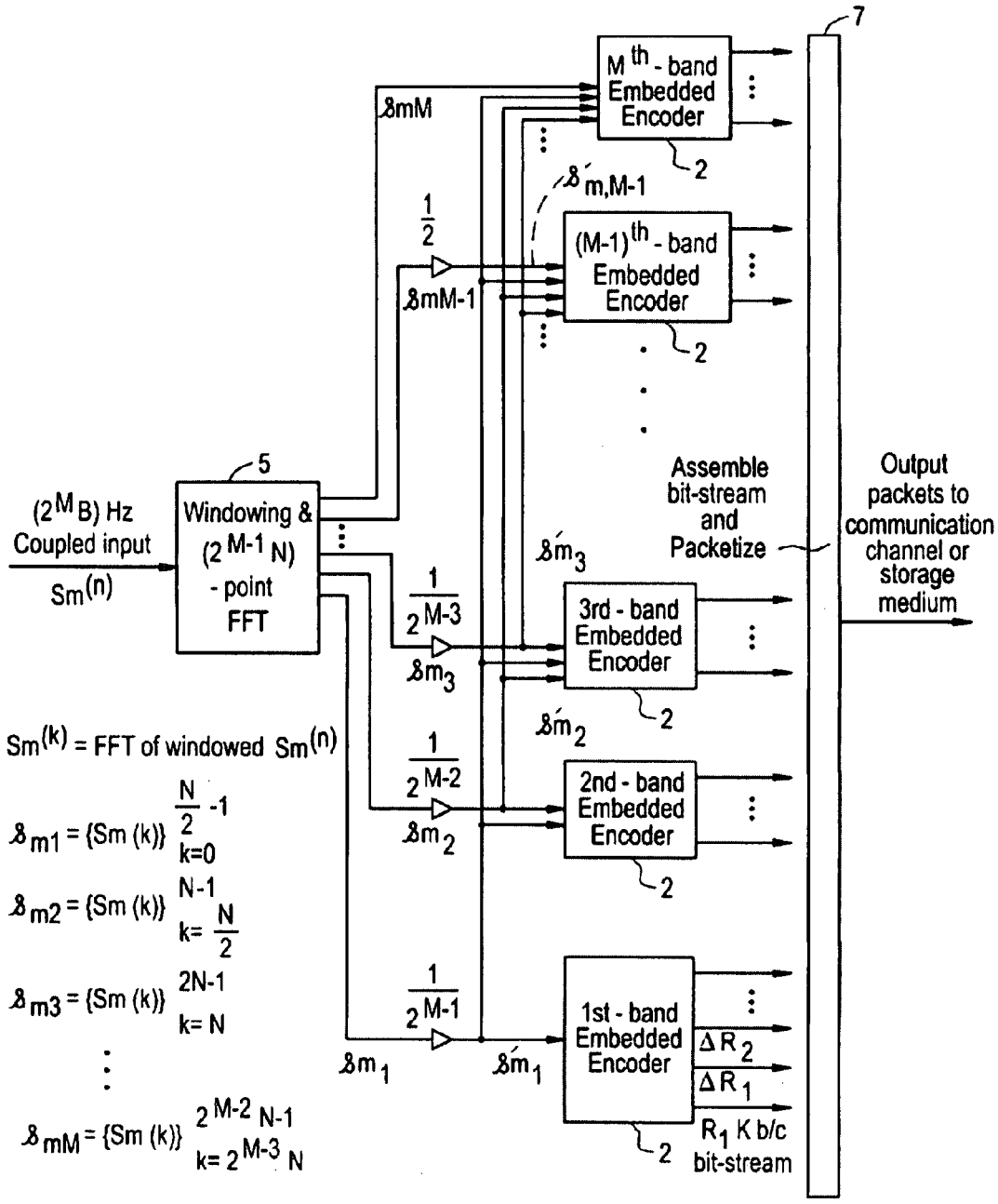
FIG. 2A is an FFT-based scalable and embedded codec architecture of encoder using octave band separation in accordance with the present invention.

FIG. 2A is a specific example of the encoding system shown in FIG. 1A, which is an FFT-based, scalable and embedded codec architecture operating on M octave bands. As shown in the figure, band splitter 5 is implemented using a $2^{M-1}$.N FFT of the incoming signal, M bands of its output being provided to M different encoders 2. In a preferred embodiment of the present invention, each encoder can be embedded, meaning that 2 or more separate and embedded bit-streams at different bit-rates may be generated by each individual encoder 2. Finally, block 7 assembles and packetizes the output bit stream.

If the decoding system corresponding to the encoding system in FIG. 2A has the same M bands and operates at the same sampling rate, then there is no need to perform the scaling operations at the input side of the first through the (M−1)th embedded encoder 2, as shown in FIG. 2A. However, a desirable and novel feature of the present invention is to allow a decoding system with fewer than M bands (i.e., operating at a lower sampling rate) to be able to decode a subset of the output embedded bit-stream produced by the encoding system in FIG. 2A, and do so with a low complexity by using an inverse FFT of a smaller size (smaller by a factor of a power of 2). For example, an encoding system may operate at a 32 kHz sampling rate using a 2048-point FFT, and a subset of the output bit-stream can be decoded by a decoding system operating at a sampling rate of 16 kHz using a 1024-point inverse FFT. In addition, a further reduced subset of the output bit-stream can be decoded in accordance with the present invention by another decoding system operating at a sampling rate of 8 kHz using a 512-point inverse FFT. The scaling factors in FIG. 2A allows this feature of the present invention to be achieved in a transparent manner. In particular, as shown in FIG. 2A, the scaling factor for the M−1 th encoder is ½, and it decreases until for the lower-most band designated as the 1st-band embedded encoder, the scaling factor is $\frac{1}{2}^{M-1}$.

Figure 2B:
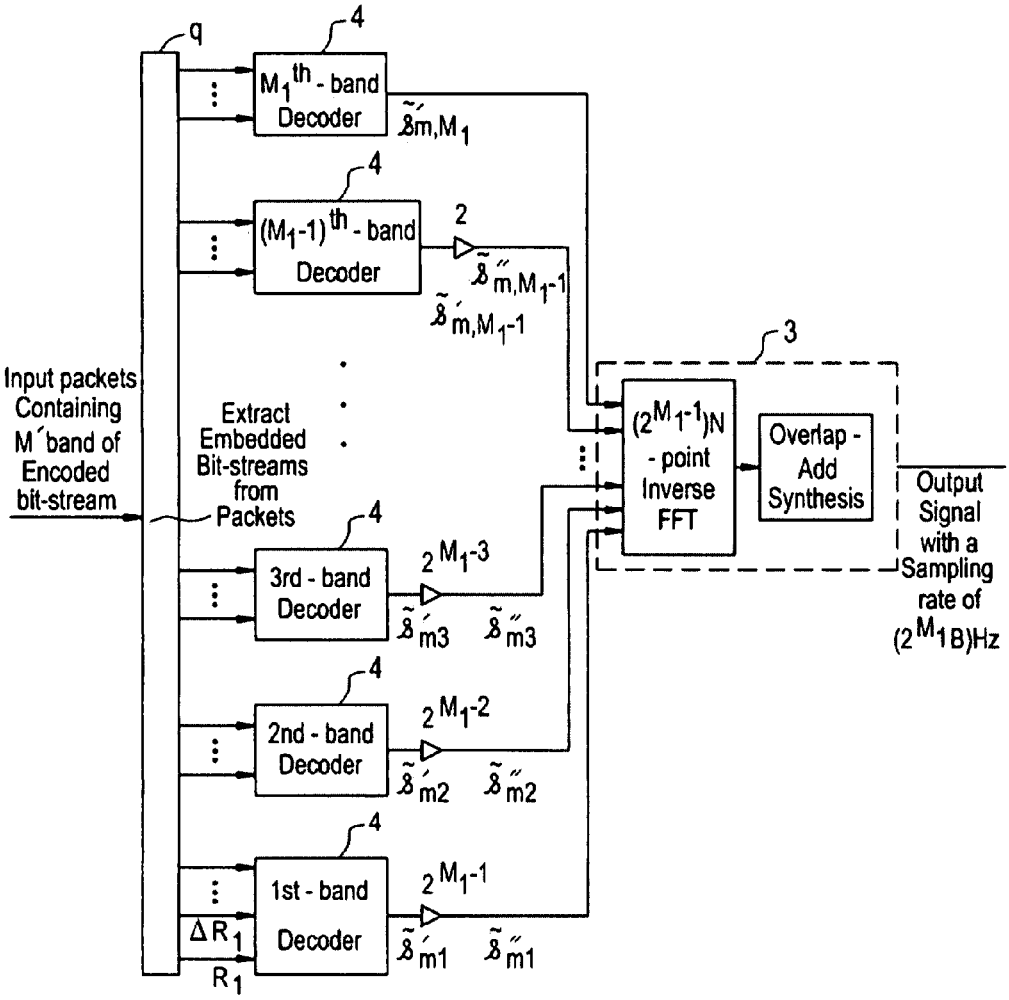
FIG. 2B is an FFT-based decoder architecture corresponding to the encoder in FIG. 2A.

FIG. 2B is a block diagram of the FFT-based decoder architecture corresponding to the encoder in FIG. 2A. Note that FIG. 2B is valid for an $M_1$-band decoding system, where $M_1$ can be any integer from 1 to M. As shown in the figure, input packets of data, containing $M_1$ bands of encoded bit stream information, are first supplied to block 9 which extracts the embedded bit streams from the individual data packets, and routes each bit stream to the corresponding decoder. Thus, for example, bit stream corresponding to data from the first band encoder will be decoded in block 9 and supplied to the first band decoder 4. Similarly, information in the bit stream that was supplied by the $M_1$-th band encoder will be supplied to the corresponding $M_1$-th band decoder.

As shown in the figure, the overall decoding system has $M_1$ decoders corresponding to the first $M_1$ encoders at the analysis end of the system. Each decoder performs the reverse operation of the corresponding encoder to generate an output bit stream, which is then scaled by an appropriate scaling factors, as shown in FIG. 2B. Next, the outputs of all decoders are supplied to block 3 which performs the inverse FFT of the incoming decoded data and applies, for example, overlap-add synthesis to reconstruct the original signal with the original sampling rate. It can be shown that due to the inherent scaling factor 1/N associated with the N-point inverse FFT, the special choices of the scaling factors shown in FIG. 2A and FIG. 2B allow the decoding system to decode the bit-stream at a lower sampling rate than what was used at the encoding system, and do this using a smaller inverse FFT size in a way that would maintain the gain level (or volume) of the decoded signal.

In accordance with the present invention, using the system shown in FIGS. 2A and 2B, users at the receiver end can decode information that corresponds to the communication capabilities of their respective devices. Thus, a user who is only capable of processing low bit-rate signals, may only choose to use the information supplied from the first band decoder. It is trivial to show that the corresponding output signal will be equivalent to processing an original input signal at a sampling rate which is $2^M$ times lower than the original sampling rate. Similar sampling rate scalability is achieved, for example, in subband coding, as known in the art. Thus, a user may only choose to reconstruct the low bit-rate output coming from the first band encoder. Alternatively, users who have access to wide-band telecommunication devices, may choose to decode the entire range of the input information, thus obtaining the highest available quality for the system.

The underlying principles can be explained better with reference to a specific example. Suppose, for example, that several users of the system are connected using a wide-band communications network, and wish to participate in a conference with other users that use telephone modems, with much lower bit-rates. In this case, users who have access to the high bit-rate information may decode the output coming from other users of the system with the highest available quality. By contrast, users having low bit-rate communication capabilities will still be able to participate in the conference, however, they will only be able to obtain speech quality corresponding to standard telephony applications.

(2) Scalability Over Different Bit Rates and Embedded Coding

The principles of embeddedness in accordance with the present invention are illustrated with reference to FIG. 3A, which is a block diagram of a sinusoidal transform coding (STC) encoder for providing embedded signal coding. It is well known that a signal can be modeled as a sum of sinusoids. Thus, for example, in STC processing, one may select the peaks of the FFT magnitude spectrum of that input signal and use the corresponding spectrum components to completely reconstruct the input signal. It is also known that each sinusoid is completely defined by three parameters: a) its frequency; b) its magnitude; and c) its phase. In accordance with a specific aspect of the present invention, the embedded feature of the codec is provided by progressively changing the accuracy with which different parameters of each sinusoid in the spectrum of an input signal are transmitted.

Figure 3A:
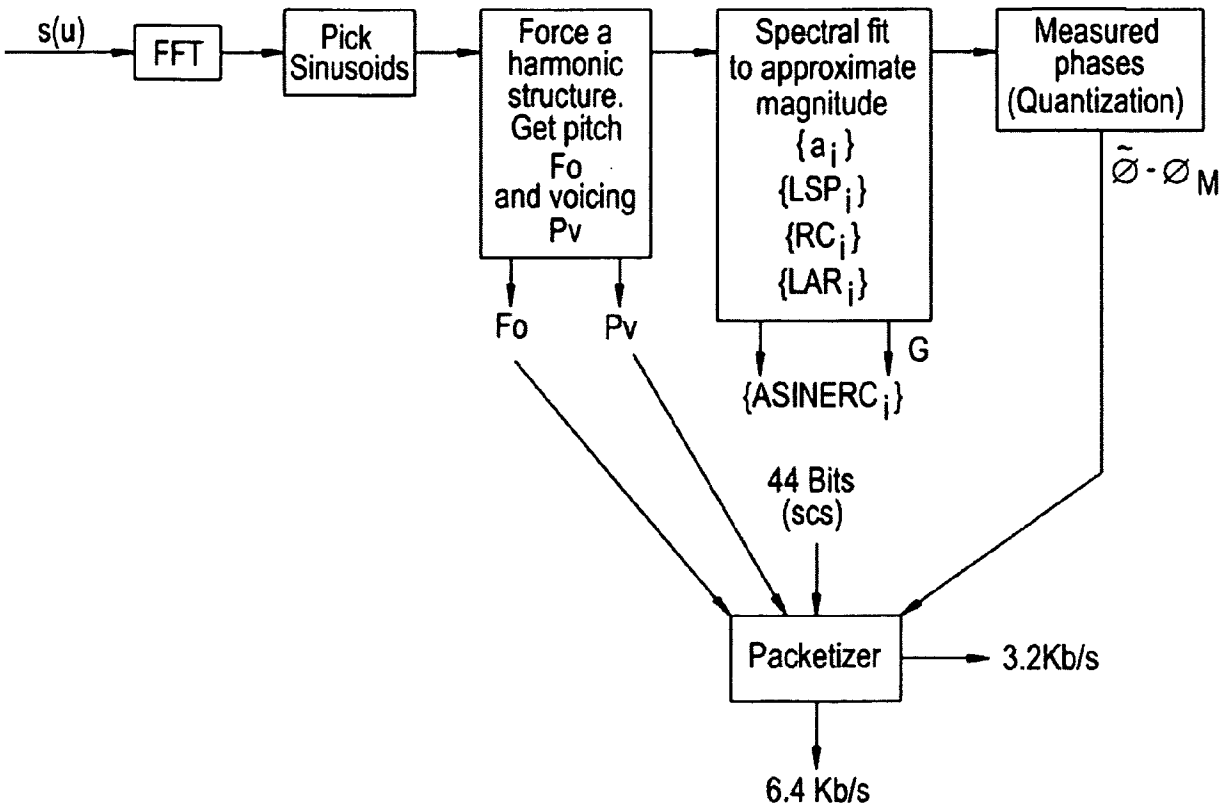
FIG. 3A is a block diagram of an illustrative embedded encoder in accordance with the present invention, using sinusoid transform coding.

For example, as shown in FIG. 3A, one way to reduce the encoding bit rate in accordance with the present invention is to impose a harmonic structure on the signal, which makes it possible to reduce the total number of frequencies to be transmitted to one—the frequency of the fundamental harmonic. All other sinusoids processed by the system are assumed in such an embodiment to be harmonically related to the fundamental frequency. This signal model is, for example, adequate to represent human speech. The next block in FIG. 3A shows that instead of transmitting the magnitudes of each sinusoid, one can only transmit information about the spectrum envelope of the signal. The individual amplitudes of the sinusoids can then be obtained in accordance with the present invention by merely sampling the spectrum envelope at pre-specified frequencies. As known in the art, the spectrum envelope can be encoded using different parameters, such as LPC coefficients, reflection coefficients (RC), and others. In speech applications it is usually necessary to provide a measure of how voiced (i.e., how harmonic) the signal is at a given time, and a measure of its volume or its gain. In very low bit-rate applications in accordance with the present invention one can therefore only transmit a harmonic frequency, a voicing probability indicating the extent to which the spectrum is dominated by voice harmonics, a gain, and a set of parameters which correspond to the spectrum envelope of the signal. In mid- and higher-bit-rate applications, in accordance with this invention one can add information concerning the phases of the selected sinusoids, thus increasing the accuracy of the reconstruction. Yet higher bit-rate applications may require transmission of actual sinusoid frequencies, etc., until in high-quality applications all sinewaves and all of their parameters can be transmitted with high accuracy.

Embedded coding in accordance with the present invention is thus based on the concept of using, starting with low bit-rate applications, of a simplified model of the signal with a small number of parameters, and gradually adding to the accuracy of signal representation at each next stage of bit-rate increase. Using this approach, in accordance with the present invention one can achieve incrementally higher fidelity in the reconstructed signal by adding new signal parameters to the signal model, and/or increasing the accuracy of their transmissions.

(3) The Method

In accordance with the underlying principles of the present invention set forth above, the method of the present invention generally comprises the following steps. First, the input audio or speech signal is divided into two or more signal portions, which in combination provide a complete representation of the input signal. In a specific embodiment, this division can be performed in the frequency domain so that the first portion corresponds to the base band of the signal, while other portions correspond to the high end of the spectrum.

Next, the first signal portion is encoded in a separate encoder that provides on output various parameters required to completely reconstruct this portion of the spectrum. In a preferred embodiment, the encoder is of the embedded type, enabling smooth transition from a low-bit rate output, which generally corresponds to a parametric representation of this portion of the input signal, to a high bit-rate output, which generally corresponds to waveform coding of the input capable of providing a reconstruction of the input signal waveform with high fidelity.

In accordance with the method of the present invention the transition from low-bit rate applications to high-bit rate applications is accomplished by providing an output bit stream that includes a progressively increased number of parameters of the input signal represented with progressively higher resolution. Thus, in the one extreme, in accordance with the method of the present invention the input signal can be reconstructed with high fidelity if all signal parameters are represented with sufficiently high accuracy. At the other extreme, typically designed for use by consumers with communication devices having relatively low-bit rate communication capabilities, the method of the present invention merely provides those essential parameters that are sufficient to render a humanly intelligible reconstructed signal at the synthesis end of the system.

In a specific embodiment, the minimum information supplied by the encoder consists of the fundamental frequency of the speaker, the voicing information, the gain of the signal and a set of parameters, which correspond to the shape of the spectrum envelope and the signal in a given time frame. As the complexity of the encoding increases, in accordance with the method of the present invention different parameters can be added. For example, this includes encoding the phases of different harmonics, the exact frequency locations of the sinusoids representing the signal (instead of the fundamental frequency of a harmonic structure), and next, instead of the overall shape of the signal spectrum, transmitting the individual amplitudes of the sinusoids. At each higher level of representation, the accuracy of the transmitted parameters can be improved. Thus, for example, each of the fundamental parameters used in a low-bit rate application can be transmitted using higher accuracy, i.e., increased number of bits.

In a preferred embodiment, improvement in the signal reconstruction a low bit rates is accomplished using mixed-phase coding in which the input signal frame is classified into two modes: a steady state and a transition mode. For a frame in a steady state mode the transmitted set of parameters does not include phase information. On the other hand, if the signal in a frame is in a transition mode, the encoder of the system measures and transmits phase information about a select group of sinusoids which is decoded at the receiving end to improve the overall quality of the reconstructed signal. Different sets of quantizers may be used in different modes.

This modular approach, which is characteristic for the system and method of the present invention, enables users with different communication devices operating at different sampling rates or bit-rate to communicate effectively with each other. This feature of the present invention is believed to be a significant contribution to the art.

Figure 3B:
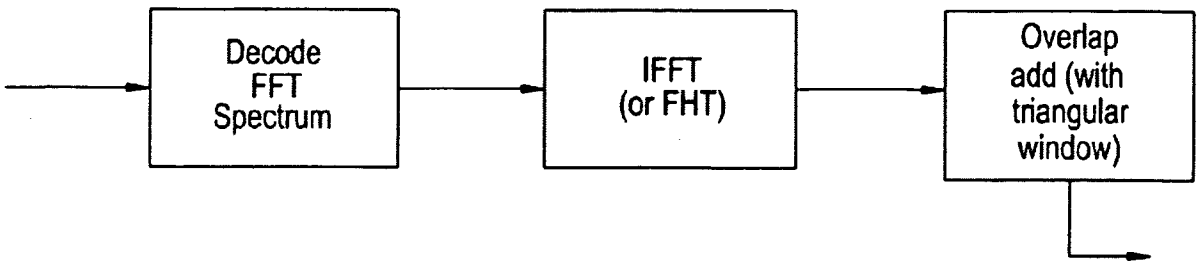
FIG. 3B is a block diagram of a decoder corresponding to the encoder in FIG. 3A.

FIG. 3B is a block diagram illustrating the operation of a decoder corresponding to the encoder shown in FIG. 3A. As shown in the figure, in a specific embodiment the decoder first decodes the FFT spectrum (handling problems such as the coherence of measured phases with synthetically generated phases), performs an inverse Fourier transform (or other suitable type of transform) to synthesize the output signal corresponding to a synthesis frame, and finally combines the signal of adjacent frames into a continuous output signal. As shown in the figure, such combination can be done, for example, using standard overlap-and-add techniques.

Figure 4A:
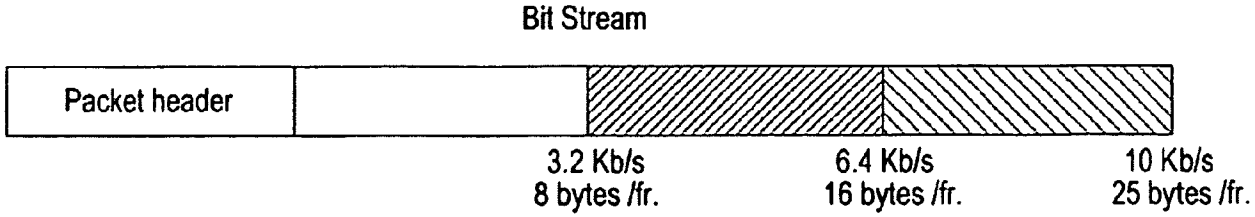
FIGS. 4A and 4B show two embodiments of bitstream packaging in accordance with the present invention.

FIG. 4 is an illustration of data packets assembled in accordance with two embodiments of the present invention to transport audio signals over packet switched networks, such as the Internet. As seen in FIG. 4A, in one embodiment of the present invention, data generated at different stages of the embedded codec can be assembled together in a single packet, as known in the art. In this embodiment, a router of the packet-switched network, or the decoder, can strip the packet header upon receipt and only take information which corresponds to the communication capacity of the receiving device. Thus, a device which is capable of operating at 6.4 kilobits per second (kb/s), upon receipt of a packet as shown in FIG. 4A can strip the last portion of the packet and use the remainder to reconstruct a rendition of the input signal. Naturally, a user capable of processing 10 kb/s will be able to reconstruct the entire signal based on the packet. In this embodiment a router can, for example, re-assemble the packets to include only a portion of the input signal bands.

Figure 4B:
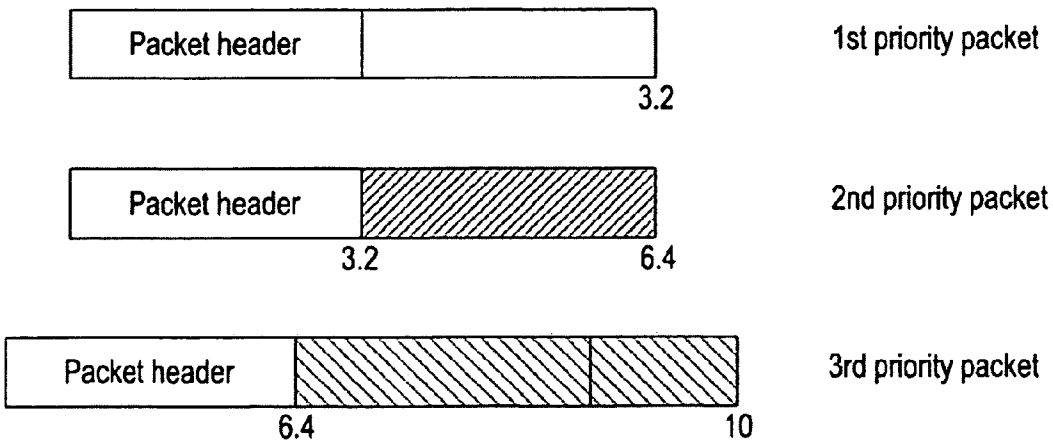

In an alternative embodiment of the present invention shown in FIG. 4B, packets which are assembled at the analyzer end of the system can be prioritized so that information corresponding to the lowest-bit rate application is inserted in a first priority packet, secondary information can be inserted in second- and third-priority packets, etc. In this embodiment of the present invention, users that only operate at the lowest-bit rate will be able to automatically separate the first priority packets from the remainder of the bit stream and use these packets for signal reconstruction. This embodiment enables the routers in the system to automatically select the priority packets for a given user, without the need to disassemble or reassemble the packets.

B. Description of the Preferred Embodiments

A specific implementation of a scalable embedded coder is described below in a preferred embodiment with reference to FIGS. 5, 6 and 7.

(1) The Analyzer

Figure 5:
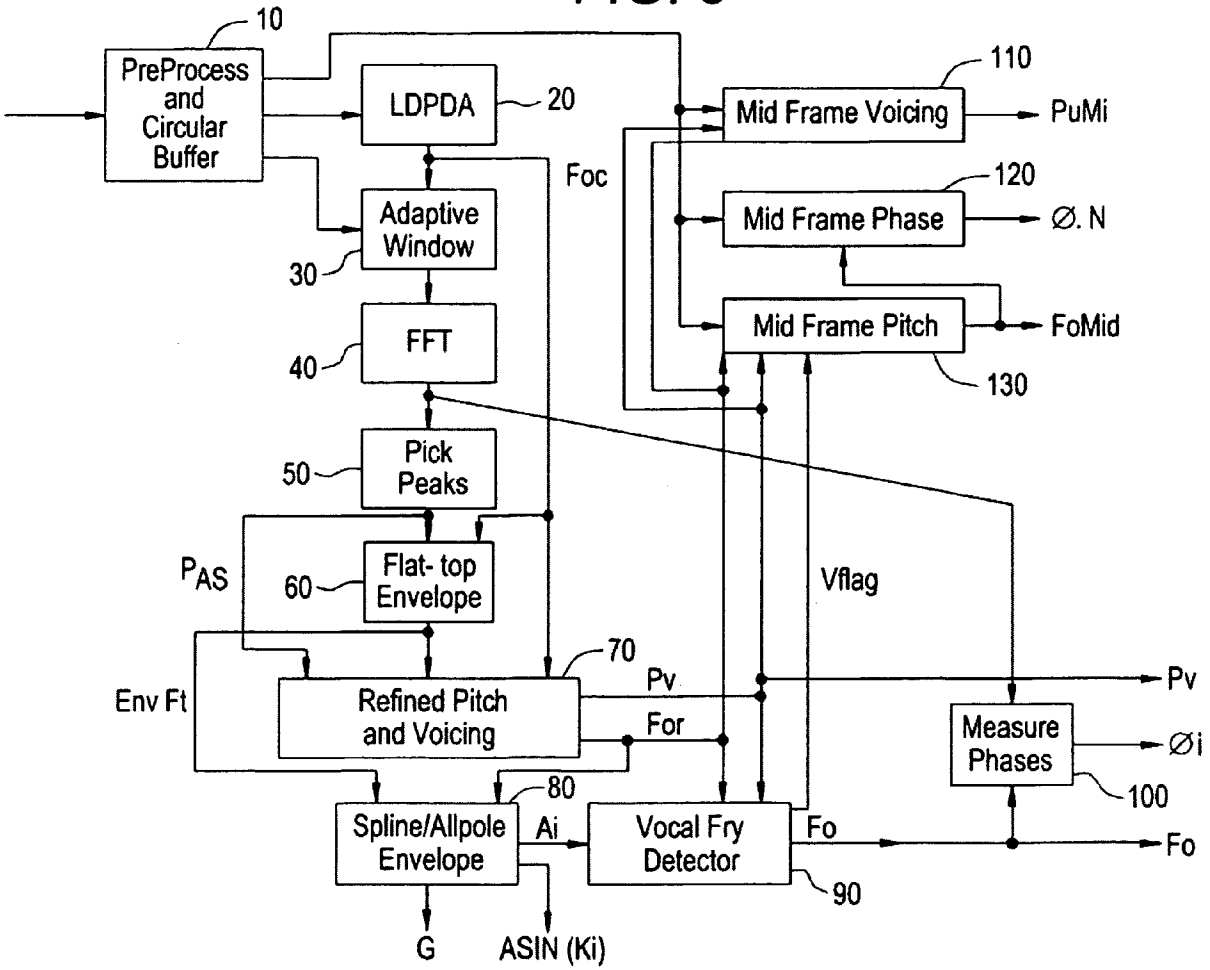
FIG. 5 is a block diagram of the analyzer in an embedded codec in accordance with a preferred embodiment of the present invention.

FIG. 5 is a block diagram of the analyzer in an embedded codec in accordance with a preferred embodiment of the present invention.

With reference to the block diagram in FIG. 5, the input speech is pre-processed in block 10 with a high-pass filter to remove the DC component. As known in the art, removal of 60 Hz hum can also be applied, if necessary. The filtered speech is stored in a circular buffer so it can be retrieved as needed by the analyzer. The signal is separated in frames, the duration of which in a preferred embodiment is 20 ms.

Frames of the speech signal extracted in block 10 are supplied next to block 20, to generate an initial coarse estimate of the pitch of the speech signal for each frame. Estimator block 20 operates using a fixed wide analysis window (preferably a 36.4 ms long Kaiser window) and outputs a coarse pitch estimate Foc that covers the range for the human pitch (typically 10 Hz to 1000 Hz). The operation of block 20 is described in further detail in Section B.4 below.

The pre-processed speech from block 10 is supplied also to processing block 30 where it is adaptively windowed, with a window the size of which is preferably about 2.5 times the coarse pitch period (Foc). The adaptive window in block 30 in a preferred embodiment is a Hamming window, the size of which is adaptively adjusted for each frame to fit between pre-specified maximum and minimum lengths. Section E.4 below describes a method to compute the coefficients of the filter on-the-fly. A modification to the window scaling is also provided to ensure that the codec has unity gain when processing voiced speech.

In block 40 of the analyzer, a standard real FFT of the windowed data is taken. The size of the FFT in a preferred embodiment is 512 points. Sampling rate-scaled embodiments of the present invention may use larger-size FFT processing, as shown in the preceding Section A.

Block 40 of the analyzer computes for each signal frame the location (i.e., the frequencies) of the peaks of the corresponding Fourier Transform magnitudes. Quadratic interpolation of the FFT magnitudes is used in a preferred embodiment to increase the resolution of the estimates for the frequency and amplitudes of the peaks. Both the frequencies and the amplitudes of the peaks are recorded.

Block 60 computes in a preferred embodiment a piecewise constant estimate (i.e., a zero order spline) of the spectral envelope, known in the art as a SEEVOC flat-top, using the spectral peaks computed in block 50, and the coarse pitch estimate Foc from block 20. The algorithm used in this block is similar to that used in the Spectral Envelope Estimation Vocoder (SEEVOC), which is known in the art.

In block 70, the pitch estimate obtained in block 20 is refined using in a preferred embodiment a local search around the coarse pitch estimate $F_{OC}$ of the analyzer. Block 70 also estimates the voicing probability of the signal. The inputs to this block, in a preferred embodiment, are the spectral peaks (obtained in block 40), the SEEVOC flat-top, and the coarse pitch estimate $F_{OC}$. Block 70 uses a novel non-linear signal processing technique described in further detail in Section C.

The refined pitch estimate obtained in block 70 and the SEEVOC flat-top spectrum envelope are used to create in block 80 of the analyzer a smooth estimate of the spectral envelope using in a preferred embodiment cubic spline interpolation between peaks. In a preferred embodiment, the frequency axis of this envelope is then warped on a perceptual scale, and the warped envelope is modeled with an all-pole model. As known in the art, perceptual-scale warping is used to account for imperfections of the human hearing in the higher end of the spectrum. A 12th order all-pole model is used in a specific embodiment, but the model order used for processing speech may be selected in the range from 10 to about 22. The gain of the input signal is approximated as the prediction residual of the all-pole model, as known in the art.

Block 90 of the analyzer is used in accordance with the present invention to detect the presence of pitch period doubles (vocal fry), as described in further detail in Section B.6 below.

In a preferred embodiment of the present invention, parameters supplied from the processing blocks discussed above are the only ones used in low-bit rate implementations of the embedded coder, such as a 3.2 kb/s coder. Additional information can be provided for higher bit-rate applications as described in further detail next.

In particular, for higher bit rates, the embedded codec in accordance with a preferred embodiment of the present invention provides additional phase information, which is extracted in block 100 of the analyzer. In a preferred embodiment, an estimate of the sine-wave phases of the first M pitch harmonics is provided by sampling the Fourier Transform computed in block 40 at the first M multiples of the final pitch estimate. The phases of the first 8 harmonics are determined and stored in a preferred embodiment.

Blocks 110, 120 and 130 are used in a preferred embodiment to provide mid-frame estimates of certain parameters of the analyzer which are ordinarily updated only at the frame rate (20 ms in a preferred embodiment). In particular, the mid-frame voicing probability is estimated in block 110 from the pre-processed speech, the refined pitch estimates from the previous and current frames, and the voicing probabilities from the previous and current frames. The mid-frame sine-wave phases are estimated in block 120 by taking a DFT of the input speech at the first M harmonics of the mid-frame pitch.

The mid-frame pitch is estimated in block 130 from the pre-processed speech, the refined pitch estimates from the previous and current frames, and the voicing probabilities from the previous and current frames.

The operation of blocks 110, 120 and 130 is described in further detail in Section B.5 below.

(2) The Mixed-Phase Encoder

The basic Sinusoidal Transform Coder (STC), which does not transmit the sinusoidal phases, works quite well for steady-state vowel regions of speech. In such steady-state regions, whether sinusoidal phases are transmitted or not does not make a big difference in terms of speech quality. However, for other parts of the speech signal, such as transition regions, often there is no well-defined pitch frequency or voicing, and even if there is, the pitch and voicing estimation algorithms are more likely to make errors in such regions. The result of such estimation errors in pitch and voicing is often quite audible distortion. Empirically it was found that when the sinusoidal phases are transmitted, such audible distortion is often alleviated or even completely eliminated. Therefore, transmitting sinusoidal phases improves the robustness of the codec in transition regions although it doesn't make that much of a perceptual difference in steady-state voiced regions. Thus, in accordance with a preferred embodiment of the present invention, multi-mode sinusoidal coding can be used to improve the quality of the reconstructed signal at low bit rates where certain phases are transmitted only during transition state, while during steady-state voiced regions no phases are transmitted, and the receiver synthesizes the phases.

Specifically, in a preferred embodiment, the codec classifies each signal frame into two modes, steady state or transition state, and encodes the sinusoidal parameters differently according to which mode the speech frame is in. In a preferred embodiment, a frame size of 20 ms is used with a look-ahead of 15 ms. The one-way coding delay of this codec is 55 ms, which meets the ITU-T's delay requirements.

Figure 5A:
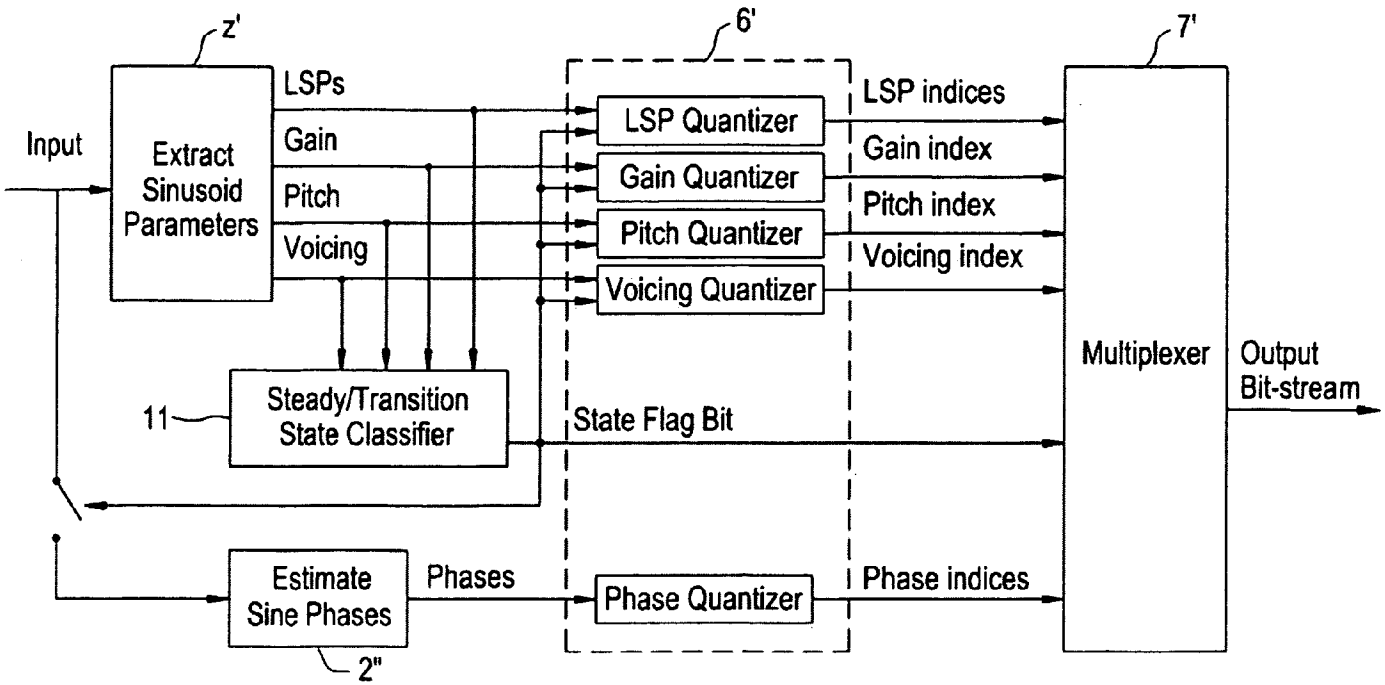
FIG. 5A is a block diagram of a multi-mode, mixed phase encoder in accordance with a preferred embodiment of the present invention.

The block diagram of an encoder in accordance with this preferred embodiment of the present invention is shown in FIG. 5A. For each frame of buffered speech, the encoder 2' performs analysis to extract the parameters of the set of sinusoids which best represents the current frame of speech. As illustrated in FIG. 5 and discussed in the preceding section, such parameters include the spectral envelope, the overall frame gain, the pitch, and the voicing, as are well-known in the art. A steady/transition state classifier 11 examines such parameters and determine whether the current frame is in the steady state or transition state. The output is a binary decision represented by the state flag bit supplied to assemble and package multiplexer block 7'.

With reference to FIG. 5A, classifier 11 determines which state the current speech frame is, and the remaining speech analysis and quantization is based on this determination. More specifically, on input the classifier uses the following parameters: pitch, voicing, gain, autocorrelation coefficients (or the LSPs), and the previous speech-state. The classifier estimates the state of the signal frame by analyzing the stationarity in the input parameter set from one frame to the next. A weighted measure of this stationarity is compared to a threshold which is adapted based on the previous frame-state and a decision is made on the current frame state. The method used by the classifier in a preferred embodiment of the present invention is described below using the following notations:

| | |
|---|---|
| Pitch | P, where P is the pitch period expressed in samples |
| Voicing Probability | Pv |
| Gain | G, where G is log base 2 of the gain in linear domain |
| Autocorrelation Coefficients | A [m], where m is the integer time lag |
| param_1 | previous frame value of "param" ("param" can be P, Pv, G, or A [m] ) |

Voicing

The change in voicing from one frame to the next is calculated as $$dPv=\mathrm{abs}(Pv-Pv_1)$$

Pitch

The change in pitch from one frame to the next is calculated as $$dP=\mathrm{abs}(\log2(Fs/P)-\log2(Fs/P_1))$$

where P is measured in the time domain (samples), and Fs is the sampling frequency (8000 Hz). This basically measures the relative change in logarithmic pitch frequency.

Gain

The change in the gain (in log2 domain) is calculated as:

$$dG=\mathrm{abs}(G-G_1)$$

where G is the logarithmic gain, or the base-2 logarithm of the gain value that is expressed in the linear domain.

Autocorrelation Coefficients

The change in the first M autocorrelation coefficients is calculated as:

$$dA=\mathrm{sum}(I=1 \text{ to } M)\ \mathrm{abs}(A[I]/A[0]-A_1[I]/A_1[0]).$$

Note that in FIG. 5A the LSP coefficients are shown as input to classifier 11. LSPs can be converted to autocorrelation coefficients used in the formula above within the classifier, as known in the art. Other sets of coefficients can be used in alternate embodiments.

On the basis of the above parameters, the stationarity measure for the frame is calculated as $$dS=dP/P_TH+dPv/PV_TH+dG/G_TH+dA/A_TH+(1.0-A[P]/A[0])/AP_TH$$

where P_TH, PV_TH, G_TH, A_TH, and AP_TH are fixed thresholds determined experimentally. The stationarity measure threshold (S_TH) is determined experimentally and is adjusted based on the previous state decision. In a specific embodiment, if the previous frame was in a steady state, S_TH=a, else S_TH=b, where a and b are experimentally determined constants.

Accordingly, a frame is classified as steady-state if dS <S_TH and voicing, gain, and A[P]/A[0] exceed some minimum thresholds. On output, as shown in FIG. 5A, classifier 11 provides a state flag, a simple binary indicator of either steady-state or transition-state.

In this embodiment of the present invention the state flag bit from classifier 11 is used to control the rest of the encoding operations. Two sets of parameter quantizers, collectively designated as block 6' are trained, one for each of the two states. In a preferred embodiment, the spectral envelope information is represented by the Line-Spectrum Pair (LSP) parameters. In operation, if the input signal is determined to be in a steady-state mode, only the LSP parameters, frame gain G, the pitch, and the voicing are quantized and transmitted to the receiver. On the other hand, in the transition state mode, the encoder additionally estimates, quantizes and transmits the phases of a selected set of sinusoids. Thus, in a transition state mode, supplemental phase information is transmitted in addition to the basic information transmitted in the steady state mode.

After the quantization of all sinusoidal parameters is completed, the quantizer 6' outputs codeword indices for LSP, gain, pitch, and voicing (and phase in the case of transition state). In a preferred embodiment of the present invention two parity bits are finally added to form the output bit-stream of block 7'. The bit allocation of the transmitted parameters in different modes is described in Section D(3).

(3) The Synthesizer

Figure 6:
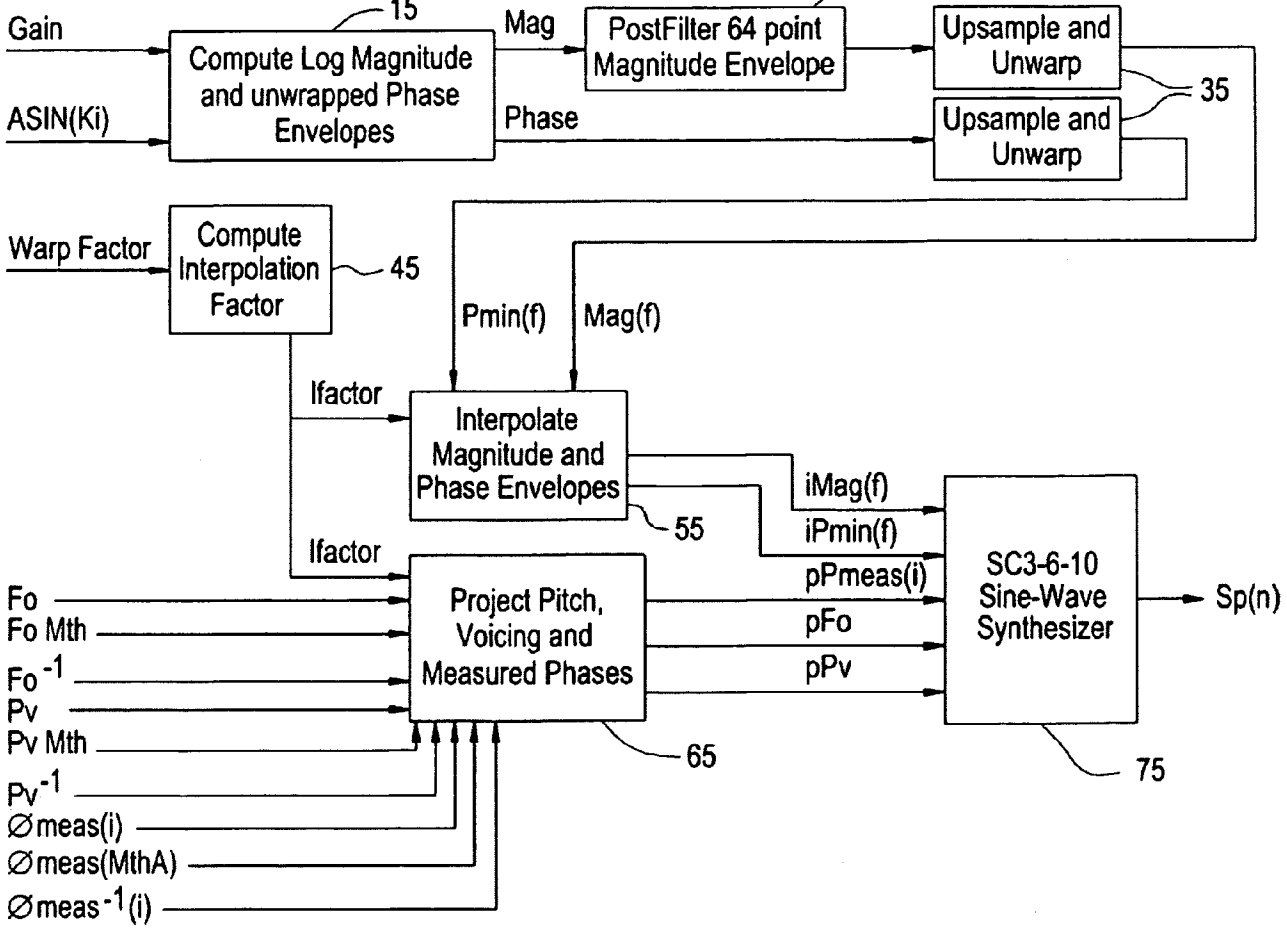
FIG. 6 is a block diagram of the decoder in an embedded codec in a preferred embodiment of the present invention.

FIG. 6 is a block diagram of the decoder (synthesizer) of an embedded codec in a preferred embodiment of the present invention. The synthesizer of this invention reconstructs speech at intervals which correspond to sub-frames of the analyzer frames. This approach provides processing flexibility and results in perceptually improved output. In a specific embodiment, a synthesis sub-frame is 10 ms long.

In a preferred embodiment of the synthesizer, block 15 computes 64 samples of the log magnitude and unwrapped phase envelopes of the all-pole model from the arcsin of the reflection coefficients (RCs) and the gain (G) obtained from the analyzer. (For simplicity, the process of packetizing and de-packetizing data between two transmission points is omitted in this discussion.)

The samples of the log magnitude envelope obtained in block 15 are filtered to perceptually enhance the synthesized speech in block 25. The techniques used for this are described in Section E.1, which provides a detailed discussion of a constant complexity post-filtering implementation used in a preferred embodiment of the synthesizer.

In the following block 35, the magnitude and unwrapped phase envelopes are upsampled to 256 points using linear interpolation in a preferred embodiment. Alternatively, this could be done using the Discrete Cosine Transform (DCT) approach described in Section E.1. The perceptual warping from block 80 of the analyzer (FIG. 5) is then removed from both envelopes.

In accordance with a preferred embodiment, the embedded codec of the present invention provides the capability of "warping", i.e., time scaling the output signal by a user-specified factor. Specific problems encountered in connection with the time-warping feature of the present invention are discussed in Section E.2. In block 45, a factor used to interpolate the log magnitude and unwrapped phase envelopes is computed. This factor is based on the synthesis sub-frame and the time warping factor selected by the user.

In a preferred embodiment block 55 of the synthesizer interpolates linearly the log magnitude and unwrapped phase envelopes obtained in block 35. The interpolation factor is obtained from block 45 of the synthesizer.

Block 65 computes the synthesis pitch, the voicing probability and the measured phases from the input data based on the interpolation factor obtained in block 45. As seen in FIG. 6, block 65 uses on input the pitch, the voicing probability and the measured phases for: (a) the current frame; (b) the mid-frame estimates; and (c) the respective values for the previous frame. When the time scale of the synthesis waveform is warped, the measured phases are modified using a novel technique described in further detail in Section E.2.

Output block 75 in a preferred embodiment of the present invention is a Sine-Wave Synthesizer which, in a preferred embodiment, synthesizes 10 ms of output signal from a set of input parameters. These parameters are the log magnitude and unwrapped phase envelopes, the measured phases, the pitch and the voicing probability, as obtained from blocks 55 and 65.

(4) The Sine-Wave Synthesizer

Figure 7:
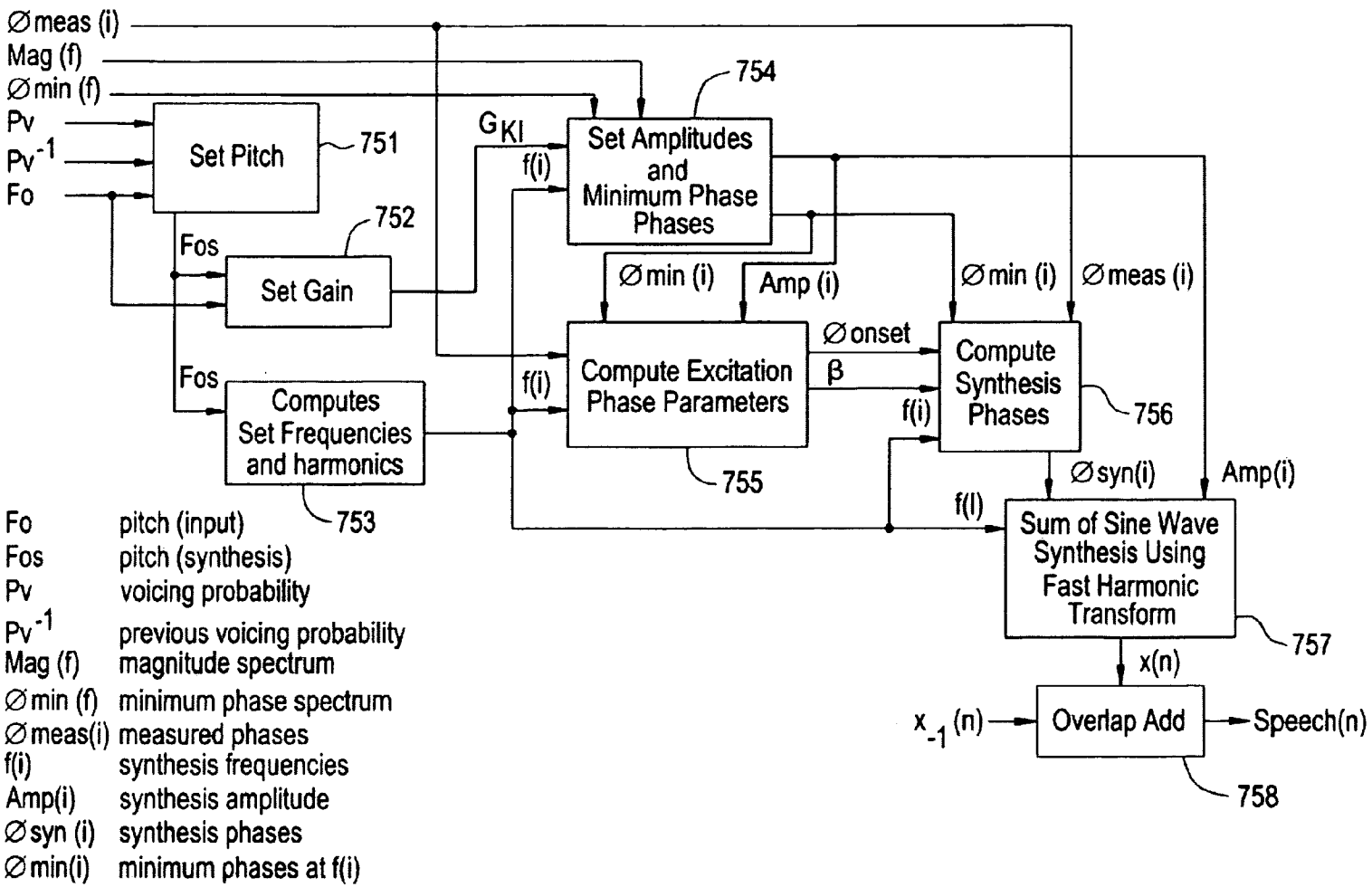
FIG. 7 is a detailed block diagram of the sine-wave synthesizer shown in FIG. 6.

FIG. 7 is detailed block diagram of the sine wave synthesizer shown in FIG. 6. In block 751 the current- and receding-frame voicing probabilities are first examined, and if the speech is determined to be unvoiced, the pitch used for synthesis is set below a predetermined threshold. This operation is applied in the preferred embodiment to ensure that there are enough harmonics to synthesize a pseudo-random waveform that models the unvoiced speech.

A gain adjustment for the unvoiced harmonics is computed in block 752. The adjustment used in the preferred embodiment accounts for the fact that measurement of noise spectra requires a different scale factor than measurement of harmonic spectra. On output, block 752 provides the adjusted gain $G_{KL}$ parameter.

The set of harmonic frequencies to be synthesized is determined based on the synthesis pitch in block 753. These harmonic frequencies are used in a preferred embodiment to sample the spectrum envelope in block 754.

In block 754, the log magnitude and unwrapped phase envelopes are sampled at the synthesis frequencies supplied from block 753. The gain adjustment $G_{KL}$ is applied to the harmonics in the unvoiced region. Block 754 outputs the amplitudes of the sinusoids, and corresponding minimum phases determined from the unwrapped phase envelopes.

The excitation phase parameters are computed in the following block 755. For the low bit-rate coder (3.2 kb/s) these parameters are determined using a synthetic phase model, as known in the art. For mid- and high bit-rate coders (e.g., 6.4 kb/s) these are estimated in a preferred embodiment from the baseband measured phases, as described below. A linear phase component is estimated, which is used in the synthetic phase model at the frequencies for which the phases were not coded.

The synthesis phase for each harmonic is computed in block 756 from the samples of the all-pole envelope phase, the excitation phase parameters, and the voicing probability. In a preferred embodiment, for sinusoids at frequencies above the voicing cutoff for which the phases were not coded, a random phase is used.

The harmonic sine-wave amplitudes, frequencies and phases are used in the embodiment shown in FIG. 7 in block 757 to synthesize a signal, which is the sum of those sine-waves. The sine-waves synthesis is performed as known in the art, or using a Fast Harmonic Transform.

In a preferred embodiment, overlap-add synthesis of the sum of sine-waves from the previous and current sub-frames is performed in block 758 using a triangular window.

(5) The Mixed-Phase Decoder

Figure 6A:
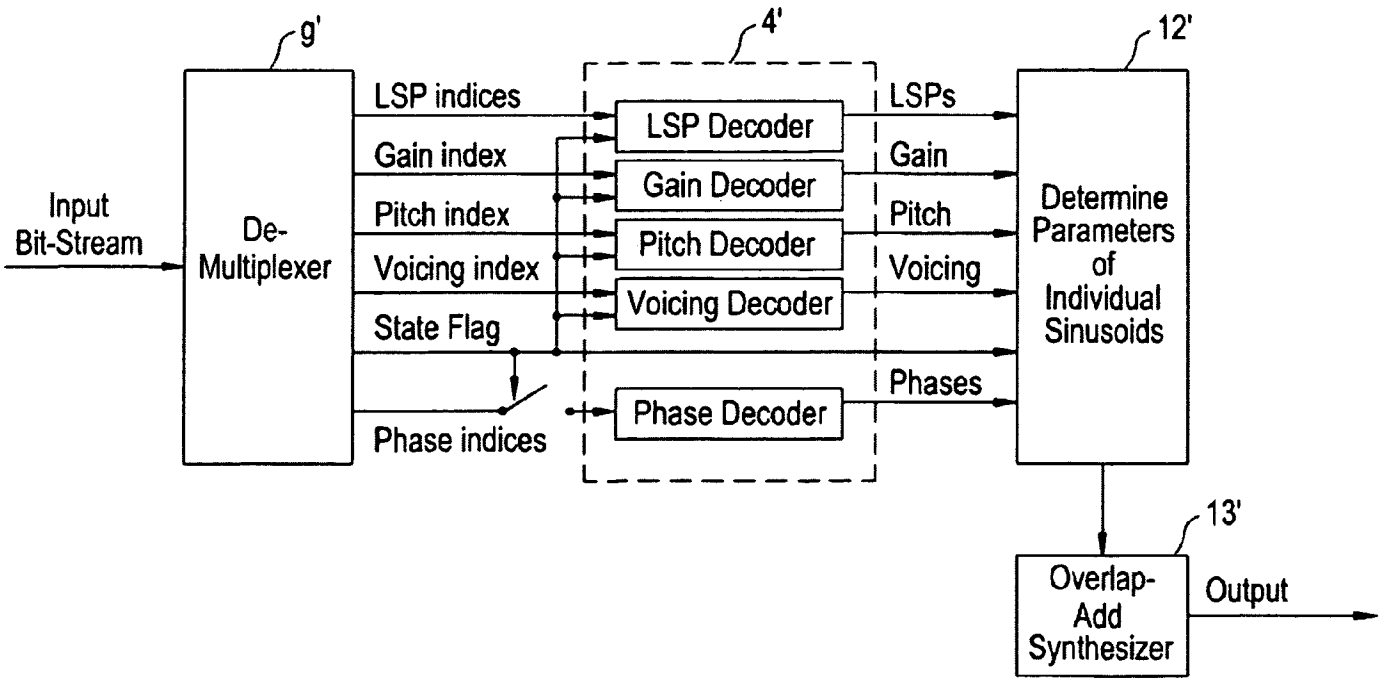
FIG. 6A is a block diagram of a multi-mode, mixed phase decoder which corresponds to the encoder in FIG. 5A.

This section describes a decoder used in accordance with a preferred embodiment of the present invention of a mixed-phase codec. The decoder corresponds to the encoder described in Section B(2) above. The decoder is shown in a block diagram in FIG. 6A. In particular, a demultiplexer 9' first separates the individual quantizer codeword indices from the received bit-stream. The state flag is examined first in order to determine whether the received frame represents a steady state or a transition state signal and, accordingly, how to extract the quantizer indices of the current frame. If the state flag bit indicates the current frame is in the steady state, decoder 9' extracts the quantizer indices for the LSP (or autocorrelation coefficients, see Section B(2)), gain, pitch, and voicing parameters. These parameters are passed to decoder block 4' which uses the set of quantizer tables designed for the steady-state mode to decode the LSP parameters, gain, pitch, and voicing.

If the current frame is in the transition state, the decoder 4' uses the set of quantizer tables for the transition state mode to decode phases in addition to LSP parameters, gain, pitch, and voicing.

Once all such transmitted signal parameters are decoded, the parameters of all individual sinusoids that collectively represent the current frame of the speech signal are determined in block 12'. This final set of parameters is utilized by a harmonic synthesizer 13' to produce the output speech waveform using the overlap-add method, as is known in the art.

(6) The Low Delay Pitch Estimator

Figure 8:
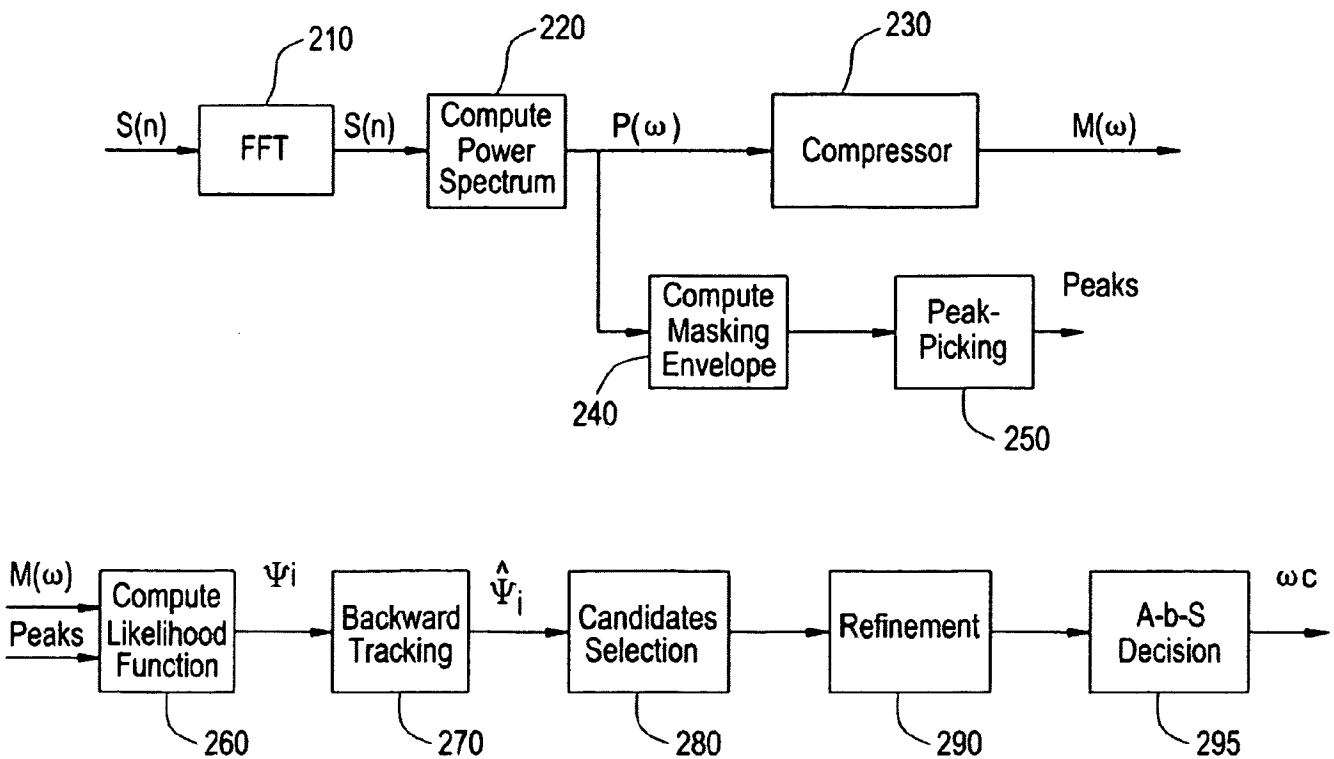
FIG. 8 is a block diagram of a low-delay pitch estimator used in accordance with a preferred embodiment of the present invention.

With reference to FIG. 5, it was noted that the system of the present invention uses in a preferred embodiment a low-delay coarse pitch estimator, block 20, the output of which is used by several blocks of the analyzer. FIG. 8 is a block diagram of a low-delay pitch estimator used in accordance with a preferred embodiment of the present invention.

Block 210 of the pitch estimator performs a standard FFT transform computation of the input signal. As known in the art, the input signal frame is first windowed. To obtain higher resolution in the frequency domain it is desirable to use a relatively large analysis window. Thus, in a preferred embodiment, block 210 uses a 291 point Kaiser window function with a coefficient $\beta$=6.0. The time-domain windowed signal is then transformed into the frequency domain using a 512 point FFT computation, as known in the art.

The following block 220 computes the power spectrum of the signal from the complex frequency response obtained in FFT block 210, using the expression:

$$P(\omega)=Sr(\omega)*Sr(\omega)+Si(\omega)*Si(\omega);$$

where Sr(ω) and Si(ω) are the real and imaginary parts of the corresponding Fourier transform, respectively.

Block 230 is used in a preferred embodiment to compress the dynamic range of the resulting power spectrum in order to increase the contribution of harmonics in the higher end of the spectrum. In a specific embodiment, the compressed power spectrum M(ω) is obtained using the expression M(ω)=P(ω)^γ, where γ=0.25.

Block 240 computes a masking envelope that provides a dynamic thresholding of the signal spectrum to facilitate the peak picking operation in the following block 250, and to eliminate certain low-level peaks, which are not associated with the harmonic structure of the signal. In particular, the power spectrum P(ω) of the windowed signal frequently exhibits some low level peaks due to the side lobe leakage of the windowing function, as well as to the non-stationarity of the analyzed input signal. For example, since the window length is fixed for all pitch candidates, high pitched speakers tend to introduce non-pitch-related peaks in the power spectrum, which are due to rapidly modulated pitch frequencies over a relatively long time period (in other words, the signal in the frame can no longer be considered stationary). To make the pitch estimation algorithm robust, in accordance with a preferred embodiment of the present invention a masking envelope is used to eliminate the (typically low level) side-effect peaks.

In a preferred embodiment of the present invention, the masking envelope is computed as an attenuated LPC spectrum of the signal in the frame. This selection gives good results, since the LPC envelope is known to provide a good model of the peaks of the spectrum if the order of the modeling LPC filter is sufficiently high. In particular, the LPC coefficients used in block 240 are obtained from the low band power spectrum, where the pitch is found for most speakers.

In a specific embodiment, the analysis bandwidth $F_{base}$ is speech adaptive and is chosen to cover 90% of the energy of the signal at the 1.6 kHz level. The required LPC order $O_{mask}$ of the masking envelope is adaptive to this base band level and can be calculated using the expression:

$$O_{mask}=\text{ceil}(O_{max}*F_{base}/F_{max}),$$

where $O_{max}$ is the maximum LPC order for this calculation, Fmax is the maximum length of the base band, and Fbase is the size of the base band determined at the 90% energy level.

Once the order of the LPC masking filter is computed, its coefficients can be obtained from the autocorrelation coefficients of the input signal. The autocorrelation coefficients can be obtained by taking the inverse Fourier transform of the power spectrum computed in block 220, using the expression:

$$R_{mask}[n] = \frac{1}{K}\sum_{i=0}^{K-1} P[i]\exp\{j2\pi ni/K\},\ n = 1 \text{ to } O_{mask},$$

where K is the length of base band in the DFT domain, P[i] is the power spectrum, R[n] is the autocorrelation coefficient and $O_{mask}$ is the LPC order.

After the autocorrelation coefficients Rmask[n], are obtained, the LPC coefficients $A_{mask}(i)$, and the residue gain $G_{mask}$ can be calculated using the well-known Levinson-Durbin algorithm.

Specifically, the z-transform of the all-pole fit to the base band spectrum is given by:

$$H_{mask}(Z) = \frac{G_{mask}}{1 + \sum_{i=1}^{O_{mask}} A_{mask\,i} Z^{-1}}$$

The Fourier transform of the baseband envelope is given by the expression:

$$H_{mask}(\omega) = \frac{G_{mask}}{1 + \sum_{i=1}^{O_{mask}} A_{mask\,i} e^{-j\omega}}$$

The masking envelope can be generated by attenuating the LPC power spectrum using the expression:

$$T_{mask}[n]=C_{mask}*|H_{mask}[n]|^2,\ n=0 \ldots K-1,$$

where $C_{mask}$ is a constant value.

The following block 250 performs peak picking. In a preferred embodiment, the "appropriate" peaks of the base band power spectrum have to be selected before computing the likelihood function. First, a standard peak-picking algorithm is applied to the base band power spectrum, that determines the presence of a peak at the k-th lag if:

$$P[k]>P[k-1],\ P[k]>P[k+1]$$

where P[k] represents the power spectrum at the k-th lag.

In accordance with a preferred embodiment, the candidate peaks then have to pass two conditions in order to be selected. The first is that the candidate peak must exceed a global threshold $T_0$, which is calculated in a specific embodiment as follows:

$$T_0=C_0*\max\{P[k]\},\ k=0 \ldots K-1$$

where $C_0$ is a constant. The $T_0$ threshold is fixed for the analysis frame. The second condition in a preferred embodiment is that the candidate peak must exceed the value of the masking envelope $T_{mask}$[n], which is a dynamic threshold that varies for every spectrum lag. Thus, P[k] will be a selected as a peak if:

$$P[k]>T_0,\ P[k]>T_{mask}[k].$$

Once all peaks determined using the above defined method are selected, their indices are saved to the array, "Peaks", which is the output of block 250 of the pitch estimator.

Block 260 computes a pitch likelihood function. Using a predetermined set of pitch candidates, which in a preferred embodiment are non-linearly spaced in frequency in the range from $\omega_{low}$ to $\omega_{high}$, the pitch likelihood function is calculated as follows:

$$\Psi(\omega_0)=\sum_{h=1}^{H}\left[\left|\hat{F}(h\omega_0)\right|\cdot\max\left\{\left|\check{F}(\omega_p)\right|\cdot D(h\omega_0-\omega_p)\right\}-\frac{1}{2}\left|\hat{F}(h\omega_0)\right|^2\right];$$

where $\omega_0$ is between $\omega_{low}$ and $\omega_{high}$; and $$\left(h-\frac{1}{2}\right)\cdot\omega_0\le\omega_p<\left(h+\frac{1}{2}\right)\cdot\omega_0$$

$$D(X)=\frac{\sin(2\pi x)}{2\pi x};\quad \text{if } |x|\le 0.5;$$
$$=0,\quad \text{otherwise}$$
$$H=\left\lfloor\frac{\pi}{\omega_0}\right\rfloor$$

and $\hat{F}(\omega)$ is the compressed Magnitude Spectrum; $\check{F}(\omega)$ denotes the Spectral peaks in the Compressed Magnitude Spectrum.

Block 270 performs backward tracking of the pitch to ensure continuity between frames and to minimize the probability of pitch doubling. Since the pitch estimation algorithm used in this processing block by necessity is low-delay, the pitch of the current frame is smoothed in a preferred embodiment only with reference to the pitch values of the previous frames.

If the pitch of current frame is assumed to be continuous with the pitch of the previous frame $\omega_{-1}$, the possible pitch candidates should fall in the range:

$$T_{\omega 1}<\omega<T_{\omega 2},$$

where $T\omega_1$ is the lower boundary given by $(0.75*\omega_{-1})$, and $T\omega_2$ is the upper boundary, which is given by $(1.33*\omega_{-1})$ The pitch candidate from the backward tracking is selected by finding the maximum likelihood function among the candidates within the range between $T\omega_1$ to $T\omega_2$, as follows:

$$\Psi(\omega)=\max\{\Psi(\omega)\},\ T_{\omega 1}<\omega<T_{\omega 2},$$

where $\Psi(\omega)$ is the likelihood function of candidate $\omega$ and $\omega_b$ is the backward pitch candidate. The likelihood of the $\omega_b$ is replaced by the expression:

$$\Psi(\omega_b)=0.5*\{\Psi(\omega_b)+\Psi_{-1}(\omega_{-1})\},$$

where $\Psi_{-1}$ is the likelihood function of previous frame. The likelihood functions of other candidates remain the same. Then, the modified likelihood function is applied for further analysis.

Block 280 makes the selection of pitch candidates. Using a progressive harmonic threshold search through the modified likelihood function $\hat{\Psi}(\omega_0)$ from $\omega_{low}$ to $\omega_{high}$, the following candidates are selected in accordance with the preferred embodiment:

(a) The first pitch candidate $\omega_1$ is selected such that it corresponds to the maximum value of the pitch likelihood function $\hat{\Psi}(\omega_0)$. The second pitch candidate $\omega_2$ is selected such that it corresponds to the maximum value of the pitch likelihood function $\hat{\Psi}(\omega_0)$ evaluated between 1.5 $\omega_1$ and $\omega_{high}$ such that $\hat{\Psi}(\omega_2)\geqq 0.75\times\hat{\Psi}(\omega_1)$. The third pitch candidate $\omega_3$ is selected such that it corresponds to the maximum value of the pitch likelihood function $\hat{\Psi}(\omega_0)$ evaluated between 1.5 $\omega_2$ and $\omega_{high}$, such that $\hat{\Psi}(\omega_3)\geqq 0.75\times\hat{\Psi}(\omega_1)$. The progressive harmonic threshold search is continued until the condition $\hat{\Psi}(\omega_k)\geqq 0.75\times\hat{\Psi}(\omega_1)$ is satisfied.

Block 290 serves to refine the selected pitch candidate. This is done in a preferred embodiment by reevaluating the pitch likelihood function $\Psi(\omega_{0})$ around each pitch candidate to further resolve the exact location of each local maximum.

Block 295 performs analysis-by-synthesis to obtain the final coarse estimate of the pitch. In particular, to enhance the discrimination between likely pitch candidates, block 295 computes a measure of how "harmonic" the signal is for each candidate. To this end, in a preferred embodiment for each pitch candidate $\omega_0$, a corresponding synthetic spectrum $\hat{S}k(\omega, \omega_0)$ is constructed using the following expression:

$$\hat{S}k(\omega,\omega_0)=S(k\omega_0)W((\omega-k\omega_0),\ 1\leqq k\leqq L$$

where $S(k\omega_0)$ is the original speech spectrum at the k-th harmonic, and L is the number of harmonics at the analysis base-band $F_{bass}$, and $W(\omega_0)$ is the frequency response of a length 291 Kaiser window with $\beta$=6.0.

Next, an error function $E_k(\omega_0)$ for each harmonic band is calculated in a preferred embodiment using the expression:

$$E_k(\omega_0)=\frac{\sum_{\omega=(k-0.5)\omega_0}^{\omega=(k+0.5)\omega_0}\left|S(\omega)-\hat{S}k(\omega,\omega_0)\right|^2}{\sum_{w=(k-0.5)\omega_0}^{\omega=(k+0.5)\omega_0}|S(\omega)|^2},\ 1\le k\le L$$

The error function for each selected pitch candidate is finally calculated over all bands using the expression:

$$E(\omega_0)=\frac{1}{L}\sum_{k=1}^{L}E_k(\omega_0).$$

After the error function $E(\omega_0)$ is known for each pitch candidate, the selection of the optimal candidate is made in a preferred embodiment based on the pre-selected pitch candidates, their likelihood functions and their error functions. The highest possible pitch candidate $\omega_{hp}$ is defined as the candidate with a likelihood function greater than 0.85 of the maximum likelihood function. In accordance with a preferred embodiment of the present invention, the final coarse pitch candidate is the candidate that satisfies the following conditions:

(1) If there is only one pitch candidate, the final pitch estimate is equal to this single candidate; and (2) If there is more than one pitch candidate, and its error function is greater than 1.1 times the error function of $\omega_{hp}$, then the final estimate of the pitch is selected to be that pitch candidate. Otherwise, the final pitch candidate is chosen to be $\omega_{hp}$.

The selection between two pitch candidates obtained using the progressive harmonic threshold search of the present invention is illustrated in FIGS. 9A-D.

Figure 9A:
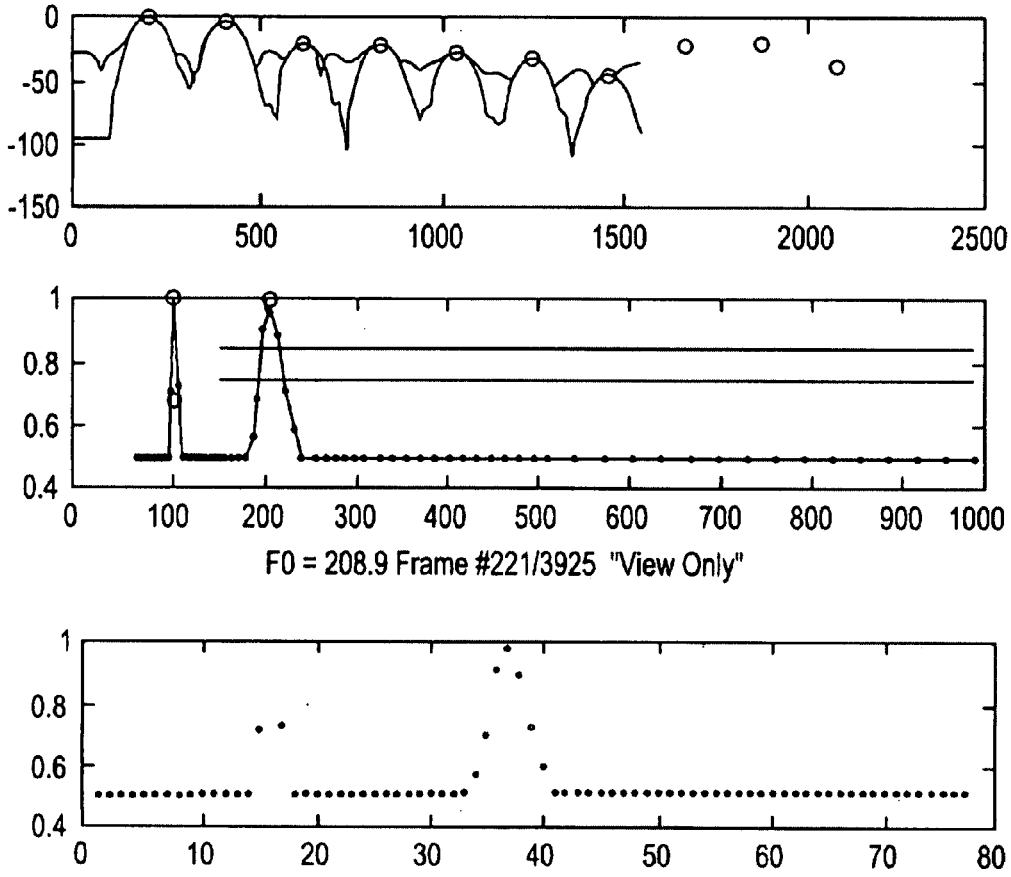
FIGS. 9A-9D illustrate the selection of pitch candidates in the low-delay pitch estimation shown in FIG. 8.
Figure 9B:
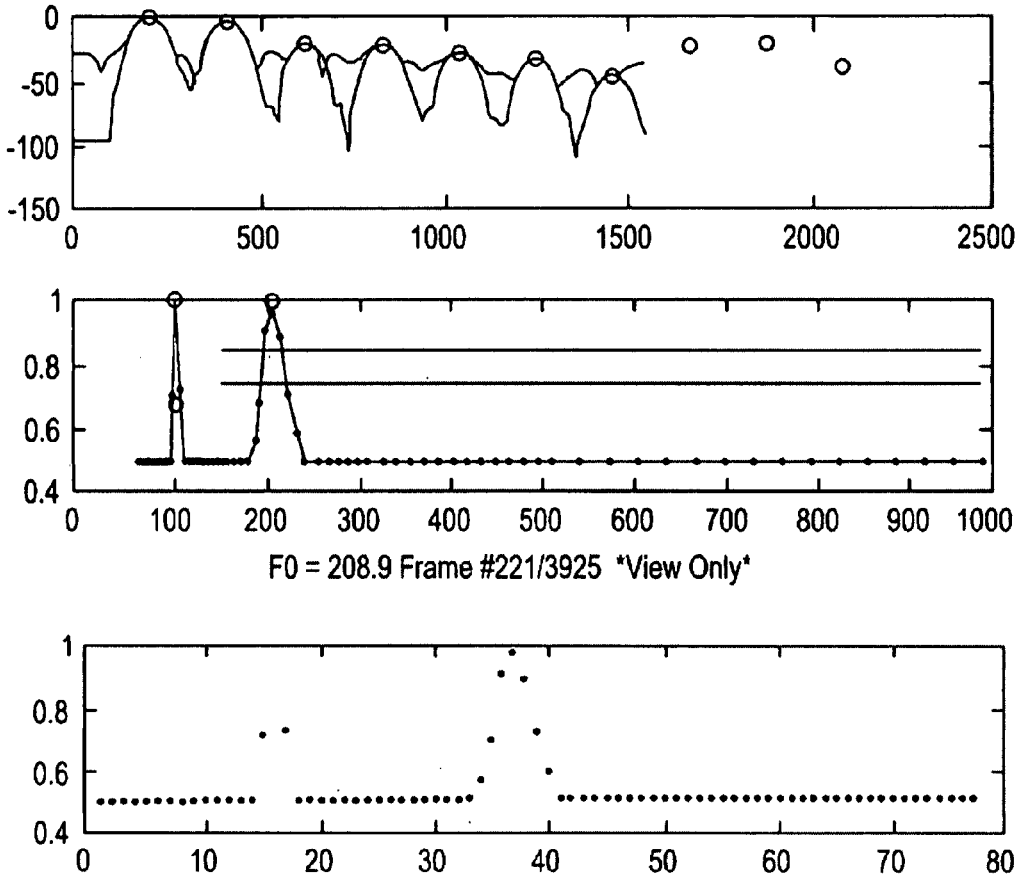
Figure 9C:
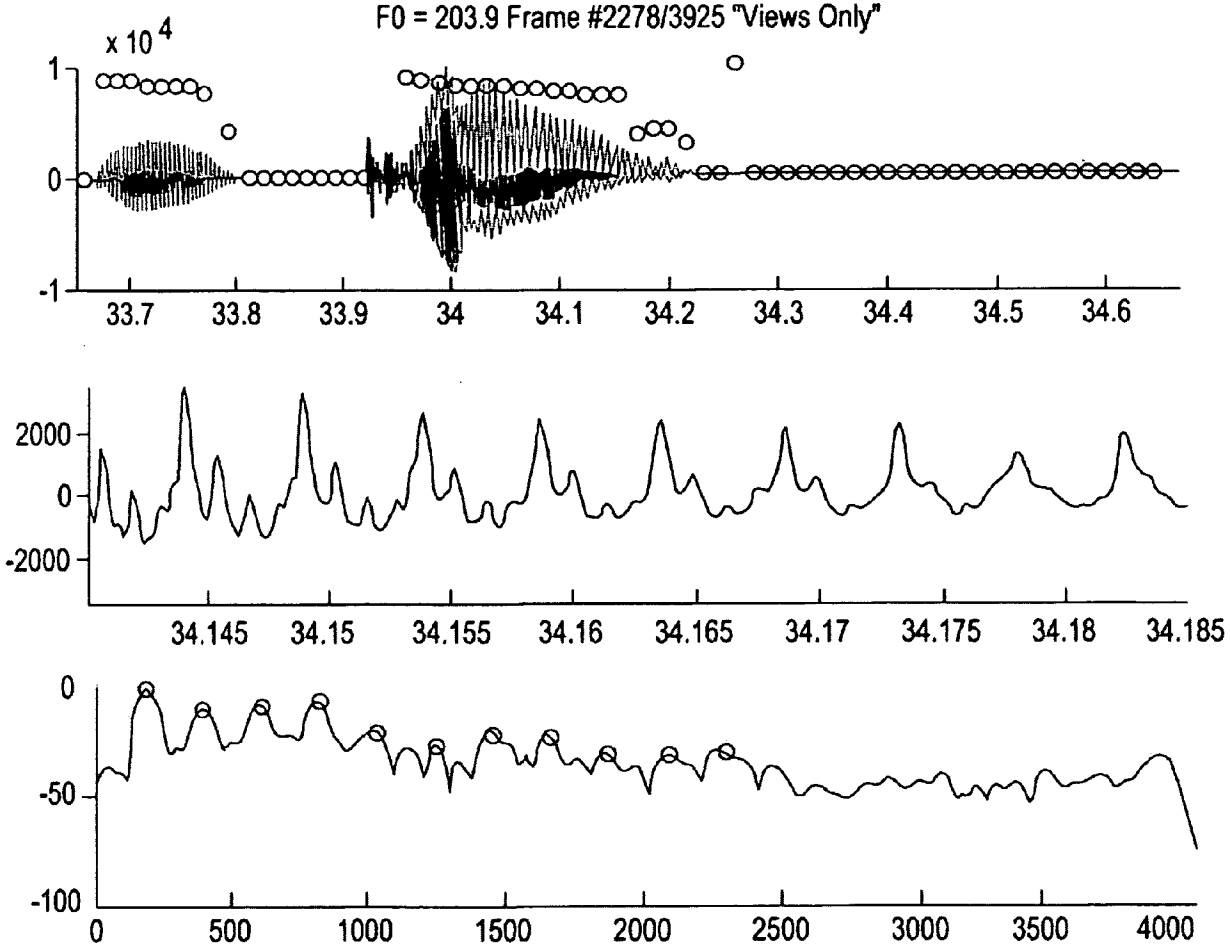
Figure 9D:
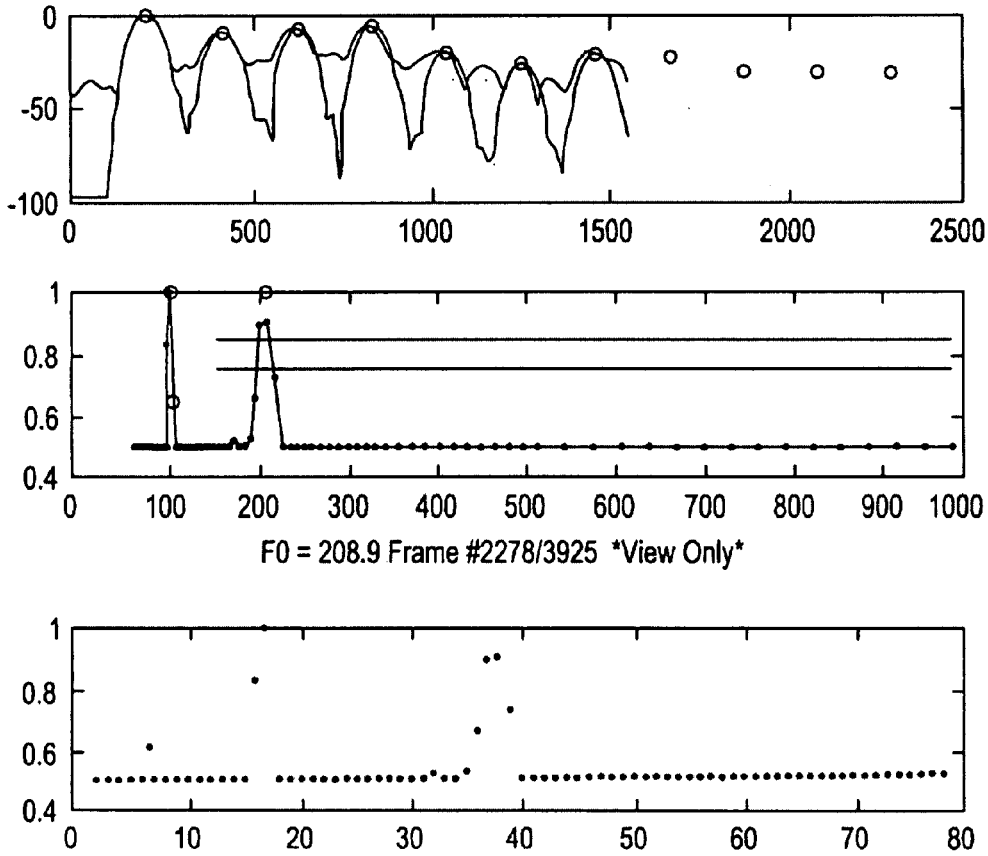

In particular, FIGS. 9A, 9B and 9D show spectral responses of original and reconstructed signals and the pitch likelihood function. The two lines drawn along the pitch likelihood function in the thresholding used to select the pitch candidate, as described above. FIG. 9C shows a speech waveform and a superimposed pitch track.

(7) Mid-Frame Parameter Determination (a) Determining the Mid-Frame Pitch

As noted above, in a preferred embodiment the analyzer end of the codec operates at a 20 ms frame rate. Higher rates are desirable to increase the accuracy of the signal reconstruction, but would lead to increased complexity and higher bit rate. In accordance with a preferred embodiment of the present invention, a compromise can be achieved by transmitting select mid-frame parameters, the addition of which does not affect the overall bit-rate significantly, but gives improved output performance. With reference to FIG. 5, these additional parameters are shown as blocks 110, 120 and 130 and are described in further detail below as "mid-frame" parameters.

Figure 10:
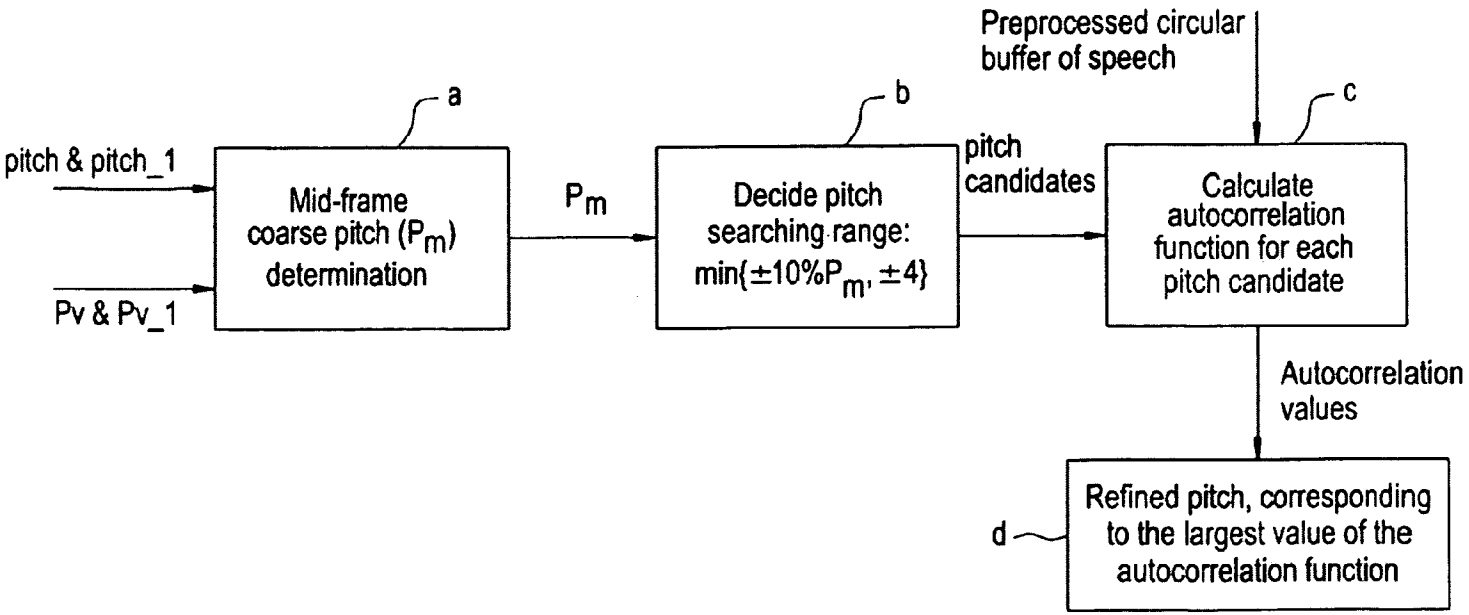
FIG. 10 is a block diagram of mid-frame pitch estimation in accordance with a preferred embodiment of the present invention.

FIG. 10 is a block diagram of mid-frame pitch estimation. Mid-frame pitch is defined as the pitch at the middle point between two update points and it is calculated after deriving the pitch and the voicing probability at both update points. As shown in FIG. 10, the inputs of block (a) of the estimator are the pitch-period (or alternatively, the frequency domain pitch) and voicing probability Pv at the current update point, and the corresponding parameters (pitch_1) and (Pv_1) at the previous update point. The coarse pitch ($P_m$) at the mid-frame is then determined, in a preferred embodiment, as follows:

$P_m$=(pitch+pitch_1)/2; if pitch<=1.25 pitch_1 and pitch>=0.8 pitch_1

Otherwise, $P_m$=pitch if Pv≧Pv_1

Or $P_m$=pitch_1 if Pv<Pv_1

Block (b) in FIG. 10 takes the coarse estimate $P_m$ as an input and determines the pitch searching range for candidates of a refined pitch. In a preferred embodiment, the pitch candidates are calculated to be either within +10% deviation range of the coarse pitch value $P_m$ of the mid-frame, or within maximum ±4 samples. (Step size is one sample.)

The refined pitch candidates, as well as preprocessed speech stored in the input circular buffer (See block 10 in FIG. 5), are then input to processing block (c) in FIG. 10. For each pitch candidate, processing block (c) computes an autocorrelation function of the preprocessed speech. In a preferred embodiment, the refined pitch is chosen in block (d) in FIG. 10 to correspond to the largest value of the autocorrelation function.

Figure 11:
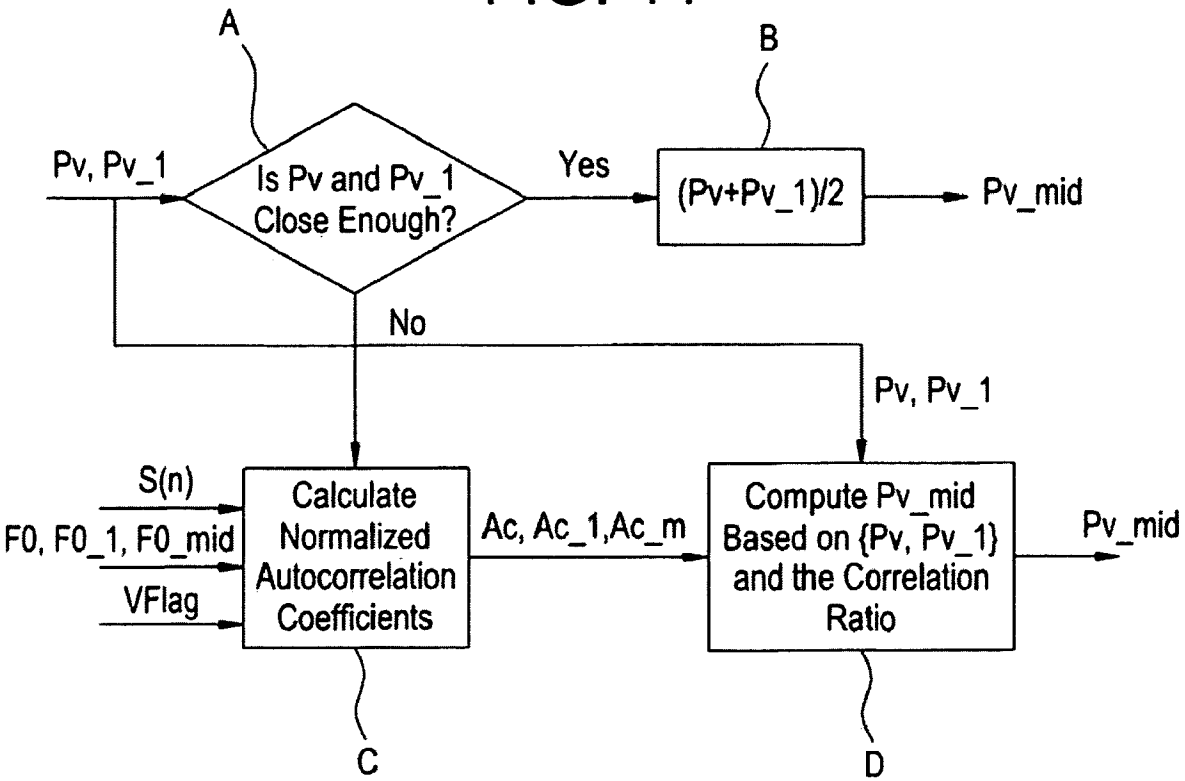
FIG. 11 is a block diagram of mid-frame voicing analysis in a preferred embodiment.

(b) Middle Frame Voicing Calculation:

FIG. 11 illustrates in a block diagram form the computation of the mid-frame voicing parameter in accordance with a preferred embodiment of the present invention. First, at step A, a condition is tested to determine whether the current frame voicing probability Pv and the previous frame voicing probability Pv_1 are close. If the difference is smaller than a predetermined given threshold, for example 0.15, the mid frame voicing Pv_mid is calculated by taking the average of Pv and Pv_1 (Step B). Otherwise, if the voicing between the two frames has changed significantly, the mid frame speech is probably in transient, and is calculated as shown in Steps C and D.

In particular, in Step C the three normalized correlation coefficients, Ac, Ac_1 and Ac_m, are calculated corresponding to the pitch of the current frame, the pitch of the previous frame and that of the mid frame. As with the autocorrelation computation described in the preceding section, the speech from the circular buffer 10 (See FIG. 5) is windowed, preferably using a Hamming window. The length of the window is adaptive and selected to be 2.5 times the coarse pitch value. The normalized correlation coefficient can be obtained by:

$$Ac = \frac{\sum S(n)S(n-P_0)}{\sqrt{\sum S(n)S(n)\sum S(n-P_0)S(n-P_0)}},\ n = 1 \ldots N - P_0$$

where S(n) is the windowed signal, N is the length of the window and $P_0$ represents of the pitch value and can be calculated from the fundamental frequency $F_0$.

As shown in FIG. 11, at Step C the algorithm also uses the vocal fry flag. The operation of the vocal fry detector is described in Section B.6. When the vocal fry flag of either the current frame or the previous frame is 1, the three pitch values, $F_0$, $F_{0_1}$ and $F_{0_mid}$, have to be converted to true pitch values. The normalized correlation coefficients are then calculated based on the true pitch values.

After the three correlation coefficients, Ac, Ac_1, Ac_m, and the two voicing parameters, Pv, Pv_1, are obtained, in the following Step D the mid-frame voicing is approximated in accordance with the preferred embodiment by:

$$Pv_{mid} = Ac_m * \frac{Pv_i}{Ac_i}$$

where $Pv_i$ and $Ac_i$ represent the voicing and the correlation coefficient of either the current frame, or the previous frame. The frame index i can be obtained using the following rule: if Ac_m is smaller than 0.35, the mid frame is probably noise-like. Then the i-th frame is a frame with smaller voicing; if Ac_m is larger than 0.35, the frame i is chosen as the one with larger voicing. The threshold parameters used in Steps A-D in FIG. 11 are experimental, and may be replaced, if necessary.

(c) Determining the Mid-Frame Phase

Since speech is almost in steady-state during short periods of time, the middle frame parameters can be calculated by simply analyzing the middle frame signal and interpolating the parameters of the end frame and the previous frame. In the current invention, the pitch, the voicing of the mid-frame are analyzed using the time-domain techniques. The mid-frame phases are calculated by using DFT (Discrete Fourier transform).

Figure 12:
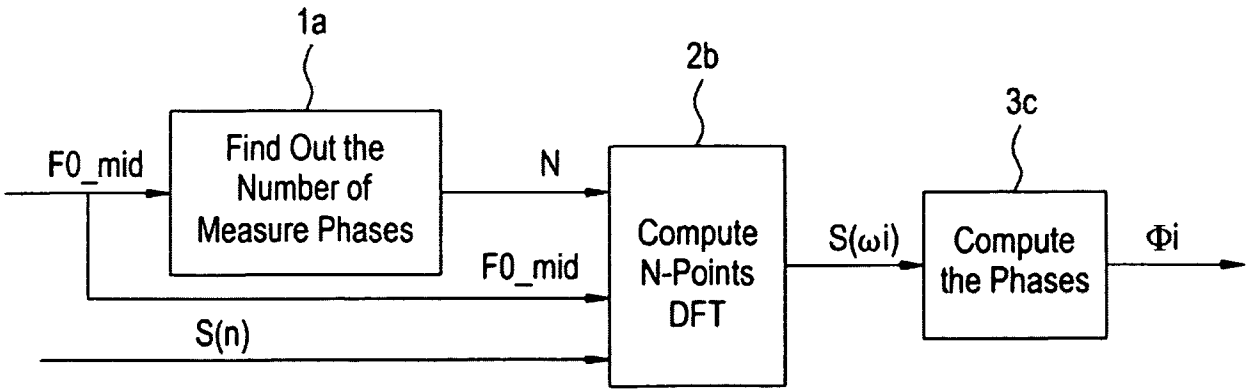
FIG. 12 is a block diagram of mid-frame phase measurement in a preferred embodiment.

The mid-frame phase measurement in accordance with a preferred embodiment of the present invention is shown in a block diagram form in FIG. 12. The algorithm is similar to the end-frame phase measurement discussed above. First, the number of phases to be measured is calculated based on the refined mid-frame pitch and the maximum number of coding phases (Step 1*a*). The refined mid-frame pitch determines the number of harmonics of the full band (e.g., from 0 to 4000 Hz). The number of measured phases is selected in a preferred embodiment as the smaller number between the total number of harmonics in the spectrum of the signal and the maximum number of encoded phases.

Once the number of measured phases is known, all harmonics corresponding to the measured phases are calculated in the radian domain as:

$$\omega_i = 2\pi * i * F0_{mid}/Fs \quad 1 \leqq i \leqq Np$$

where $F0_{mid}$ represents the mid-frame refined pitch, Fs is sampling frequency (e.g., 8000 Hz), and Np is the number of measured phases.

Since the middle frame parameters are mainly analyzed in the time-domain, a Fast Fourier transform is not calculated. The frequency transformation of the i-th harmonic is calculated using the Discrete Fourier transform (DFT) of the signal (Step 2*b*):

$$S(\omega_i) = \sum_{n=0}^{N-1} s(n)\exp(-jn\omega_i)$$

here s(n) is the windowed middle frame signal of length N, and $\omega_i$ is the i-th harmonic in the radian domain.

The phase of the i-th harmonic is measured by:

$$\phi_i = \arctan\frac{I(\omega_i)}{R(\omega_i)}$$

here $I(\omega_i)$ is the imaginary part of $S(\omega_i)$ and $R(\omega_i)$ is the real part of $S(\omega_i)$. See Step 3*c* in FIG. 12.

(8) The Vocal Fry Detector

Vocal fry is a kind of speech which is low-pitched and has rough sound due to irregular glottal excitation. With reference to block 90 in FIG. 5, and FIG. 13, in accordance with a preferred embodiment, a vocal fry detector is used to indicate the vocal fry of speech. In order to synthesize smooth speech, in a preferred embodiment, the pitch during vocal fry speech frames is corrected to the smoothed pitch value from the long-term pitch contour.

Figure 13:
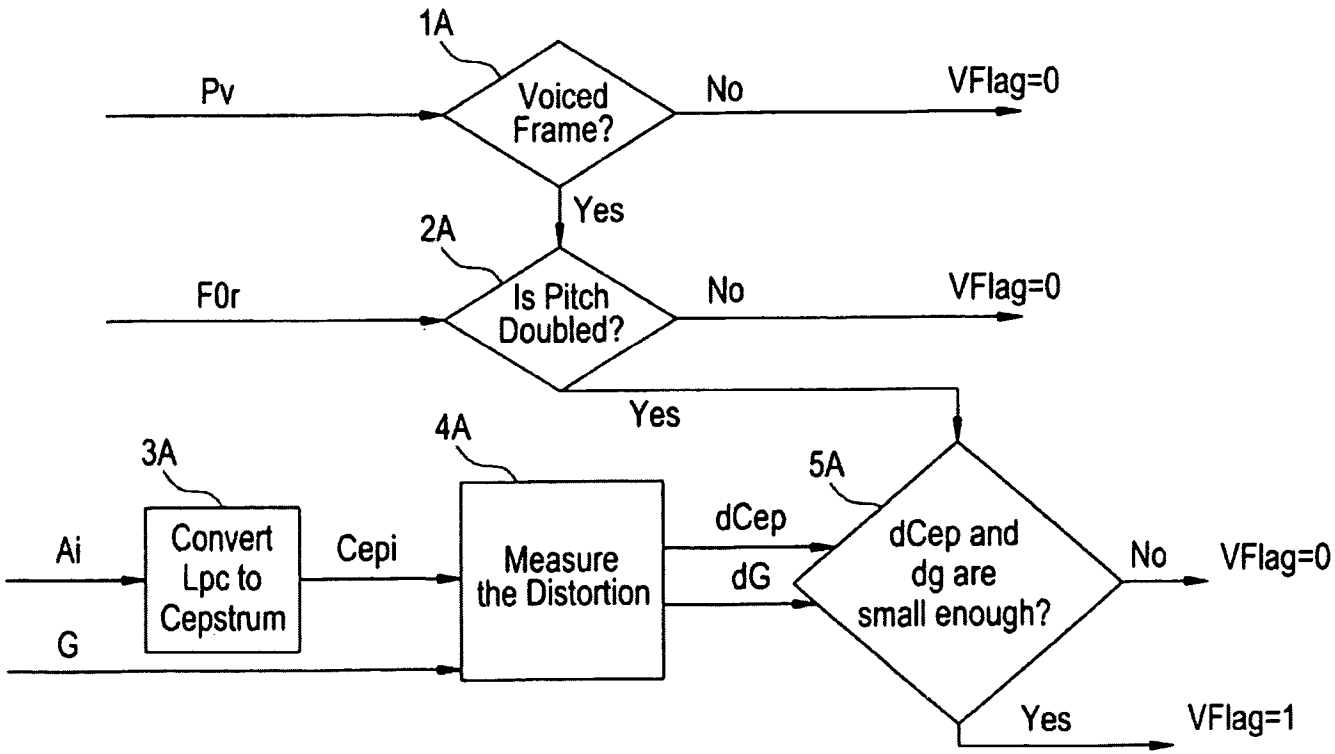
FIG. 13 is a block diagram of a vocal fry detector algorithm in a preferred embodiment.

FIG. 13 is the block diagram of the vocal fry detector used in a preferred embodiment of the present invention. First, at Step 1A the current frame is tested to determine whether it is voiced or unvoiced. Specifically, if the voicing probability Pv is below 0.2, in a preferred embodiment the frame is considered unvoiced and the vocal fry flag VFlag is set to 0. Otherwise, the frame is voiced and the pitch value is validated.

To detect vocal fry for a voiced frame, the real pitch value $F_{0r}$ has to be compared with the long term average of the pitch $F_{0avg}$. If $F_{0r}$ and $F_{0avg}$ satisfy the condition $$1.74*F0r<F0_avg<2.3*F0r,$$

at Step 2A the pitch $F_{0r}$ is considered to be doubled. Even if the pitch is doubled, however, the vocal fry flag cannot automatically be set to 1. This is because pitch doubling does not necessarily indicate vocal fry. For example, during two talkers' conversation, if the pitch of one talker is almost double that of the other, the lower pitched speech is not vocal fry. Therefore, in accordance with this invention, a spectrum distortion measure is obtained to avoid wrong decisions in situations as described above.

In particular, as shown in Step 3A, the LPC coefficients obtained in the encoder are converted to cepstrum coefficients by using the expression:

$$Cep_i = A_i + \sum_{k=1}^{i-1}\left(\frac{k}{i}\right)Cep_k * A_{i-k},\ 1 \le i \le P$$

where $A_i$ is the i-th LPC coefficient, Cepi is the i-th cepstrum coefficient, and P is the LPC order. Although the order of cepstrum can be different from the LPC order, in a specific embodiment of this invention they are selected to be equal.

The distortion between the long term average cepstrum and the current frame cepstrum is calculated in Step 4A using, in a preferred embodiment, the expression:

$$dCep = \frac{1}{P}\sum_{i=1}^{P} W_i(Cep_i - ACep_i)^2$$

where $Acep_i$ is the long term average cepstrum of the voiced frames and $W_i$ is the weighing factors, as known in the art:

$$Wi = \left[1 + \frac{P}{2}\sin\left(\frac{\pi i}{P}\right)\right]^2,\ 1 \le i \le P$$

The distortion between the log-residue gain G and the long term averaged log residue gain AG is also calculated in Step 4A:

$$dG=|G-AG|.$$

Then, at Step 5A of the vocal fry detector, the dCep and dG parameters are tested using, in a preferred embodiment, the following rules:

$$\{d\text{Gain}\leqq 2\} \text{ and } \{d\text{Cep}\leqq 0.5,\ \text{conf}\geqq 3\}$$

$$\text{or } \{d\text{Cep}\leqq 0.4,\ \text{conf}\geqq 2\},$$

$$\text{or } \{d\text{Cep}\leqq 0.1,\ \text{conf}\geqq 1\},$$

where conf is a measurement which counts how many continuous voiced frames have the smooth pitch values. If both dCep and dGain pass the conditions above, the detector indicates the presence of a vocal fry, and the corresponding flag is set equal to 1.

If the vocal fry flag is 1, the pitch value $F_0$ has to be modified to $$F_0=0.5*F0r$$

Otherwise, the F0 is the same as F0*r*.

C. Non-linear Signal Processing

In accordance with a preferred embodiment of the present invention, significant improvement of the overall performance of the system can be achieved using several novel non-linear signal processing techniques.

(1) Preliminary Discussion

A typical paradigm for lowrate speech coding (below 4 kb/s) is to use a speech model based on pitch, voicing, gain and spectral parameters. Perhaps the most important of these in terms of improving the overall quality of the synthetic speech is the voicing, which is a measure of the mix between periodic and noise excitation. In contemporary speech coders this is most often done by measuring the degree of periodicity in the time-domain waveform, or the degree to which its frequency domain representation is harmonic. In either domain, this measure is most often computed in terms of correlation coefficients. When voicing is measured over a very wide band, or if multiband voicing is used, it is necessary that the pitch be estimated with considerable accuracy, because even a small error in pitch frequency can result in a significant mismatch to the harmonic structure in the high-frequency region (above 1800 Hz). Typically, a pitch refinement routine is used to improve the quality of this fit. In the time domain this is difficult if not impossible to accomplish, while in the frequency domain it increases the complexity of the implementation significantly. In a well known prior art contribution, McCree added a time-domain multiband voicing capability to the Linear Prediction Coder (LPC) and found a solution to the pitch refinement problem by computing the multiband correlation coefficient based on the output of an envelope detector lowpass filter applied to each of the multiband bandpass waveforms.

In accordance with a preferred embodiment of the present invention, a novel nonlinear processing architecture is proposed which, when applied to a sinusoidal representation of the speech signal, not only leads to an improved frequency-domain estimate of multiband voicing but also to a new and novel approach to estimating the pitch, and for estimating the underlying linear-phase component of the speech excitation signal. Estimation of the linear phase parameter is essential for midrate codecs (6-10 kb/s) as it allows for the mixture of baseband measured phases and highband synthetic phases, as was typical of the old class of Voice-Excited Vocoders.

Nonlinear Signal Representation:

The basic idea of an envelope detector lowpass filter used in the sequel can be explained simply on the basis of two sinewaves of different frequencies and phases. If the time-domain envelope is computed using a square-law device, the product of two sinewave gives new sinewaves at the sum and difference frequencies. By applying a lowpass filter, the sinewave at the sum frequency can be eliminated and only the component at the difference frequency remains. If the original two sinewaves were contiguous components of a harmonic representation, then the sinewave at the difference frequency will be at the fundamental frequency, regardless of the frequency band in which the original sinewave pair was located. Since the resulting waveform is periodic, computing the correlation coefficient of the waveform at the difference frequency provides a good measure of voicing, a result which holds equally well at low and high frequencies. It is this basic property that eliminates the need for extensive pitch refinement and underlies the non-linear signal processing techniques in a preferred embodiment of the present invention.

In the time domain, this decomposition of the speech waveform into sum and difference components is usually done using an envelope detector and a lowpass filter. However if the starting point for the nonlinear processing is based on a sinewave representation of the speech waveform, the separation into sinewaves at the sum frequencies and at the difference frequencies can be computed explicitly. Moreover, the lowpass filtering of the component at the sum frequencies can be implemented exactly hence reducing the representation to a new set of sinewaves having frequencies given by the difference frequencies.

If the original speech waveform is periodic, the sine-wave frequencies are multiples of the fundamental pitch frequency and it is easy to show that the output of the nonlinear processor is also periodic at the same pitch period and hence is amenable to standard pitch and voicing estimation techniques. This result is verified mathematically next.

Suppose that the speech waveform has been decomposed into its underlying sine-wave components $$s(n) = \sum_{k=1}^{K} s_k(n)$$

where $s_k(n)=A_k\exp[j(n\omega_k+\theta_k)]$ where $\{A_k, \omega_k, \theta_k\}$ are the amplitudes, frequencies and phases at the peaks of the Short-Time Fourier Transform (STFT). The output of the square-law nonlinearity is defined to be $$\begin{aligned} y(n) &= \mu\sum_{k=1}^{K} s_k(n) + \sum_{l=1}^{L}\sum_{k=1}^{K-1} s_{k+1}(n)s_k^*(n) \\ &= \mu\sum_{k=1}^{K} \gamma_k\exp(jn\omega_k) + \sum_{l=1}^{L}\sum_{k=1}^{K-1} \gamma_{k+1}\gamma_k^*\exp[jn(\omega_{k+1}-\omega_k)] \end{aligned} \tag{1}$$

here $\gamma_k=A_k\exp(j\theta_k)$ is the complex amplitude and where $0\geqq\mu\geqq1$ is a bias factor used when estimating the pitch and voicing parameters (as it insures that there will be frequency components at the original sine-wave frequencies). The above definition of the square-law nonlinearity implicitly performs lowpass filtering as only positive frequency differences are allowed. If the speech waveform is periodic with pitch period $\tau_0=2\pi/\omega_0$, where $\omega_0$ is the pitch frequency, then $\omega_k=k\,\omega_0$ and the output of the nonlinearity is $$y(n;\omega_0) = \mu\sum_{k=1}^{K} \gamma_k\exp(jn\omega_0) + \sum_{l=1}^{L}\sum_{k=1}^{K-1} \gamma_{k+1}\gamma_k^*\exp(jnl\omega_0)$$

which is also periodic with period $\tau_0$.

(2) Pitch Estimation and Voicing Detection

One way to estimate the pitch period is to use the parametric representation in Eqn. 1 to generate a waveform over a sufficiently wide window, and apply any one of a number of standard time-domain pitch estimation techniques. Moreover, measurements of voicing could be made based on this waveform using, for example, the correlation coefficient. In fact, multiband voicing measures can be computed in a specific embodiment simply by defining the limits on the summations in Eqn. 1 to allow only those frequency components corresponding to each of the multiband bandpass filters. However, such an implementation is complex.

In accordance with a preferred embodiment of the present invention, in this approach the correlation coefficient is computed explicitly in terms of the sinusoidal representation. This function is defined as $$R(\tau_0) = Re\sum_{n=-N}^{N} y(n)y*(n-\tau_0)$$

where "Re" denotes the real part of the complex number. The pitch is estimated, to within a multiple of the true pitch, by choosing that value of $\tau_0$ for which $R(\tau_0)$ is a maximum. Since y(n) in Eqn. 1 is a sum of sinewaves, it can be written more generally as, $$y(n) = \sum_{m=1}^{M} Y_m \exp(j\Omega_m)$$

for complex amplitudes $Y_m$ and frequencies $\omega_m$. It can be shown that the correlation function is then given by $$R(\tau_0) = \sum_{m=1}^{M} |Y_m|^2 \cos(\tau_0 \Omega_m) \qquad \text{Eq. 2}$$

In order to evaluate this expression it is necessary to accumulate all of the complex amplitudes for which the frequency values are the same. This could be done recursively by letting $\Pi_m$ denote the set of frequencies accumulated at stage m and $\Gamma_m$ denote the corresponding set of complex amplitudes. At the first stage, $$\Pi_0=\{\omega_1, \omega_2, \ldots, \omega_K\}$$

$$\Gamma_0=\{\mu\gamma_1, \mu\gamma_2, \ldots, \mu\gamma_K\}$$

At stage m, for each value of 1=1,2, . . . ,L and k=1, 2, . . . ,K−1 if $(\omega_{k+1}-\omega_k)=\omega_i$ for some $\omega_1 \epsilon \pi$, the complex amplitude is augmented according to $$Y_i=Y_i+\gamma_{k+1}\gamma^*_k$$

If there is no frequency component that matches, the set of allowable frequencies is augmented in a preferred embodiment to stage m+1 according to the expression $$\Pi_{m+1}=\{\Pi_m, (\omega_{k+1}-\omega_k)\}$$

From a signal processing point of view, the advantage of accumulating the complex amplitudes in this way is in exploiting the advantages of complex integration, as determined by $|Y_m|^2$ in Eqn. 2. As shown next, some processing gains can be obtained provided the vocal tract phase is eliminated prior to pitch estimation, as might be achieved, for example, using allpole inverse filtering. In general, there is some risk in assuming that the complex amplitudes of the same frequency component at "in phase", hence a more robust estimation strategy in accordance with a preferred embodiment of the present invention is to eliminate the coherent integration. When this is done, the sine-wave frequencies and the squared-magnitudes of y(n) are identified as $$\Omega_m=\omega_m;\ |Y_m|=\mu^2 A_m^2$$

$$\text{for } m=1,2, \ldots, K \text{ and}$$

$$\Omega_m=(\omega_{k+1}-\omega_k);\ |Y_m|^2=A_{k+1}A_k$$

for l=1,2, . . . ,L and k=1,2, . . . ,K−1 where m is incremented by one for each value of l and k.

Many variations of the estimator described above in a preferred embodiment can be used in practice. For example, it is usually desirable to compress the amplitudes before estimating the pitch. It has been found that square-root compression usually leads to more robust results since it introduces many of the benefits provided by the usual perceptual weighing filter. Another variation that is useful in understanding the dynamics of the pitch extractor is to note that $\tau_0=2\pi/\omega_0$, and then instead of searching for the maximum of $R(\tau_0)$ in Eqn. 2, the maximum is found from the function $$R'(\omega_0) = \sum_{m=1}^{M} |Y_m|^2\, 0.5 * \left[1 + \cos(2\pi\omega_m/\omega_0)\right]$$

Since the term $$C(\omega;\omega_0)=0.5*[1+\cos(2\pi\omega/\omega_0)]$$

can be interpreted as a comb filter tuned to the pitch frequency $\omega_0$, the correlation pitch estimator can be interpreted as a bank of comb filters, each tuned to a different pitch frequency. The output pitch estimate corresponds to the comb filter that yields the maximum energy at its output. A reasonable measure of voicing is then the normalized comb filter output $$\rho(\omega_0) = \sum_{m=1}^{M} |Y_m|^2\, 0.5 * \left[1 + \cos(2\pi\omega_m/\omega_0)\right] \Big/ \sum_{m=1}^{M} |Y_m|^2$$

Figure 14:
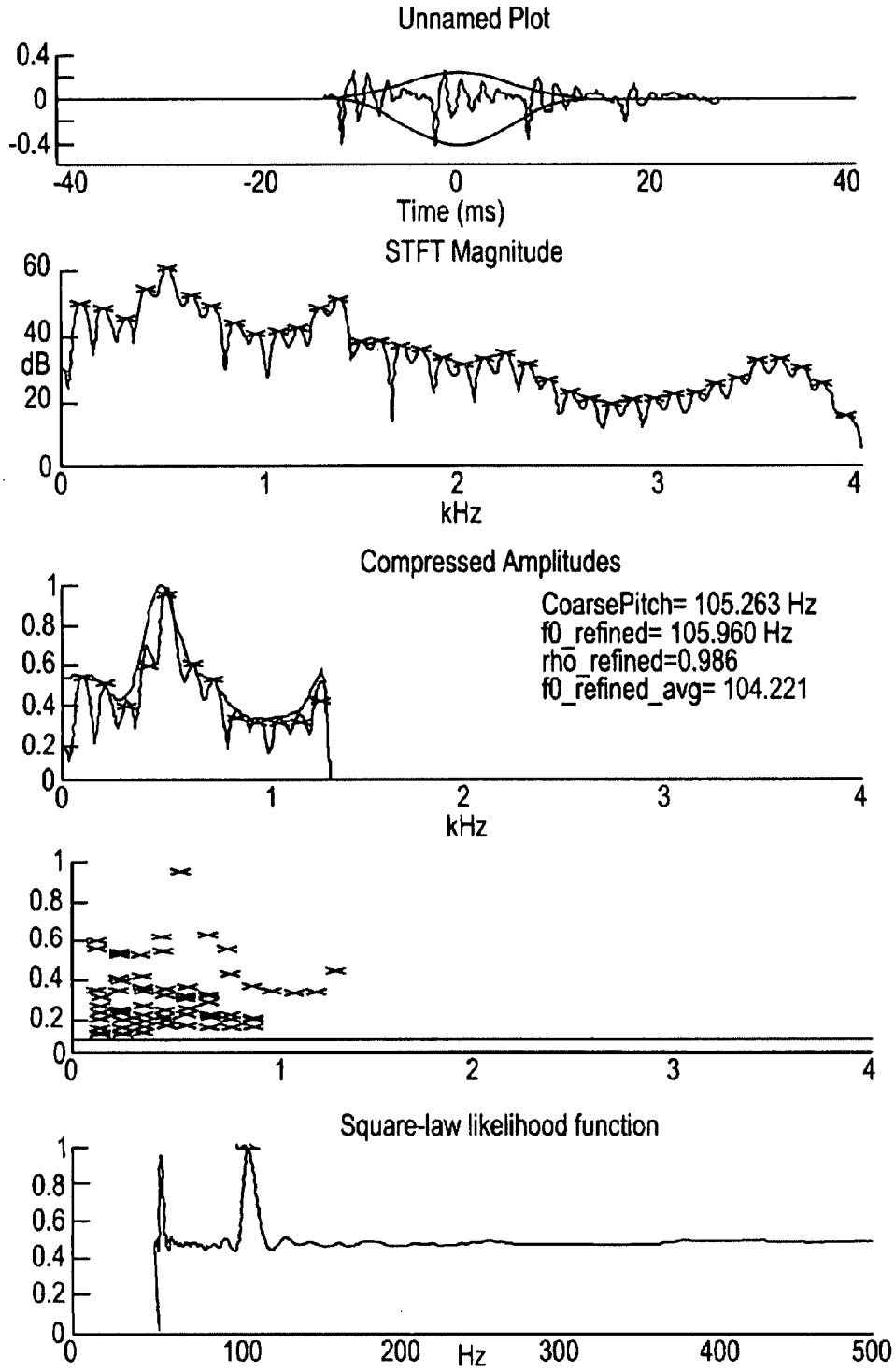
FIG. 14 is an illustration of the application of nonlinear signal processing to estimate the pitch of a speech signal.

An example of the result of these processing steps is shown in FIG. 14. The first panel shows the windowed segment of the speech to be analyzed. The second panel shows that magnitude of the STFT and the peaks that have been picked over the 4 kHz speech bandwidth. The pitch is estimated over a restricted bandwidth, in this case about 1300 Hz. The peaks in this region are selected and then square-root compression is applied. The compressed peaks are shown in the third panel. Also shown is the cubic spline envelope, that was fitted to the original baseband peaks. This is used to suppress low-level peaks. The fourth panel shows the peaks that are obtained after the application of the square-law nonlinearity. The bias factor was set to be $\mu$=0.99 so that the original baseband peaks are one component of the final set of peaks. The maximum separation between peaks was set to be L=8, so that there are multiple contributions of peaks at the product amplitudes up to the 8-th harmonic. The fifth panel shows the normalized comb filter output, $\rho(\omega_0)$, plotted for $\omega_0$ in the range from 50 Hz to 500 Hz. The pitch estimate is declared to be 105.96 Hz and corresponds to a normalized comb filter output of 0.986. If the algorithm were to be used for multiband voicing, the normalized comb filter output would be computed for the square-law nonlinearity based on an original set of peaks that were confined to a particular frequency region.

(3) Voiced Speech Sine-Wave Model

Extensive experiments have been conducted that show that synthetic speech of high quality can be synthesized using a harmonic set of sine waves provided the amplitude and phases of each sine-wave component are obtained by sampling the envelopes of the magnitude and phase of the short-time Fourier transform at frequencies corresponding to the harmonics of the pitch frequency. Although efficient techniques have been developed for coding the sine-wave amplitudes, little work has been done in developing effective methods for quantizing the phases. Listening tests have shown that it takes about 5 bits to code each phase at high quality, and it is obvious that very few phases could be coded at low data rates. One possibility is to code a few baseband phases and use a synthetic phase model for the remaining phases terms. Listening tests reveal that there are two audibly different components in the output waveform. This is due to the fact that the two components are not time aligned.

During strongly voiced speech the production of speech begins with a sequence of excitation pitch pulses that represent the closure of the glottis as a rate given by the pitch frequency. Such a sequence can be written in terms of a sum of sine waves as $$\hat{e}(n) = \sum_{k=1}^{K} \exp[j(n - n_0)\omega_k]$$

where $n_0$ corresponds to the time of occurrence of the pitch pulse nearest the center of the current analysis frame. The occurrence of this temporal event, called the onset time, insures that the underlying excitation sine waves will be in phase at the time of occurrence of the glottal pulse. It is noted that although the glottis may close periodically, the measured sine waves may not be perfectly harmonic, hence the frequencies $\omega_k$ may not in general be harmonically related to the pitch frequency.

The next operation in the speech production model shows that the amplitude and phase of the excitation sine waves are altered by the glottal pulse shape and the vocal tract filters. Letting $$H_s(\omega)=|H_s(\omega)|\exp[j\Phi_s(\omega)]$$

denote the composite transfer function for these filters, called the system function, then the speech signal at its output due to the excitation pulse train at its input can be written by $$\hat{s}(n) = \sum_{k=1}^{K} |H_s(\omega_k)|\exp\{j[(n - n_0)\omega_k + \Phi_s(\omega_k) + \beta\pi]\}$$

where $\beta$=0 or 1 accounts for the sign of the speech waveform. Since the speech waveform can be represented by the decomposition $$s(n) = \sum_{k=1}^{K} A_k \exp[j(n\omega_k + \theta_k)]$$

amplitudes and phases that would have been produced by the glottal and vocal tract models can be identified as:

$$A_k=|H_s(\omega_k)|$$

$$\theta_k=-n_0\omega_k+\Phi_s(\omega_k) \quad (3)$$

This shows that the sine-wave amplitudes are samples of the glottal pulse and vocal tract magnitude response, and the sine-wave phase is made up of a linear component due to glottal excitation and a dispersive component due to the vocal tract filter.

In the synthetic phase model, the linear phase component is computed by keeping track of an artificial set of onset times or by computing an onset phase obtained by integrating the instantaneous pitch frequency. The vocal tract phase is approximated by computing a minimum phase from the vocal tract envelope. One way to combine the measured baseband phases with a highband synthetic phase model is to estimate the onset time from the measured phases and then use this in the synthetic phase model. This estimation problem has already been addressed in the art and reasonable results were obtained by determining the values of $n_0$ and $\beta$ to minimize the squared error $$E(n_0, \beta) = \sum_{n=-N}^{N} |s(n) - \hat{s}(n; n_0, \beta)|^2$$

This method was found to produce reasonable estimates for low-pitched speakers. For high-pitched speakers the vocal tract envelope is undersampled and this led to poor estimates of the vocal tract phase and ultimately poor estimates of the linear phase. Moreover the estimation algorithm required use of a high order FFT at considerable expense in complexity.

The question arises as to whether or not a simpler algorithm could be developed using the sine-wave representation at the output of the square-law nonlinearity. Since this waveform is made up of the difference frequencies and phases, Eqn. 3 above shows that if the difference phases would provide multiple samples of the linear phase. In the next section, a detailed analysis is developed to show that it is indeed possible to obtain good estimate of the linear phase using the nonlinear processing paradigm.

(4) Excitation Phase Parameters Estimation

It has been demonstrated that high quality synthetic speech can be obtained using a harmonic sine-wave representation for the speech waveform. Therefore rather than dealing with the general sine-wave representation, the harmonic model is used as the starting point for this analysis. In this case $$s(n)=\Sigma\bar{A}(k\omega_0)\exp\{j[nk\omega_0+\bar{\theta}(k\omega_0)]\}$$

where the quantities with the bar notation are the harmonic samples of the envelopes fitted to the amplitudes and phases of the peaks of the short-time Fourier transform. A cubic spline envelope has been found to work well for the amplitude envelope and a zero order spline envelope works well for the phases. From Eqn. 3, the harmonic synthetic phase model for this speech sample is given by $$\hat{s}(n) = \sum_{k=1}^{K} \bar{A}(k\omega_0)\exp\{j[(n - n_0) + \Phi(k\omega_0) + \beta\pi]\}$$

At this point it is worthwhile to introduce some additional notation to simplify the analysis. First, $\phi_0=-n_0\omega_0$ is used to denote the phase of the fundamental. $A_k$ and $\phi_k$ are used to denote the harmonic samples of the magnitude and phase spline vocal tract envelope and finally $\theta_k$ are used to denote the harmonic samples of the STFT phase. Letting the measured and modeled waveforms be written as $$s(n) = \sum_{k=1}^{K} s_k(n) = \sum_{k=1}^{K} A_k \exp[j(nk\omega_0 + \theta_k)]$$

$$\hat{s}(n) = \sum_{k=1}^{K} \hat{s}_k(n) = \sum_{k=1}^{K} A_k \exp[j(nk\omega_0 - k\varphi_0 - \Phi_k - \beta\pi)]$$

new waveforms corresponding to the output of the square-law nonlinearity are defined as $$y_l(n) = \sum_{k=1}^{K-l} s_{k+l}s_k^*(n) = \sum_{k=1}^{K-l} A_{k+l}A_k \exp[j(nl\omega_0 + \theta_{k+l} - \theta_k)]$$

$$\hat{y}_l(n) = \sum_{k=1}^{K-l} \hat{s}_{k+l}(n)\hat{s}_k^*(n) = \sum_{k=1}^{K-l} A_{k+l}A_k \exp[j(nl\omega_0 + l\phi_0 + \Phi_{k+l} - \Phi_k)]$$

for 1=1,2, . . . , L. A reasonable criterion for estimating the onset phase is to find that value of $\phi_0$ that minimizes the squared-error $$E_l(\varphi_0) = \frac{1}{2N+1}\sum_{n=-N}^{N} |y_l(n) - \hat{y}(n;\varphi_0)|^2$$

which, for $N>2\pi/\omega_0$, reduces to $$E_l(\varphi_0) = 2\sum_{k=1}^{K} A_{k+l}^2 A_k^2 (1 - \cos[(\theta_{k+l} - \Phi_{k+l}) - (\theta_k - \Phi_k) - l\varphi_0]\} \tag{4}$$

Letting $P_{k,1}=A_{k+1}\hat{}2\ A_k\hat{}2$, $\epsilon_{k+1}=\theta_{k+1}-\Phi_{k+1}$, and $\epsilon_k=\theta_k-\Phi_k$, picking $\phi_0$ to minimize the estimation error in Eqn. 4 is the same as choosing that value of to maximize the function $$E_l(\varphi_0) = \sum_{k=l}^{K-l} P_{k,l}\cos(\varepsilon_{k+l} - \varepsilon_k - l\varphi_0)$$

70

Letting $$R_l = \sum_{k=1}^{K-l} P_{k,l}\cos(\varepsilon_{k+l} - \varepsilon_k)$$

$$I_l = \sum_{k=1}^{K} P_{k,l}\sin(\varepsilon_{k+l} - \varepsilon_k)$$

the function to be maximized can be written as $$E_l(l\varphi_0) = R_l\cos(l\varphi_0) + I_l\sin(l\varphi_0)$$

$$= \sqrt{R_l^2 + I_l^2}\cos[l\varphi_0 - \tan^{-1}(I_l/R_l)]$$

It is then obvious that the maximizing value of $\phi_0$, satisfies the equation $$\hat{\varphi}_0(l) = \frac{1}{l}\tan^{-1}(I_l/R_l) \tag{5}$$

73

Although all of the terms in the right-hand-size of this equation are known, it is possible to estimate the onset phase only to within a multiple of $2\pi$. However, by definition, $\phi_0=-n_0\omega_0$. Since the onset time is the time at which the sine waves come into phase, this must occur within one pitch period about the center of the analysis frame. Setting in l=1 in Eqn. 5 results in the unambiguous least-squared-error estimate of the onset phase:

$$\hat{\phi}_0(1)=\tan^{-1}(I_1/R_1)$$

In general there can be no guarantee that the onset phase based on the second order differences, will be unambiguous. In other words, $$\hat{\varphi}_0(2) = \frac{1}{2}[\tan^{-1}(I_2/R_2) + 2\pi M(2)]$$

where M(2) is some integer. If the estimators are performing properly, it is expected that the estimate from lag 1 should be "close" to the estimate from the second lag. Therefore, to a first approximation a reasonable estimate of M(2) is to let $$\hat{M}(2) = \text{integer}\left(\frac{2\hat{\varphi}_0(1)}{2\pi}\right)$$

Then for the square-law nonlinearity based on second order differences, the estimate for the onset phase is $$\hat{\varphi}_0(2) = \frac{1}{2}\left[\tan^{-1}(I_2/R_2) + 2\pi\hat{M}(2)\right]$$

Since now there are two measurements of the onset phase, then presumably a more robust estimate can be obtained by averaging the two estimates. This gives a new estimator as $$\hat{\varphi}_0(2) = \frac{1}{2}[\hat{\varphi}_0(1) + \hat{\varphi}_0(2)]$$

This estimate can then be used to resolve the ambiguities for the next stage by computing $$\hat{M}(3) = \text{integer}\left(\frac{3\hat{\varphi}_0(2)}{2\pi}\right)$$

and then the onset phase estimate for the third order differences is $$\hat{\varphi}_0(3) = \frac{1}{3}[\tan^{-1}(I_3/R_3) + 2\pi M(3)]$$

and this estimate can be smoothed using the previous estimates to give $$\hat{\varphi}_0(3) = \frac{1}{3}[\hat{\varphi}_0(1) + \hat{\varphi}_0(2) + \hat{\varphi}(3)]$$

This process can be continued until the onset phase for the L-th order difference has been computed. At the end of this set of recursions, there will have been computed the final estimate for the phase of the fundamental. In the sequel, this will be denoted by $\phi_0$ hat.

There remains the problem of estimating the phase offset, $\beta$. Since the outputs of the square-law nonlinearity give no information regarding this parameter, it is necessary to return to the original sine-wave representation for the speech signal. A reasonable criterion is to pick $\beta$ to minimize the squared-error $$E''(\beta) = \frac{1}{2N+1}\sum_{n=-N}^{N}|s(n)-\hat{s}(n;\beta)|^2$$
$$= \sum_{k=1}^{K} A_k^2[1-\cos(\theta_k - k\hat{\varphi}_0 - \Phi_k - \beta\pi]$$

Following the same procedure used to estimate the onset phase, it is easy to show that the least-squared error estimate of $\beta$ is $$\beta = \frac{1}{\pi}\tan^{-1}\left[\left(\sum_{k=1}^{K} A_k^2\sin(\theta_k - k\hat{\varphi}_0 - \Phi_k)\right)\Big/\sum_{k=1}^{K} A_k^2\cos(\theta_k - k\hat{\varphi}_0 - \Phi_k)\right)\right]$$

In order to get some feeling for the utility of these estimates of the excitation phase parameters is to compute and examine the residual phase errors, the errors that remain after the minimum phase and the excitation phase have been removed from the measured phase. These residual phases are given by $$\epsilon_k = (\theta_k - k\hat{\phi}_0 - \Phi_k - \beta\pi)$$

Figure 15:
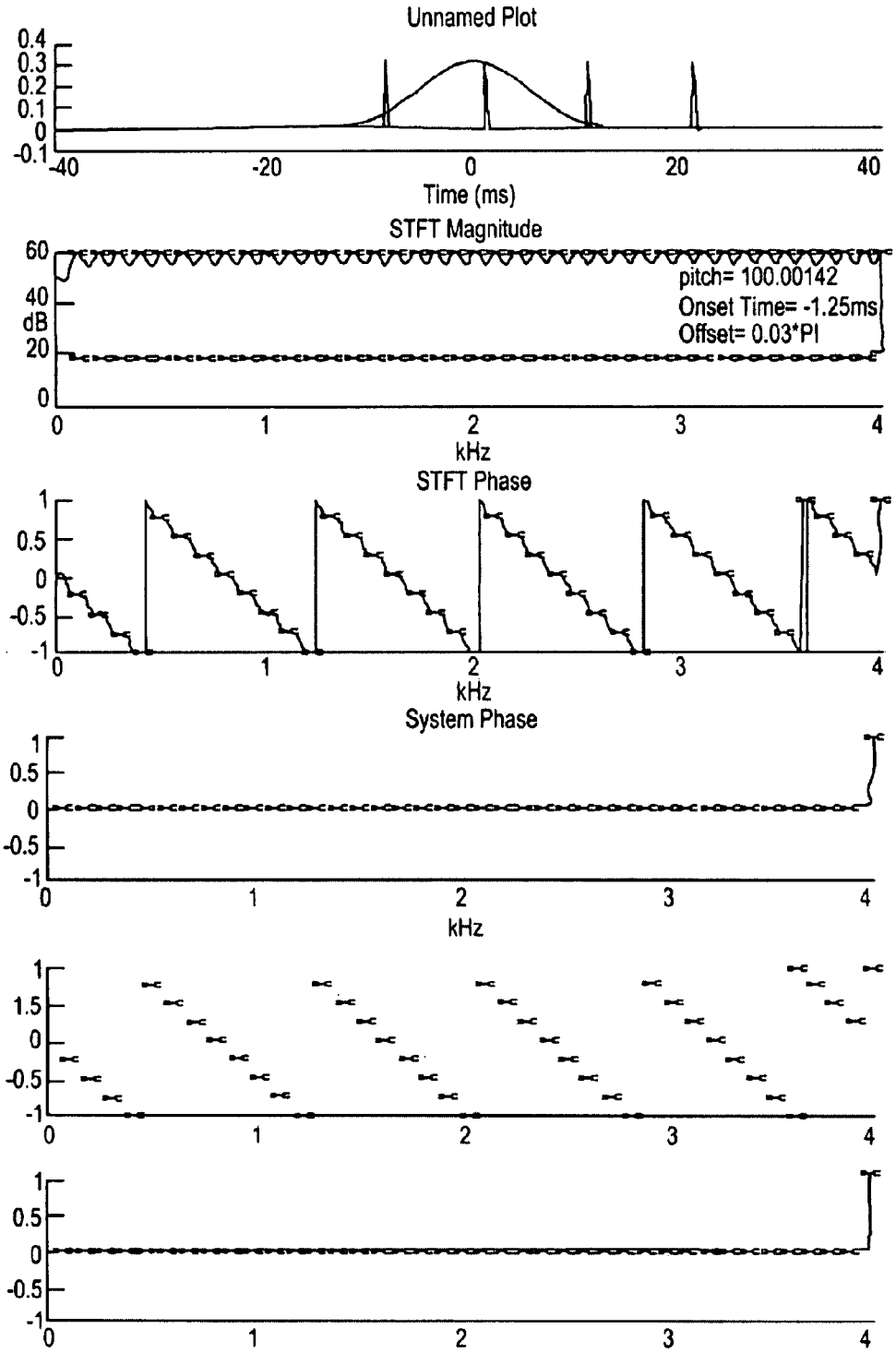
FIG. 15 is an illustration of the application of nonlinear signal processing to estimate linear excitation phases.

A useful test signal check the validity of the method is to use a simple pulse train input signal. Such a waveform is shown in the first panel in FIG. 15. The second panel shows the STFT magnitude and the peaks at the harmonics of the 100 Hz pitch frequency are shown. The third panel shows the STFT phase and the effect of the wrapped phases is clearly shown. The fourth panel shows the system phase, which in this case is zero since the minimum phase associated with a flat envelope is zero. In the fifth panel the result of subtracting the system phase from the measured phases is shown. Since the minimum phase is zero, these phases are the same as those shown in the fourth panel. Also shown in the fifth panel are the harmonic samples of the excitation phase as computed from the linear phase model. In this case, the estimates agree exactly with the measurements. This is further verified in the sixth panel which is a plot of the residual phases, and as can be seen, these are essentially zero.

Figure 16:
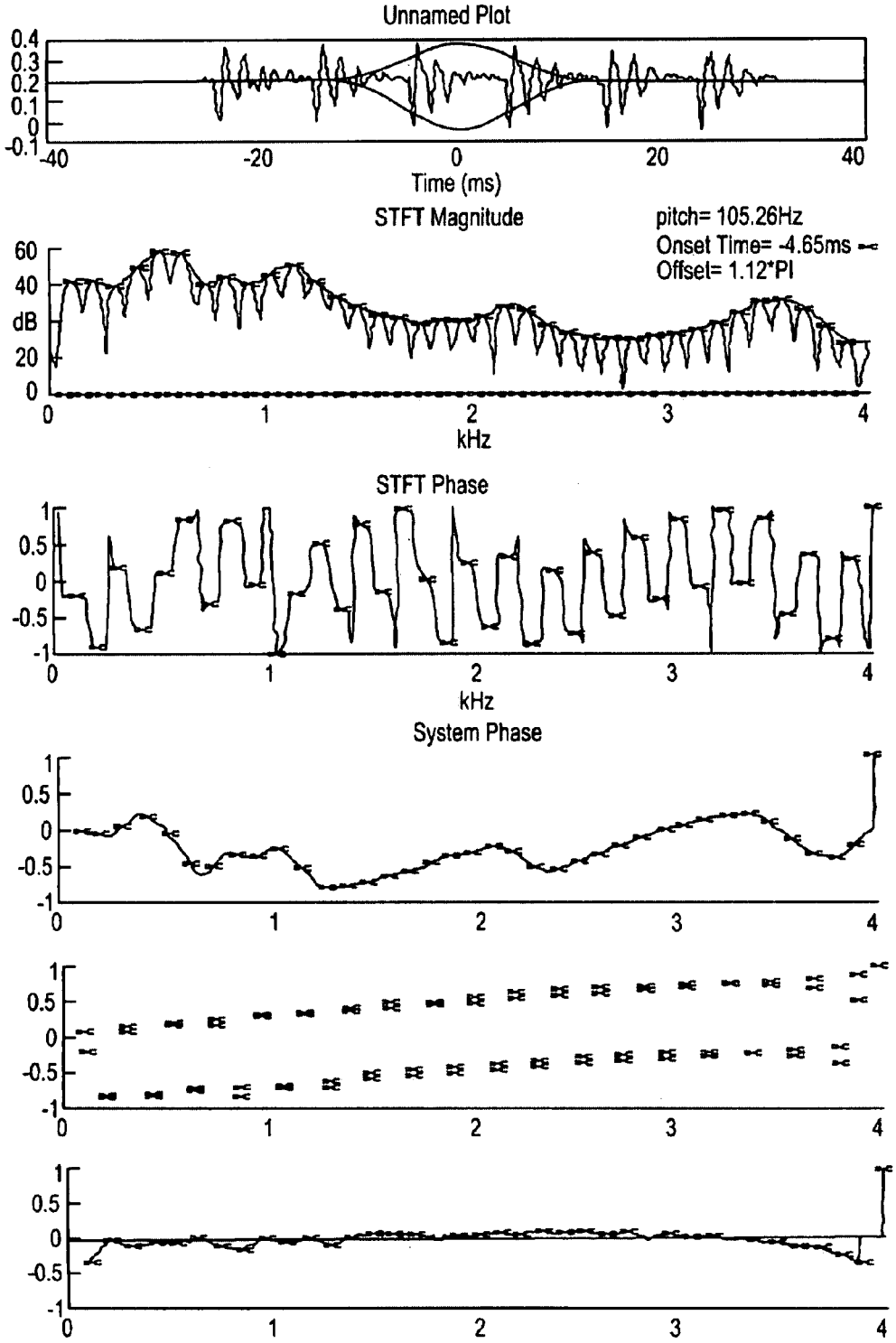
FIG. 16 shows non-linear processing results for a low pitched speaker.
Figure 17:
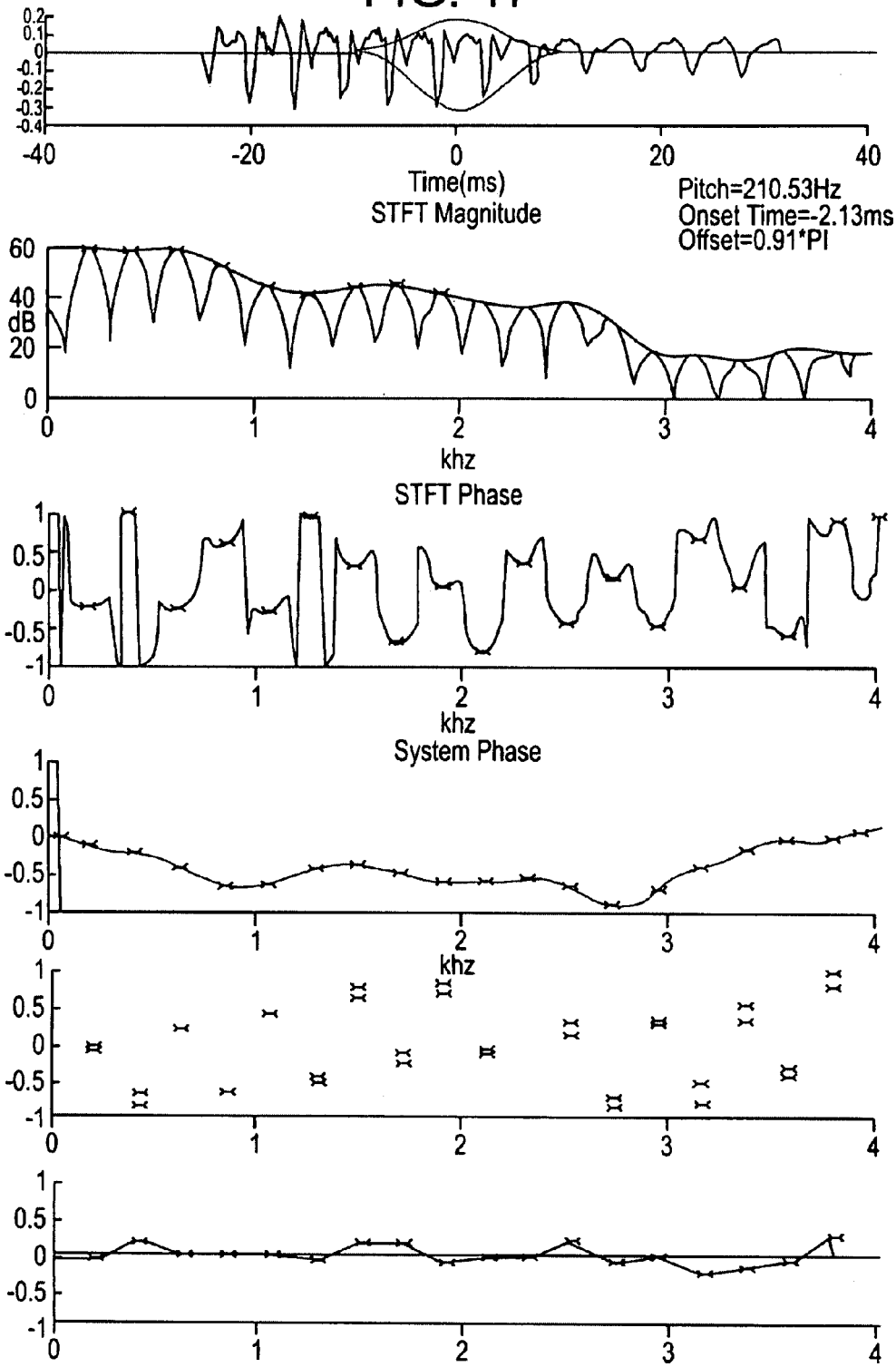
FIG. 17 shows the same set of results as FIG. 16 but for a high-pitched speaker.
Figure 18:
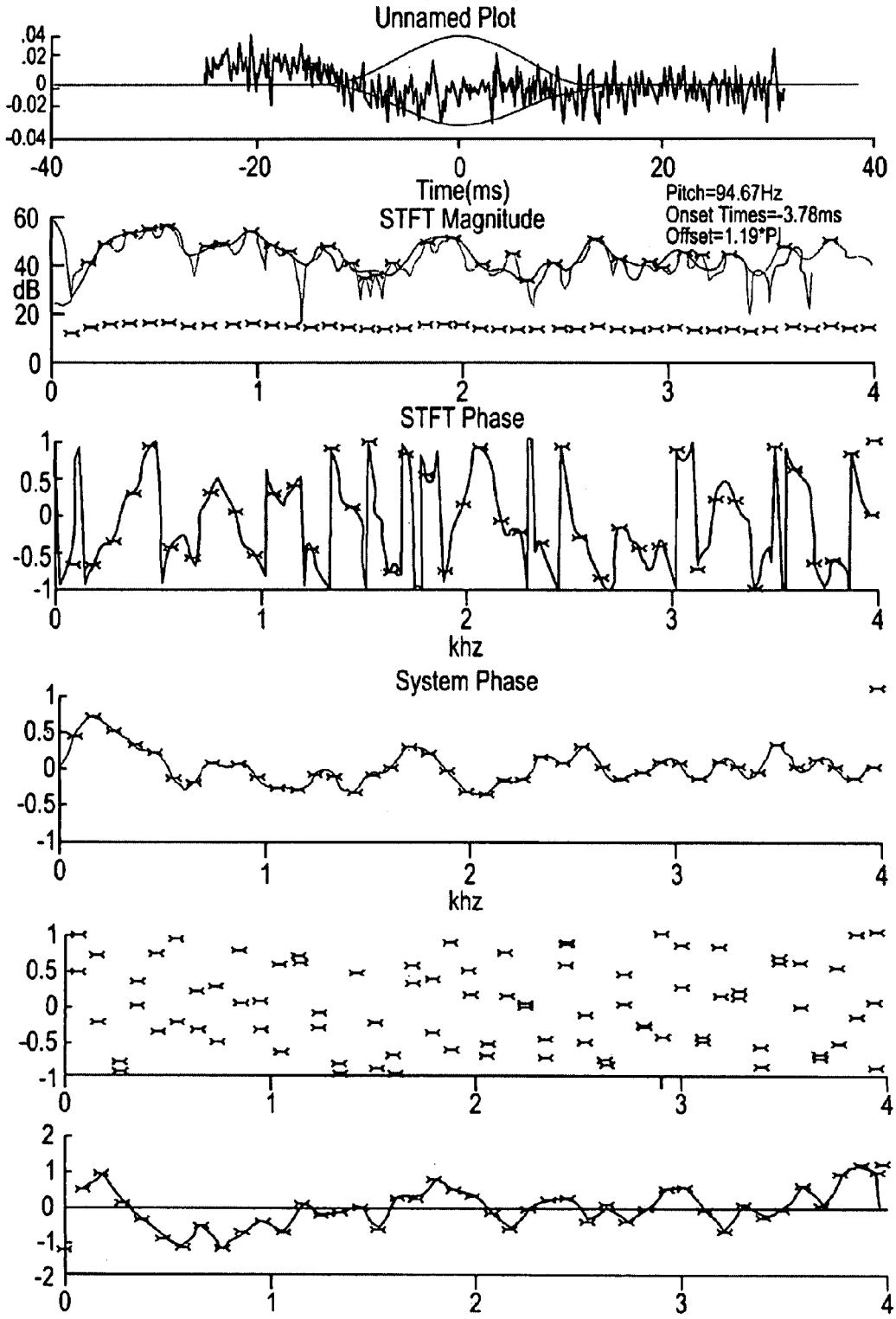
FIG. 18 shows non-linear signal processing results for a segment of unvoiced speech.

Another set of results is shown in FIG. 16 for a low-pitched speaker. The first panel shows the waveform segment to be analyzed, the second panel shows the STFT magnitude and the peaks used in the estimator analysis, the third panel shows the measured STF phases and the fourth panel shows the minimum phase system phase. The fifth panel shows the difference between the measured STFT phases and the system phases, and these are not exactly linear. Also plotted is the linear phase estimates obtained after the estimates of the excitation parameters have been computed. Finally in the sixth panel, the residual phases are shown to be quite small. FIG. 17 shows another set of results obtained for a high-pitched speaker. It is expected that the estimates might not be quite as good since the system phase is undersampled. However, at least for this case, the estimates are quite good. As a final example, FIG. 18 shows the results for a segment of unvoiced speech. In this case the residual phases are of course not small.

(5) Mixed Phase Processing

One way to perform mixed phase synthesis is to compute the excitation phase parameters from all of the available data, provide those estimates to the synthesizer. Then if only a set of baseband measured phases are available to the receiver, the highband phases can be obtained by adding the system phase to the linear excitation phase. This method requires that the excitation phase parameters be quantized and transmitted to the receiver. Preliminary results have shown that a relatively large number of bits is needed to quantize these parameters to maintain high quality. Furthermore, the residual phases would have to be computed and quantized and this can add considerable complexity to the analyzer.

Figure 19:
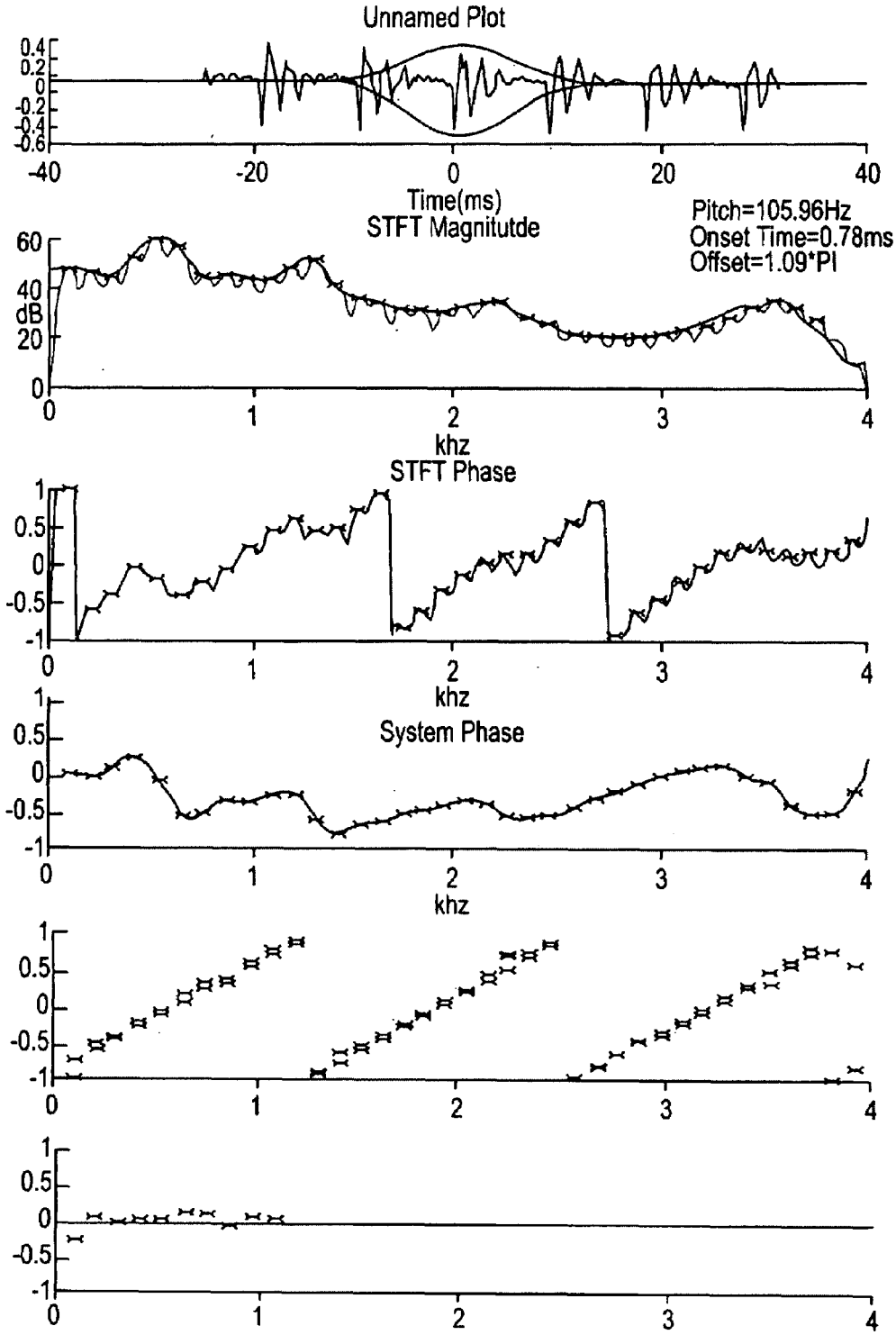
FIG. 19 illustrates estimates of the excitation parameters at the receiver from the first 10 baseband phases.

Another approach is to quantize and transmit the set of baseband phases and then estimate the excitation parameters at the receiver. While this eliminates the need to quantize the excitation parameters, there may be too few baseband phases available to provide good estimates at the receiver. An example of the results of this procedure are shown in FIG. 19 where the excitation parameters are estimated from the first 10 baseband phases. As can be seen in the sixth panel, the residual baseband phases are quite small, while surprisingly, in the fifth panel, it can be seen that the linear phase estimates provide a fairly good math to the measured excitation phases. In fact, after extensive listening tests, it has been verified that this is quite an effective procedure for solving the classical high-frequency regeneration problem.

Following is a description of a specific embodiment of mixed-phase processing in accordance with the present invention, using multi-mode coding, as described in Sections B(2) and B(5) above. In multi-mode coding different phase quantization rules are applied depending on whether the signal is in a steady-state or a transition-state. During steady-state, the synthesizer uses a set of synthetic phases composed of a linear phase, and minimum phase system phase, and a set of random phases that are applied to those frequencies above the voicing-adaptive cutoff. See Sections C(3) and C(4) above. The linear phase component is obtained by adding a quadratic phase to the linear phase that was used on the previous frame. The quadratic phase is the area of the pitch frequency contour computed for the pitch frequencies of the previous and current frames. Notably, no phase information is measured or transmitted at the encoder side.

During the transition-state condition, in order to obtain a more robust pitch and voicing measure, it is desired to determine a set of baseband phases at the analyzer, transmit them to the synthesizer and use them to compute the linear phase and the phase offset components, as described above.

Industry standards, such as those of the International Telecommunication Union (ITU) have certain specifications concerning the input signal. For example, the ITU specifies that a 16 kHz input speech must go through a lowpass filter and a bandpass filter (a modified IRS "Intermediate Reference System") before being downsamped to a 8 kHz sampling rate and fed to the encoder. The ITU lowpass filter has a sharp drop off in frequency response beyond the cutoff frequency (approximately around 3800 Hz). The modified IRS is a bandpass filter used in most telephone transmission systems which has a lower cutoff frequency around 300 Hz and upper cutoff frequency around 3400 Hz. Between 300 Hz and 3400 Hz, there is a 10 dB highpass spectral tilt. To comply with the ITU specifications, a codec must therefore operate on IRS filtered speech which significantly attenuates the baseband region. In order to gain the most benefit from baseband phase coding, therefore, if N phases are to be coded (where in a preferred embodiment N~6), in a preferred embodiment of the present invention, rather than coding the phases of the first N sinewaves, the phases of the N contiguous sinewaves having the largest cumulative amplitudes are coded. The amplitudes of contiguous sinewaves must be used so that the linear phase component can be computed using the nonlinear estimator technique explained above. If the phase selection process is based on the harmonic samples of the quantized spectral envelope, then the synthesizer decisions can track the analyzer decisions without having to transmit any control bits.

As discussed above, in a specific embodiment, one can transmit the phases of the first (e.g., 8 harmonics) having the lowest frequencies. However, in cases where the baseband speech is filtered, as in the ITU standard, or simply whenever these harmonics have fairly low magnitudes so that perceptually it doesn't make much difference whether the phases are transmitted or not another approach is warranted. If the magnitude, and hence the power, of such harmonics is so low that we can barely hear these harmonics, then it doesn't matter how accurate we quantize and transmit these phases—it will all just be a waste. Therefore, in accordance with a preferred embodiment, when only a few bits are available for transmitting the phase information of a few harmonics, it makes much more sense to transmit the phases of those few harmonics that are perceptually most important, such as those with the highest magnitude or power. For the non-linear processing techniques described above to extract the linear phase term at the decoder, the group of harmonics should be contiguous. Therefore, in a specific embodiment the phases of the N contiguous harmonics that collectively have the largest cumulative magnitude are used.

D. Quantization

Figure 20:
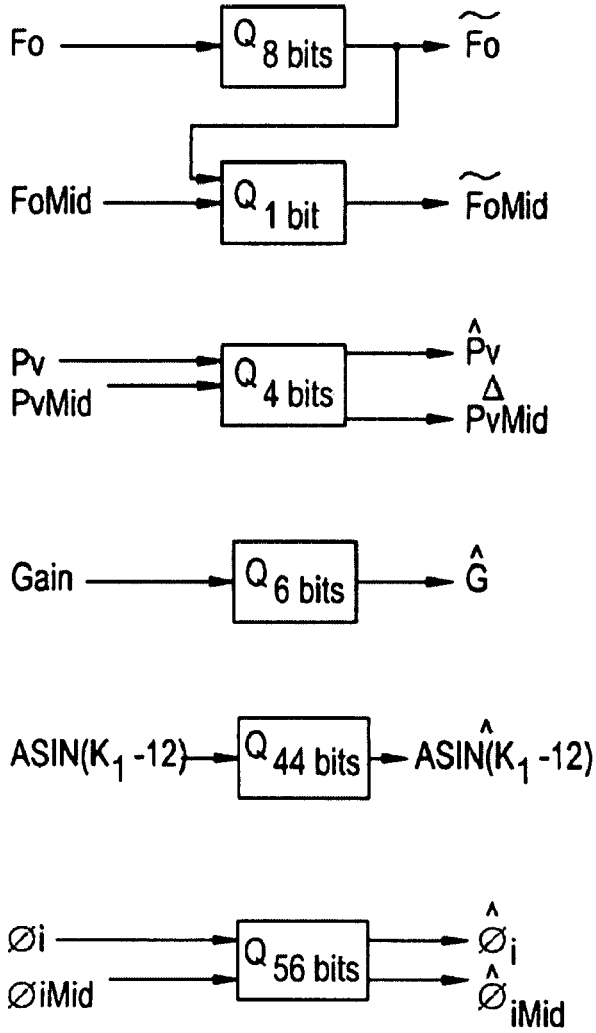
FIG. 20 illustrates the quantization of parameters in a preferred embodiment of the present invention.

Quantization is an important aspect of any communication system, and is critical in low bit-rate applications. In accordance with preferred embodiments of the present invention, several improved quantization methods are advanced that individually and in combination improve the overall performance of the system. FIG. 20 illustrates parameter quantization in accordance with a preferred embodiment of the present invention.

(1) Intraframe Prediction Assisted Quantization of Spectral Parameters

As noted, in the system of the present invention, a set of parameters is generated every frame interval (e.g., every 20 ms). Since speech may not change significantly across two or more frames, substantial savings in the required bit rate can be realized if parameter values in one frame are used to predict the values of parameters in subsequent frames. Prior art has shown the use of inter-frame prediction schemes to reduce the overall bit-rate. In the context of packet-switched network communication, however, lost or out-of-order packets can create significant problems for any system using inter-frame prediction.

Accordingly, in a preferred embodiment of the present invention, bit-rate savings are realized by using intra-frame prediction in which lost packets do not affect the overall system performance. Furthermore, conforming with the underlying principles of this invention, a quantization system and method is proposed in which parameters are encoded in an "embedded" manner, i.e., progressively added information merely adds to, but does not supersede, low bit-rate encoded information.

Figure 21:
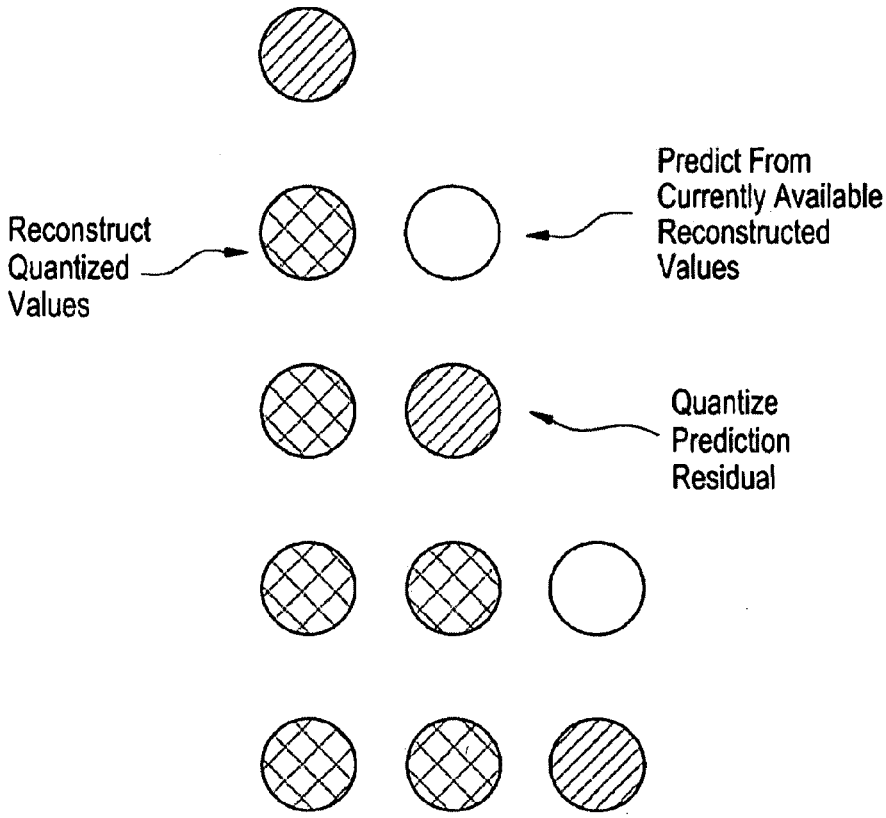
FIG. 21 illustrates the time sequence used in the maximally intraframe prediction assisted quantization method in a preferred embodiment of the present invention.

FIG. 21 illustrates the time sequence used in the maximally intraframe prediction assisted quantization method in a preferred embodiment of the present invention.

This technique, in general, is applicable to any representation of spectral information, including line spectral pairs (LSPs), log area ratios (LARs), and linear prediction coefficients (LPCs), reflection coefficients (RC) and the arc sine of the RCs, to name a few. RC parameters are especially useful in the context of the present invention because, unlike LPC parameters, increasing the prediction order by adding new RCs does not affect the values of previously computed parameters. Using the arc sine of RC, on the other hand, reduces the sensitivity to quantization errors.

Additionally, the technique is not restricted in terms of the number of values that are used for prediction, and the number of values that are predicted at each pass. With reference to the example shown in FIG. 21, it is assumed that the values are generated from left to right, and that only one value is predicted in each pass. This assumption is especially relevant to RCs (and their arc sines) which exemplify embedded parameter generation.

The first step in the process is to subtract the vector of means from the actual parameter vector $\omega=\{\omega_0, \omega_1, \omega, \ldots, \omega_{N-1}\}$ to form the mean removed vector, $\omega mr=\omega-\overline{\omega}$. It should be noted that the mean vector is obtained in a preferred embodiment from a training sequence and represents the average values of the components of the parameter vector over a large number of frames.

The result of the first prediction assisted quantization step cannot use any intraframe prediction, and is shown as a single solid black circle in FIG. 21. The next step is to form the reconstructed signal. For the values generated by the first quantization, the reconstructed values are the same as the quantized values since no interframe prediction is available. The next step is to predict the subsequent vector values, as indicated by the empty circle in FIG. 21. The equation for this prediction is $$\omega p=a\bullet\omega r$$

where ωp is the vector of predicted values, a is a matrix of prediction coefficients, and ωr is the vector of spectral coefficients from the current frame which have already been quantized and reconstructed. The matrix of prediction coefficients is pre-calculated and is obtained in a preferred embodiment using a suitable training sequence. The next step is to form residual signal. The residual value, ωr, is given in a preferred embodiment by the equation $$\omega res=\omega mr+\omega p$$

At this point, the residual is quantized. The quantized signal, ωq represents an approximation of the residual value, and can be determined, among other methods, from scalar or vector quantization, as known in the art.

Finally, the value that will be available at the decoder is reconstructed. This reconstructed value, ωrec, is given i na preferred embodiment by $$\omega rec=\omega p+\omega q$$

Figure 21A:
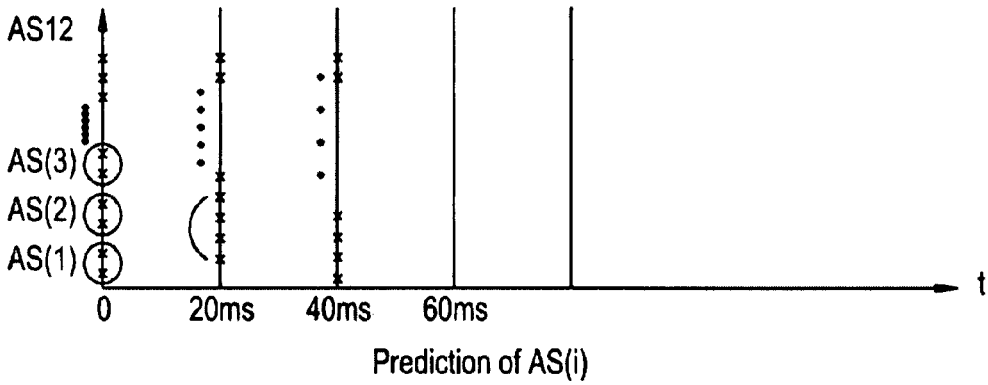
FIG. 21A shows an implementation of the prediction assisted quantization illustrated in FIG. 21.
Figure 21A:
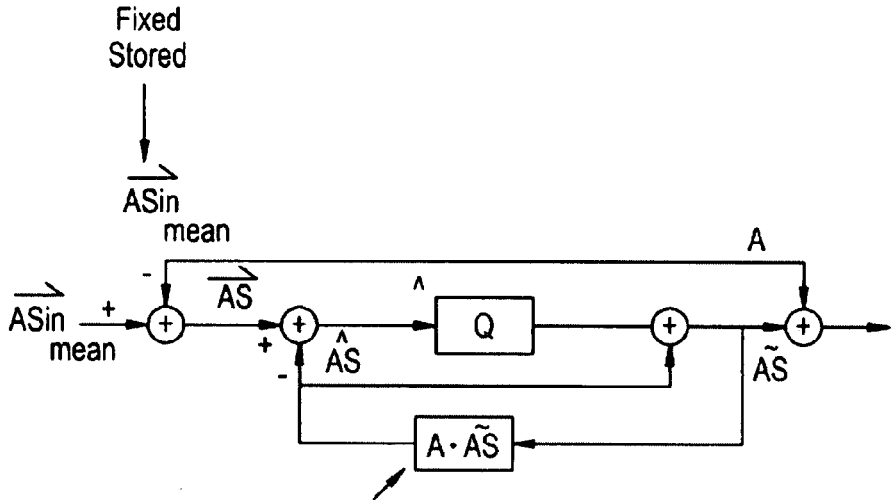

At this point, in accordance with the present invention the process repeats iteratively to generate the next set of predicted values, which are used to determine residual values, that are quantized, are then used to form the next set of reconstructed values. This process is repeated until all of the spectral parameters from the current frame are quantized. FIG. 21A shows an implementation of the prediction assisted quantization described above. It should be noted that for enhanced system performance two sets of matrix values can be used: one for voiced, and a second for unvoiced speech frames.

This section describes an example of the approach to quantizing spectrum envelope parameters used in a specific embodiment of the present invention. The description is made with reference to the log area ratio (LAR) parameters, but can be extended easily to equivalent datasets. In a specific embodiment, the LAR parameters for a given frame are quantized differently depending on the voicing probability for the frame. A fixed threshold is applied to the voicing probability Pv to determine whether the frame is voiced or unvoiced.

In the next step, the mean value is removed from each LAR as shown above. Preferably, there are two sets of mean values, one for voiced LARs and one for unvoiced LARs. The first two LARs are quantized directly in a specific embodiment.

Higher order LARs are predicted in accordance with the present invention from previously quantized lower order LARs, and the prediction residual is quantized. Preferably, there are separate sets of prediction coefficients for voiced and unvoiced LARs.

In order to reduce the memory size, the quantization tables for voiced LARs can be also applied (with appropriate scaling) to unvoiced LARs. This increases the quantization distortion in unvoiced spectra but the increased distortion is not perceptible. For many of the LARs the scale factor is not necessary.

(2) Joint Quantization of Measured Phases

Figure 22A:
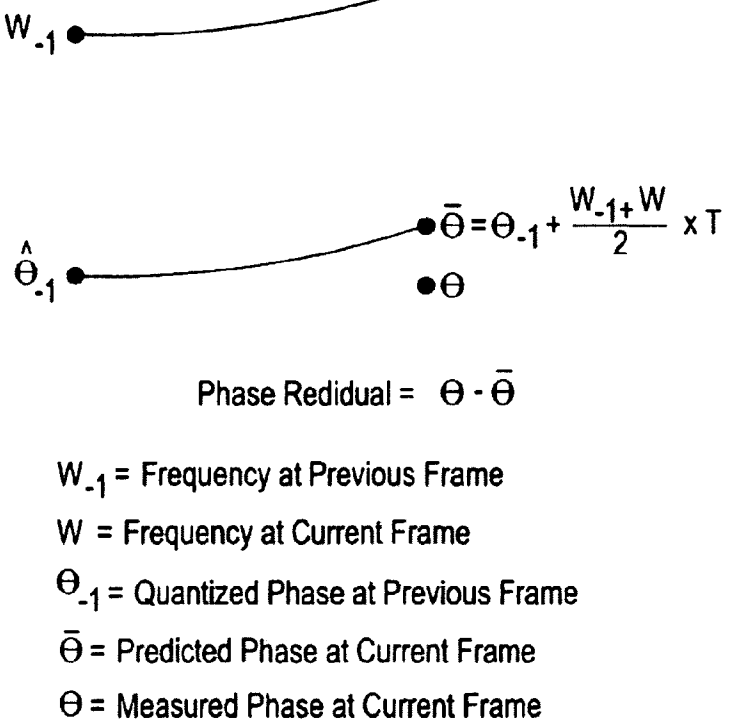
FIG. 22A illustrates phase predictive coding.

Prior art, including some written by one of the co-inventors of this application, has shown that very high-quality speech can be obtained for a sinusoidal analysis system that uses not only the amplitudes and frequencies but also measured phases, provided the phases are measured about once every 10 ms. Early experiments have shown that if each of the phases are quantized using about 5 bits per phase, little loss in quality occurred. Harmonic sine-wave coding systems have been developed that quantize the phase-prediction error along the each frequency track. By linearly interpolating the frequency along each track, the phase excursion from one frame to the next is quadratic. As shown in FIG. 22A, the phase at a given frame can be predicted from the previously quantized phase by adding the quadratic phase prediction term. Although such a predictive coding scheme can reduce the number of bits required to code each phase, it is susceptible to channel error propagation.

Figure 22B:
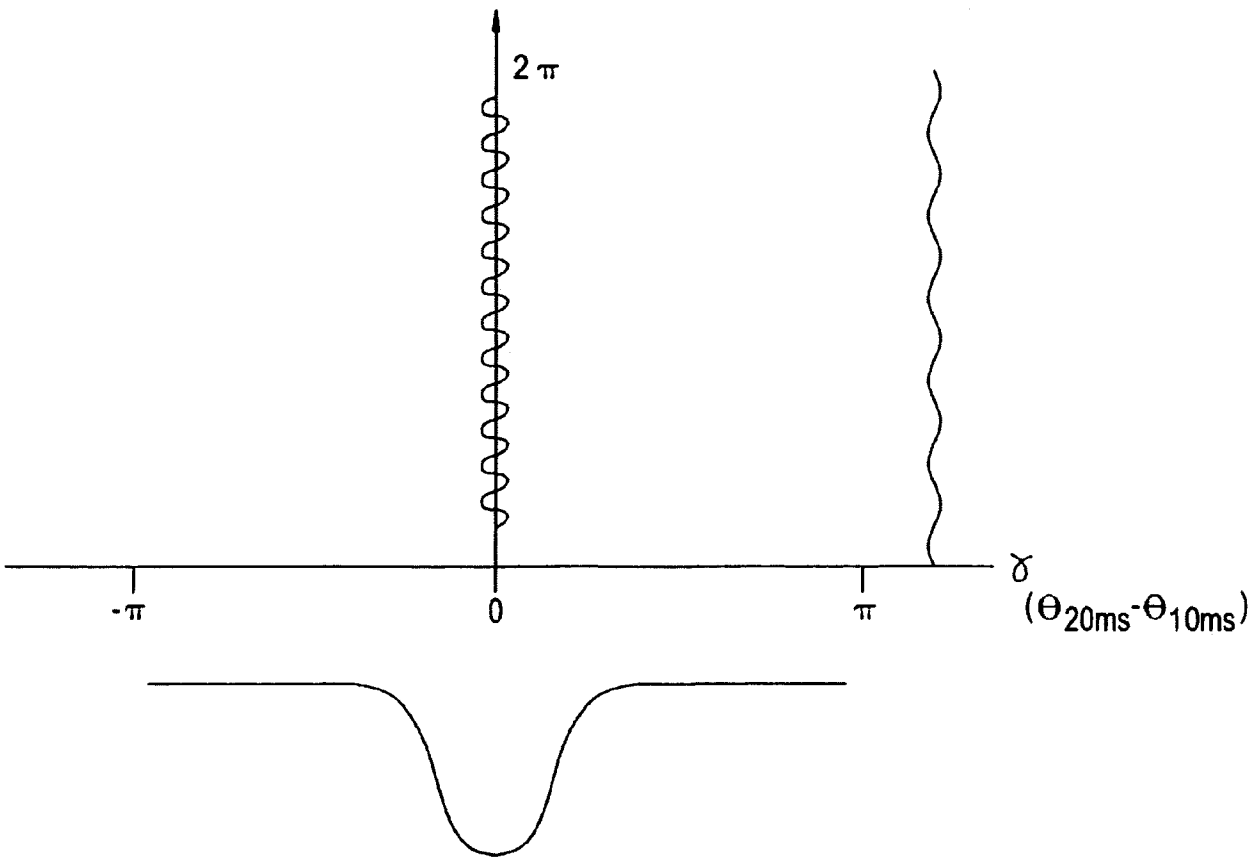
FIG. 22B is a scatter plot of a 20 ms phase and the predicted 10 ms phase measured for the first harmonic of a speech signal.

As noted above, in a preferred embodiment of the present invention, the frame size used by the codec is 20 ms, so that there are two 10 ms subframes per system frame. Therefore, for each frequency track there are two phase values to be quantized every system frame. If these values are quantized separately each phase would require five bits. However, the strong correlation that exists between the 20 ms phase and the predicted value of the 10 ms phase can be used in accordance with the present invention to create a more efficient quantization method. FIG. 22B is a scatter plot of the 20 ms phase and the predicted 10 ms phase measured for the first harmonic. Also shown is the histogram for each of the phase measurements. If a scalar quantization scheme is used to code the phases, it is obvious that the 20 ms phase should be coded uniformly in the range of [0,2PI], using about 5 bits per phase, while the 10 ms phase prediction error can be coded using a properly designed Lloyd-Max quantizer requiring less than 5 bits. Further efficiencies could be obtained using a vector quantizer design. Also shown in the figure are the centers that would be obtained using 7 bits per phase pair. Listening experiments have shown that there is no loss in quality using 8 bits per phase pair, and just noticeable loss with 7 bits per pair, the loss being more noticeable for speakers with a higher pitch frequency.

(3) Mixed-Phase Quanitization Issues

In accordance with a preferred embodiment of the present invention multi-mode coding, as described in Sections B(2), B(5) and C(5) can be used to improve the quality of the output signal at low bit rates. This section describes certain practical issues arising in this specific embodiment.

With reference to Section C(5) above, in a transition state mode, if N phases are to be coded, where in a preferred embodiment N~6, rather than coding the phases of the first N sinewaves, the phases of the N contiguous sinewaves having the largest cumulative amplitudes are coded. The amplitudes of contiguous sinewaves must be used so that the linear phase component can be computed using the nonlinear estimator techniques discussed above. If the phase selection process is based on the harmonic samples of the quantized spectral envelope, then the synthesizer decisions can track the analyzer decisions without having to transmit any control bits.

In the process of generating the quantized spectral envelope for the amplitude selection process, the envelope of the minimum phase system phase is also computed. This means that some coding efficiency can be obtained by removing the system phase from the measured phases before quantization. Using the signal model developed in Section C(3) above, the resulting phases are the excitation phases which in the ideal voiced speech case would be linear. Therefore, in accordance with a preferred embodiment of the present invention, more efficient phase coding can be obtained by removing the linear phase component and then coding the difference between the excitation phases and the quantized linear phase. Using the nonlinear estimation algorithm disclosed above, the linear phase and phase offset parameters are estimated from the difference between the measured baseband phases and the quantized system phase. Since these parameters are essentially uniformly distributed phases in the interval $[0, 2\pi]$, uniform scalar quantization is applied in a preferred embodiment to both parameters using 4 bits for the linear phase and 3 bits for the phase offset. The quantized versions of the linear phase and the phase offset are computed and then a set of residual phases are obtained by subtracting the quantized linear phase component from the excitation phase at each frequency corresponding to the baseband phase to be coded. Experiments show that the final set of residual phases tend to be clustered about zero and are amenable to vector quantization. Therefore, in accordance with a preferred embodiment of the present invention, a set of N residual phases are combined into an N-vector and quantized using an 8-bit table. Vector quantization is generally known in the art so the process of obtaining the tables will not be discussed in further detail.

In accordance with a preferred embodiment, the indices of the linear phase, the phase offset and the VQ-table values are sent to the synthesizer and used to reconstruct the quantized residual phases, which when added to the quantized linear phase gives the quantized excitation phases. Adding the quantized excitation phases to the quantized system phase gives the quantized baseband phases.

For the unquantized phases, in accordance with a preferred embodiment of the present invention the quantized linear phase and phase offset are used to generate the linear phase component, to which is added the minimum phase system phase, to which is added a random residual phase provided the frequency of the unquantized phase is above the voicing adaptive cutoff.

In order to make the transition smooth while switching from the synthetic phase model to the measured phase model, on the first transition frame, the quantized linear phase and phase offset are forced to be collinear with the synthetic linear phase and the phase offset projected from the previous synthetic phase frame. The difference between the linear phases and the phase offsets are then added to those parameters obtained on succeeding measured-phase frames.

Following is a brief discussion of the bit allocation in a specific embodiment of the present invention using 4 kbp/s multi-mode coding. The bit allocation of the codec in accordance with this embodiment of the invention is shown in Table 1. As seen, in this two-mode sinusoidal codec, the bit allocation and the quantizer tables for the transmitted parameters are quite different for the two modes. Thus, for the steady state mode, the LSP parameters are quantized to 60 bits, and the gain, pitch, and voicing are quantized to 6, 8, and 3 bits, respectively. For the transition state mode, on the other hand, the LSP parameters, gain, pitch, and voicing are quantized to 29, 6, 7, and 5 bits, respectively. 30 bits are allotted for the additional phase information.

With the state flag bit added, the total number of bits used by the pure speech codec is 78 bits per 20 ms frame. Therefore, the speech codec in this specific embodiment is a 3.9 kbit/s codec. In order to enhance the performance of the codec in noisy channel conditions, 2 parity bits are added in each of the two codec modes. This makes the final total bit-rate to 80 bits per 20 ms frame, or 4.0 kbit/s.

TABLE 1

Bit Allocation for the Two Different States

| Parameter | Steady State | Transition State |
|---|---|---|
| LSP | 60 | 29 |
| Gain | 6 | 6 |
| Pitch | 8 | 7 |
| Voicing | 3 | 5 |
| Phase | — | 30 |
| State Flag | 1 | 1 |
| Parity | 2 | 2 |
| Total | 80 | 80 |

As shown in the table, in a preferred embodiment, the sinusoidal magnitude information is represented by a spectral envelope, which is in turn represented by a set of LPC parameters. In a specific 4 kb/s codec embodiment, the LPC parameters used for quantization purpose are the Line-Spectrum Pair (LSP) parameters. For the transition state, the LPC order is 10, and 29 bits are used for quantizing the 10 LSP coefficients, and 30 bits are used to transmit 6 sinusoidal phases. For the steady state, on the other hand, the 30 phase bits are saved, and a total of 60 bits is used to transmit the LSP coefficients. Due to this increased number of bits, one can afford to use a higher LPC order, in a preferred embodiment 18, and spend the 60 bits transmitting 18 LSP coefficients. This allows the steady-state voiced regions to have a finer resolution in the spectral envelope representation, which in turn results in better speech quality than attainable with a 10th order LPC representation.

In the bit allocation table shown above, the 5 bits allocated to voicing during transition state is actually vector quantizing two voicing measures: one at the 10 ms mid-frame point, and the other at the end of the 20 ms frame. This is because voicing generally can benefit from a faster update rate during transition regions. The quantization scheme here is an interpolative VQ scheme. The first dimension of the vector to be quantized is the linear interpolation error at the mid-frame. That is, we linearly interpolate between the end-of-frame voicing of this frame and the last frame, and the interpolated value is subtracted from the actual value measured at mid-frame. The result is the interpolation error. The second dimension of the input vector to be quantized is the end-of-frame voicing value. A straightforward 5-bit VQ codebook of is designed for such a composite vector.

Finally, it should be noted that although throughout this application the two modes of the codec were referred to as being either steady state or transition state, strictly speaking in accordance with the present invention, classifying each speech frame is done into one of two modes: either steady-state voiced region, or anything else (including silence, steady-state unvoiced regions, and the true transition regions). Thus, the first "steady state" mode expression is used merely for convenience.

The complexity of the codec in accordance with the specific embodiment defined above is estimated assuming that a commercially available, general-purpose, single-ALU, 16-bit fixed-point digital signal processor (DSP) chip, such as the Texas Instrument's TMS320C540, is used for implementing the codec in the full-duplex mode. Under this assumption, the 4 kbit/s codec is estimated to have a computational complexity of around 25 MIPS. The RAM memory usage is estimated to be around 2.5 kwords, where each word is 16 bits long. The total ROM memory usage for both the program and data tables is estimated to be around 25 kwords (again assuming 16-bit words). Although these complexity numbers may not be exact, the estimation error is believed to be within ±10% most likely, and within ±20% in the worse case. In any case, the complexity of the 4 kbit/s codec in accordance with the specific embodiment defined above is well within the capability of the current generation of 16-bit fixed-point DSP chips for single-DSP full-duplex implementation.

(4) Multistage Vector Quantization

Vector Quantization (VQ) is an efficient way to quantize a "vector", which is an ordered sequence of scalar values. The quantization performance of VQ generally increases with increasing vector dimension. However, the main barrier in using high-dimensionality VQ is that the codebook storage and the codebook search complexity grow exponentially with the vector dimension. This limits the use of VQ to relatively low bit-rates or low vector dimensionalities. Multi-Stage Vector Quantization (MSVQ), as known in the art, is an attempt to address this complexity issue. In MSVQ, the input vector is first quantized in a first-stage vector quantizer. The resulting quantized vector is subtracted from the input vector to obtain a quantization error vector, which is then quantized by a second-stage vector quantizer. The second-stage quantization error vector is further quantized by a third-stage vector quantizer, and the process goes on until VQ at all stages is performed. The decoder simply adds all quantizer output vectors from all stages to obtain an output vector which approximates the input vector. In this way, high bit-rate, high-dimensionality VQ can be achieved by MSVQ. However, MSVQ generally result in a significant performance degradation compared with a single-stage VQ for the same vector dimension and the same bit-rate.

As an example, if the first pair of arcsine of PARCOR coefficients is vector quantized to 10 bits, a conventional vector quantizer needs to store a codebook of 1024 codevectors, each of which having a dimension of 2. The corresponding exhaustive codebook search requires the computation of 1024 distortion values before selecting the optimum codevector. This means 2048 words of codebook storage and 1024 distortion calculations—a fairly high storage and computational complexity. On the other hand, if a two-stage MSVQ with 5 bits assigned for each stage is used, each stage would have only 32 codevectors and 32 distortion calculations. Thus, the total storage is only 128 words and the total codebook search complexity is 64 distortion calculations. Clearly, this is a significant reduction in complexity compared with single-stage 10-bit VQ. However, the coding performance of standard MSVQs (in terms of signal-to-noise ratio (SNR)) is also significantly reduced.

In accordance with the present invention, a novel method and architecture of MSVQ is proposed, called Rotated and Scaled Multi-Stage Vector Quantization (RS-MSVQ). The RS-MSVQ method involves rotating and scaling the target vectors before performing codebook searches from the second-stage VQ onward. The purpose of this operation is to maintain a coding performance close to single-stage VQ, while reducing the storage and computational complexity of a single-stage VQ significantly to a level close to conventional MSVQ. Although in a specific embodiment illustrated below, this new method is applied to two-dimensional, two-stage VQ of arcsine of PARCOR coefficients, it should be noted that the basic ideas of the new RS-MSVQ method can easily be extended to higher vector dimensions, to more than two stages, and to quantizing other parameters or vector sources. It should also be noted that rather than performing both rotation and scaling operations, in some cases the coding performance may be good enough by performing only the rotation, or only the scaling operation (rather than both). Thus, such rotation-only or scaling-only MSVQ schemes should be considered special cases of the general invention of the RS-MSVQ scheme described here.

Figure 24A:
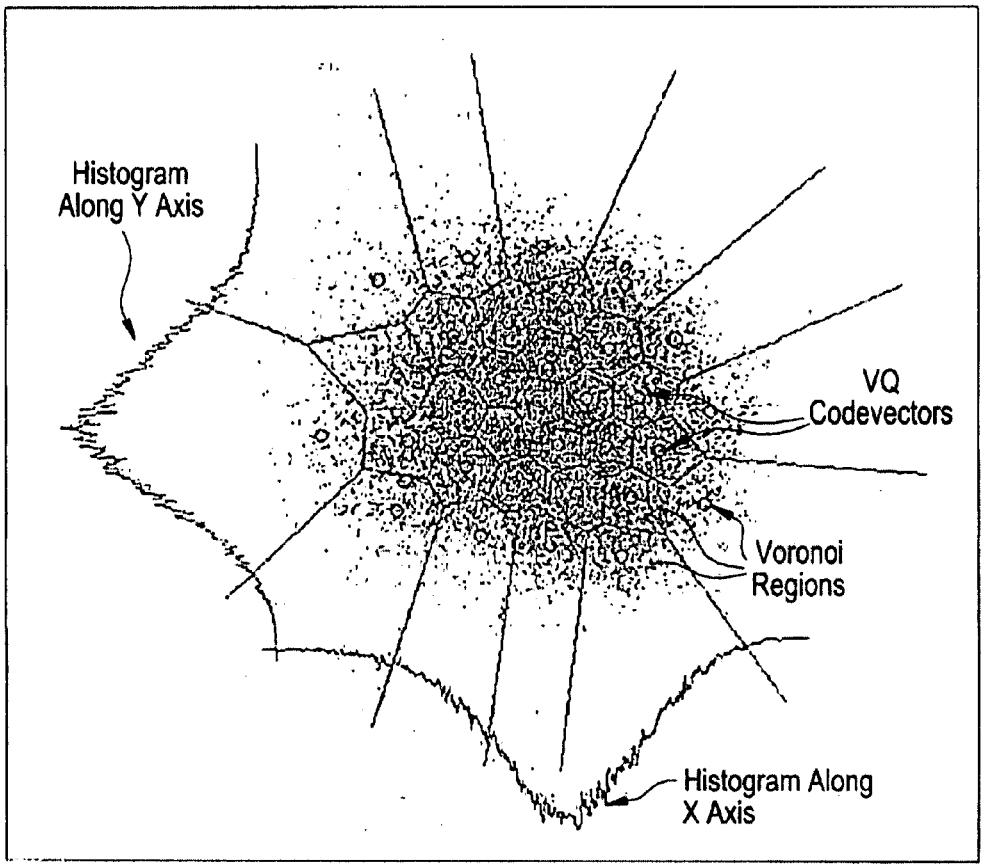
FIG. 24A is a scattered plot of pairs of arc sine intra-frame prediction reflection coefficients and histograms used to build a VQ codebook in a preferred embodiment.

To understand how RS-MSVQ works, one first needs to understand the so-called "Voronoi region" (which is sometimes also called the "Voronoi cell"). For each of the N codevectors in the codebook of a single-stage VQ or the first-stage VQ of an MSVQ system, there is an associated Voronoi region. The Voronoi region of a particular codevector is one for which all input vectors in the region are quantized using the same codevector. For example, FIG. 24A shows the 32 Voronoi regions associated with the 32 codevectors of a 5-bit, two-dimensional vector quantizer. This vector quantizer was designed to quantize the fourth pair of the intra-frame prediction error of the arcsine of PARCOR coefficients in a preferred embodiment of the present invention. The small circles indicate the locations of the 32 codevectors. The straight lines around those codevectors define the boundaries of the 32 Voronoi regions.

Two other kinds of plots are also shown in FIG. 24A: a scatter plot of the VQ input vectors used for training the codebook, and the histograms of the VQ input vectors calculated along the X axis or the Y axis. The scatter plot is shown as numerous gray dots in FIG. 24A, each dot representing the location of one particular VQ input training vector in the two-dimensional space. It can be seen that near the center the density of the dots is high, and the dot density decreases as we move away from the center. This effect is also illustrated by the X-axis and Y-axis histograms plotted along the bottom side and the left side of FIG. 24A, respectively. These are the histograms of the first or the second element of the fourth pair of intra-frame prediction error of the arcsine of PARCOR coefficients. Both histograms are roughly bell-shaped, with larger values (i.e., higher probability of happening) near the center and smaller values toward both ends.

A standard VQ codebook training algorithm, known in the art automatically adjusts the locations of the 32 codevectors to the varying density of VQ input training vectors. Since the probability of the VQ input vector being located near the center (which is the origin) is higher then elsewhere, to minimize the quantization distortion (i.e., to maximize the coding performance), the training algorithm places the codevectors closer together near the center and further apart elsewhere. As a result, the corresponding Voronoi regions are smaller near the center and larger away from it. In fact, for those codevectors at the edges, the corresponding Voronoi regions are not even bounded in size. These unbounded Voronoi regions are denoted as "outer cells", and those bounded Voronoi regions that are not around the edge are referred to as "inner cells".

Figure 24B:
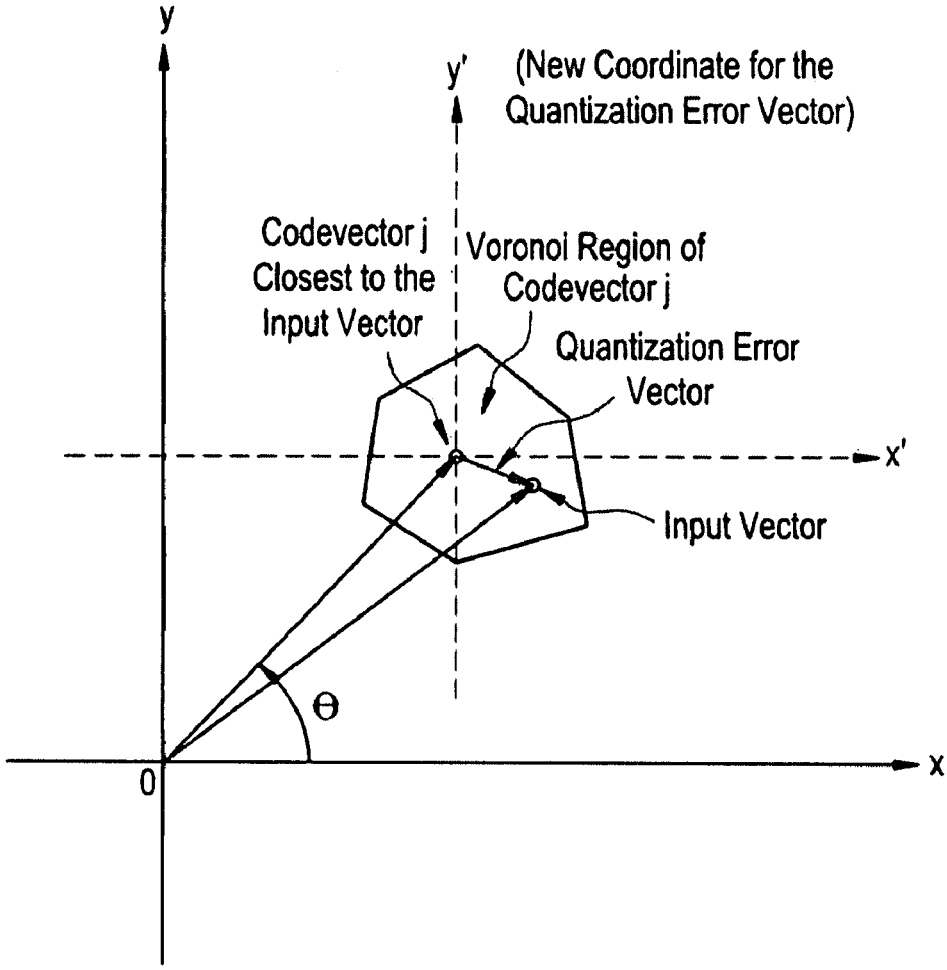
FIG. 24B illustrates the quantization error vector in a vector quantizer.

It has been observed that it is the varying sizes, shapes, and probability density functions (pdf's) of different Voronoi regions that cause the significant performance degradation of conventional MSVQ when compared with single-stage VQ. For conventional MSVQ, the input VQ target vector from the second-stage on is simply the quantization error vector of the preceding stage. In a two-stage VQ, for example, the error vector of the first stage is obtained by subtracting the quantized vector (which is the codevector closest to the input vector) of the first stage VQ from the input vector. In other words, the error vector is simply the small difference vector originating from the location of nearest codevector and terminating at the location of the input vector. This is illustrated in FIG. 24B. As far as the quantization error vector is concerned, it is as if we translate the coordinate system so that the new coordinate system has it origin on the nearest codevector, as shown in FIG. 24B. What this means is that, if all error vectors associated with a particular codevector are plotted as a scatter plot, the scatter plot will take the shape of the Voronoi region associated with that codevector, with the origin now located at the codevector location. In other words, if we consider the composite scatter plot of all quantization error vectors associated with all first-stage VQ codevectors, the effect of subtracting the nearest codevector from the input vector is to translate (i.e., to move) all Voronoi regions toward the origin, so that all codevector locations within the Voronoi regions are aligned with the origin.

If a separate second-stage VQ codebook for each of the 32 first-stage VQ codevectors (and the associated Voronoi regions) is designed, each of the 32 codebooks will be optimized for the size, shape, and pdf of the corresponding Voronoi region, and there is very little performance degradation (assuming that during encoding and decoding operations, we switch to the dedicated second-stage codebook according to which first-stage codevector is chosen). However, this approach results in storage requirements. In conventional MSVQ, only a single second-stage VQ codebook (rather than 32 codebooks as mentioned above) is used. In this case, the overall two-dimensional pdf of the input training vectors for the codebook design can be obtained by "stacking" all 32 Voronoi regions (which are translated to the origin as described above), and adding all pdf's associated with each Voronoi region. The single codebook designed this way is basically a compromise between the different shapes, sizes, and pdf's of the 32 Voronoi regions of the first-stage VQ. It is this compromise that causes the conventional MSVQ to have a significant performance degradation when compared with single-stage VQ.

Figure 23A:
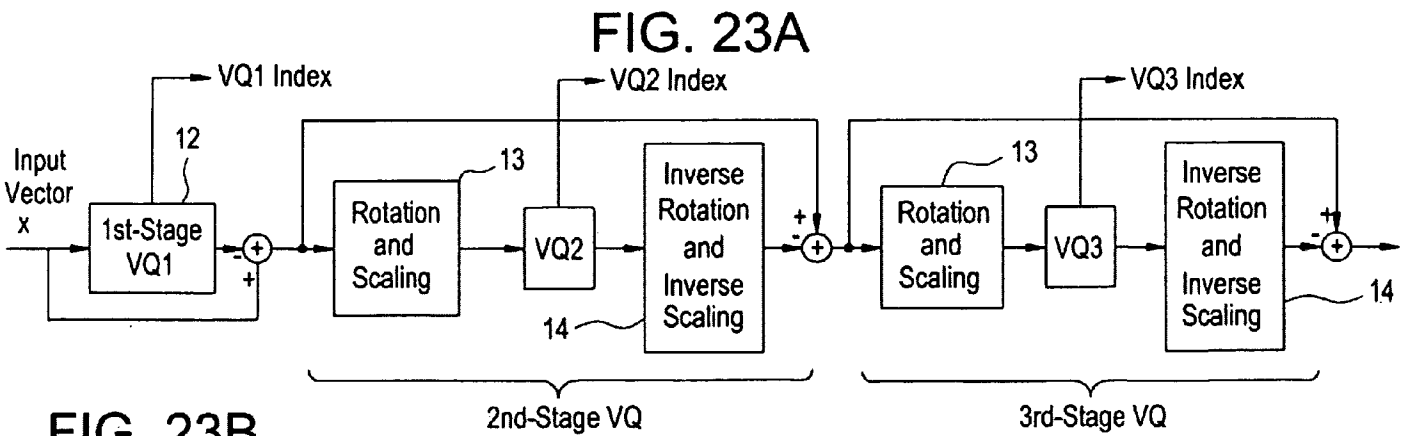
FIG. 23A is a block diagram of an RS-multistage vector quantization encoder of the codec in a preferred embodiment.
Figure 23B:
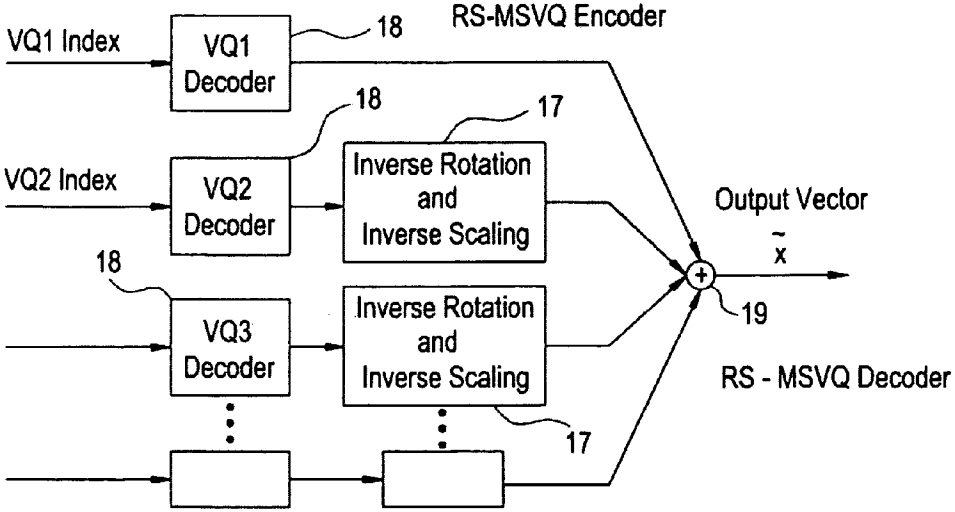
FIG. 23B is a block diagram of the decoder vector quantizer corresponding to the multi-stage encoder in FIG. 23A.

In accordance with the present invention, a novel RS-MSVQ system, as illustrated in FIGS. 23A and 23B, is proposed to maximize the coding performance without the necessity of a dedicated second-stage codebook for each first-stage codevector. In a preferred embodiment, this is accomplished by rotating and scaling the quantization error vectors to "align" the corresponding Voronoi regions as closely as possible, so that the resulting single codebook designed for such rotated and scaled previous-stage quantization error vector is not a significant compromise. The scaling operation attempts to equalize the size of the resulting scaled scatter plots of quantization error vectors in the Voronoi regions. The rotation operation serves two main functions: aligning the general trend of pdf within the Voronoi region, and aligning the shapes or boundaries of the Voronoi regions.

An example will help to illustrate these points. With reference to the scatter plot and the histograms shown in FIG. 24A, the Voronoi regions near the edge, especially those "outer cells" right along the edge, are larger than the Voronoi regions near the center. The size of the outer cells is in fact not defined since the regions are not bounded. However, even in this case the scatter plot still has a limited range of coverage, which can serve as the "size" of such outer cells. One can pre-compute the size (or a size indicator) of the coverage range of the scatter plot of each Voronoi region, and store the resulting values in a table. Such scaling factors can then be used in a preferred embodiment in actual encoding to scale the coverage range of the scatter plot of each Voronoi region so that they cover roughly the same area after scaling.

As to the rotation operation, applied in a preferred embodiment, by proper rotation at least the outer cells can be aligned so that the side of the cell which is unbounded points to the same direction. It is not so obvious why rotation is needed for inner cells (those Voronoi regions with bounded coverage and well-defined boundaries). This has to do with the shape of the pdf. If the pdf, which corresponds roughly to the point density in the scatter plot, is plotted in the Z axis away from the drawing shown in FIG. 24A, a bell-shaped three-dimensional surface with highest point around the origin (which is around the center of the scatter plot) will result. As one moves away from the center in any direction, the pdf value generally goes down. Thus, the pdf within each Voronoi region (except for the Voronoi region near the center) generally has a slope, i.e., the side of the Voronoi region closer to the center will generally have a higher pdf then the opposite side. From a codebook design standpoint, it is advantageous to rotate the Voronoi regions so that the side with higher pdf's are aligned. This is particularly important for those outer cells which have a long shape, with the pdf's decaying as one moves away from the origin, but in accordance with the present invention this is also important for inner cells if the coding performance is to be maximized. When such proper rotation is done, the composite pdf of the "stacked" Voronoi regions will have a general slope, with the pdf on one side being higher than the pdf of the opposite side. A codebook designed with such training data will have more closely spaced codevectors near the side with higher pdf values. The rotation angle associated with each first-stage codevector (or each first-stage Voronoi region) can also be pre-computed and stored in a table in accordance with a preferred embodiment of the present invention.

The above example illustrates a specific embodiment of a two-dimensional, two-stage VQ system. The idea behind RS-MSVQ, of course, can be extended to higher dimensions and more than two stages. FIGS. 23A and 23B show block diagrams of the encoder and the decoder of an M-stage RS-MSVQ system in accordance with a preferred embodiment of the present invention. In FIG. 23A, the input vector is quantized by the first stage vector quantizer VQ1, and the resulting quantized vector is subtracted from the input vector to form the first quantization error vector, which is the input vector to the second-stage VQ. This vector is rotated and scaled before being quantized by VQ2. The VQ2 output vector then goes through the inverse rotation and inverse scaling operations which undo the rotation and scaling operations applied earlier. The result is the output vector of the second-stage VQ. The quantization error vector of the second-stage VQ is then calculated and fed to the third-stage VQ, which applies similar rotation and scaling operations and their inverse operations (although in this case the scaling factor and the rotation angles are obviously optimized for the third-stage VQ). This process goes on until the M-th stage, where no inverse rotation nor inverse scaling is necessary, since the output index of VQ M is already obtained.

In FIG. 23B, the M channel indices corresponding to the M stages of VQ are decoded, and except for the first stage VQ, the decoded VQ outputs of the other stages go through the corresponding inverse rotation and inverse scaling operations. The sum of all such output vectors and the first-stage VQ output vectors is the final output vector of the entire M-stage RS-MSVQ system.

Using the general ideas of this invention, of rotation and scaling to align the sizes, shapes, and pdf's of Voronoi regions as much as possible, there are still numerous ways for determining the rotation angles and scaling factors. In the sequel, a few specific embodiments are described. Of course, the possible ways for determining the rotation angles and scaling factors are not limited to what are described below.

In a specific embodiment, the scaling factors and rotation angles are determined as follows. A long sequence of training vectors is used to determine the scaling factors. Each training vector is quantized to the nearest first-stage codevector. The Euclidean distance between the input vector and the nearest first-stage codevector, which is the length of the quantization error vector, is calculated. Then, for each first-stage codevector (or Voronoi region), the average of such Euclidean distances is calculated, and the reciprocal of such average distance is used as the scaling factor for that particular Voronoi region, so that after scaling, the error vectors in each Voronoi region have an average length of unity.

In this specific embodiment, the rotation angles are simply derived from the location of the first-stage codevectors themselves, without the direct use of the training vectors. In this case, the rotation angle associated with a particular first-stage VQ codevector is simply the angle traversed by rotating this codevector to the positive X axis. In FIG. 24B, this angle for the codevector shown there would be $-\theta$. Rotation with respect to any fixed axis can also be used, if desired. This arrangement works well for bell-shaped, circularly symmetric pdf such as what is implied in FIG. 24 A. One advantage is that the rotation angles do not have to be stored, thus saving some storage memory. Thus, one can choose to compute the rotation angle on-the-fly using just the first-stage VQ codebook data. This of course requires a higher level of computational complexity. Therefore, if the computational complexity is an issue, one can also choose to pre-compute such rotation angles and store them. Either embodiment can be used dependent on the particular application.

In a preferred embodiment, for the special case of two-dimensional RS-MSVQ, there is a way to store both the scaling factor and the rotation angle in a compact way which is efficient in both storage and computation. It is well-known in the art that in the two-dimensional vector space, to rotate a vector by an angle θ, we simply have to multiply the two-dimensional vector by a 2-by-2 rotation matrix:

$$\begin{vmatrix} \cos(\theta) & -\sin(\theta) \\ \sin(\theta) & \cos(\theta) \end{vmatrix}$$

In the example used above, there is a rotation angle of −θ, and assuming the scaling factor is g, then, in accordance with a preferred embodiment a "rotation-and-scaling matrix" can be defined as follows:

$$A = g\begin{vmatrix} \cos\theta & \sin\theta \\ -\sin\theta & \cos\theta \end{vmatrix} = \begin{vmatrix} g\cos\theta & g\sin\theta \\ -g\sin\theta & g\cos\theta \end{vmatrix}$$

Since the second row of A is redundant from a data storage standpoint, in a preferred embodiment one can simply store the two elements in the first row of the matrix A for each of the first-stage VQ codevectors. Then, the rotation and scaling operations can be performed in one single step: multiplying the quantization error vector of the preceding stage by the A matrix associated with the selected first-stage VQ codevector. The inverse rotation and inverse scaling operation can easily be done by solving the matrix equation Ax=b, where b is the quantized version of the rotated and scaled error vector, and x is the desired vector after the inverse rotation and inverse scaling.

In accordance with the present invention, all rotated and scaled Voronoi regions together can be "stacked" to design a single second-stage VQ codebook. This would give substantially improved coding performance when compared with conventional MSVQ. However, for enhanced performance at the expense of slightly increased storage requirement, in a specific embodiment one can lump the rotated and scaled inner cells together to form a training set and design a codebook for it, and also lump the rotated and scaled outer cells together to form another training set and design a second codebook optimized just for coding the error vectors in the outer cells. This embodiment requires the storage of an additional second-stage codebook, but will further improve the coding performance. This is because the scatter plots of inner cells are in general quite different from those of the outer cells (the former being well-confined while the latter having a "tail" away from the origin), and having two separate codebooks enables the system to exploit these two different input source statistics better.

In accordance with the present invention, another way to further improve the coding performance at the expense of slightly increased computational complexity is to keep not just one, but two or three lowest distortion codevectors in the first-stage VQ codebook search, and then for each of these two or three "survivor" codevectors, perform the corresponding second-stage VQ, and finally pick the combination of the first and second-stage codevectors that gives the lowest overall distortion for both stages.

Figure 24C:
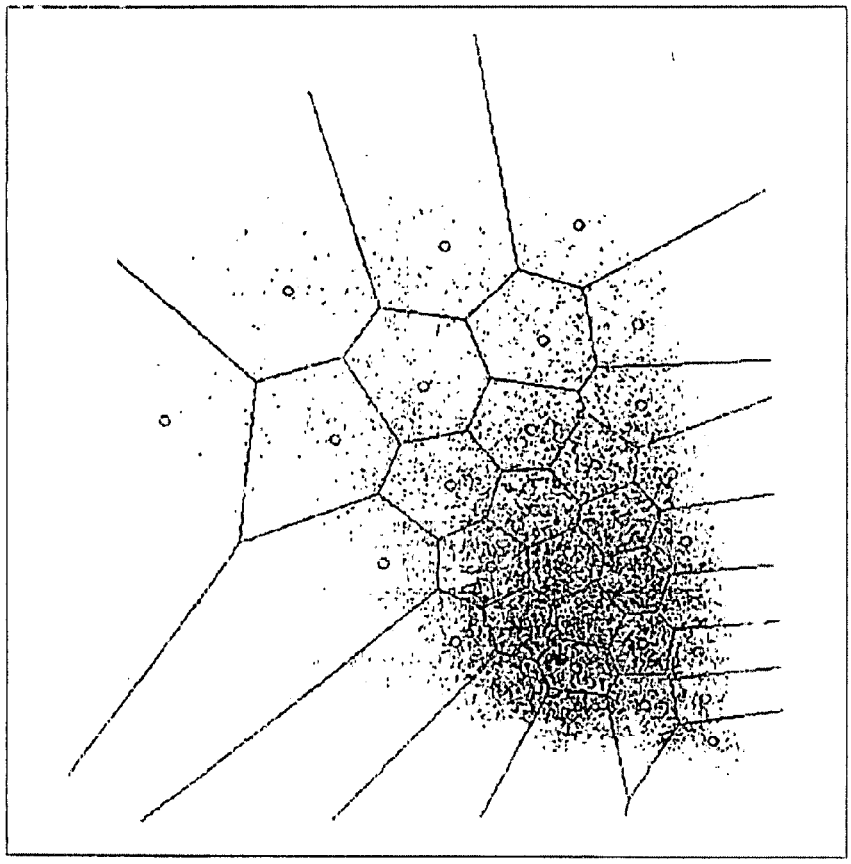
FIG. 24C is a scatter plot and an illustration of the first-stage VQ codevectors and Voronoi regions for the first pair of arcsine of PARCOR coefficients for the voiced regions of speech.

In some situations, the pdf may not be bell-shaped or circularly symmetric (or spherically symmetric in the case of VQ dimension higher than 2), and in this case the rotation angles determined above may be sub-optimal. An example is shown in FIG. 24C, where the scatter plot and the first-stage VQ codevectors and Voronoi regions are plotted for the first pair of arcsine of PARCOR coefficients for the voiced regions of speech. In this plot, the pdf is heavily concentrated toward the right edge, especially toward the lower-right corner, and therefore is not circularly symmetric. Furthermore, many of the outer cells along the right edge have well-bounded scatter plot within the Voronoi regions. In a situation like this, better coding performance can be obtained in accordance with the present invention by not using the rotation angle determination method defined above, but rather by carefully "tuning" the rotation angle for each codevector with the goal of maximally aligning the boundaries of scaled Voronoi regions and the general slope of the pdf within each Voronoi region. In accordance with the present invention this can be done either manually or through some automated algorithm. Furthermore, in alternative embodiments even the definition of inner cells can be loosened to include not only those Voronoi regions that's have well-defined boundaries, but also those Voronoi regions that do not have well-defined boundaries but have a well-defined and concentrated range of scatter plots (such as those Voronoi regions near the lower-right edge in FIG. 24C). This enables further tuning the performance of the RS-MSVQ system.

Figure 25:
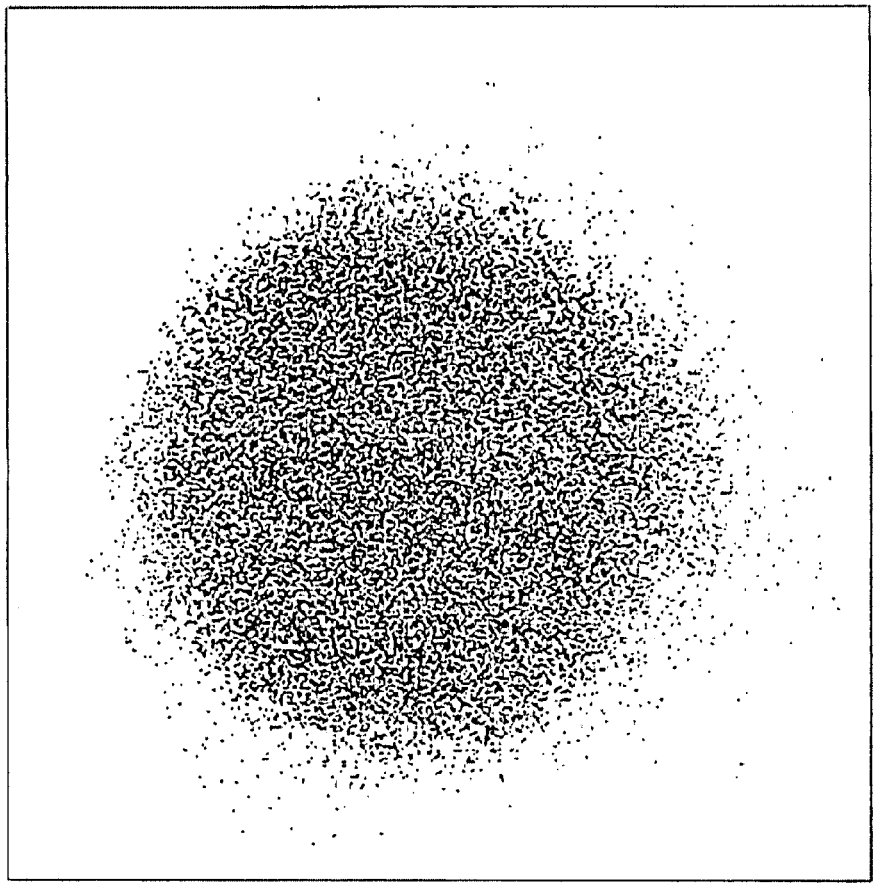
FIG. 25 shows a scatter plot of the "stacked" version of the rotated and scaled Voronoi regions for the inner cells shown in FIG. 24C when no hand-tuning (i.e. manual tuning) is applied.
Figure 26:
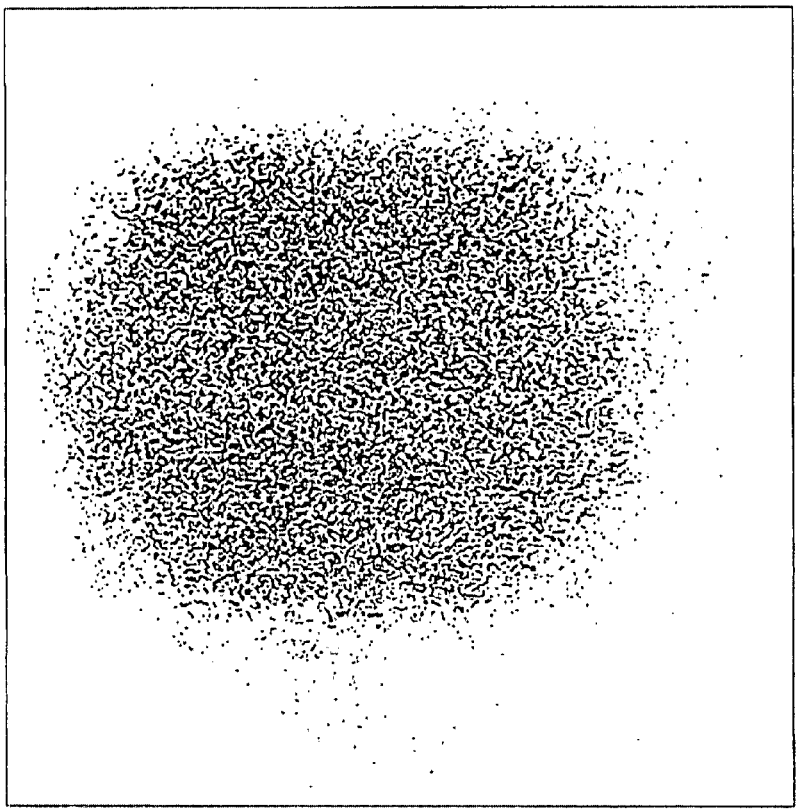
FIG. 26 shows the same kind of scatter plot as FIG. 25, except with manually tuned rotation angle and selection of inner cells.
Figure 27:
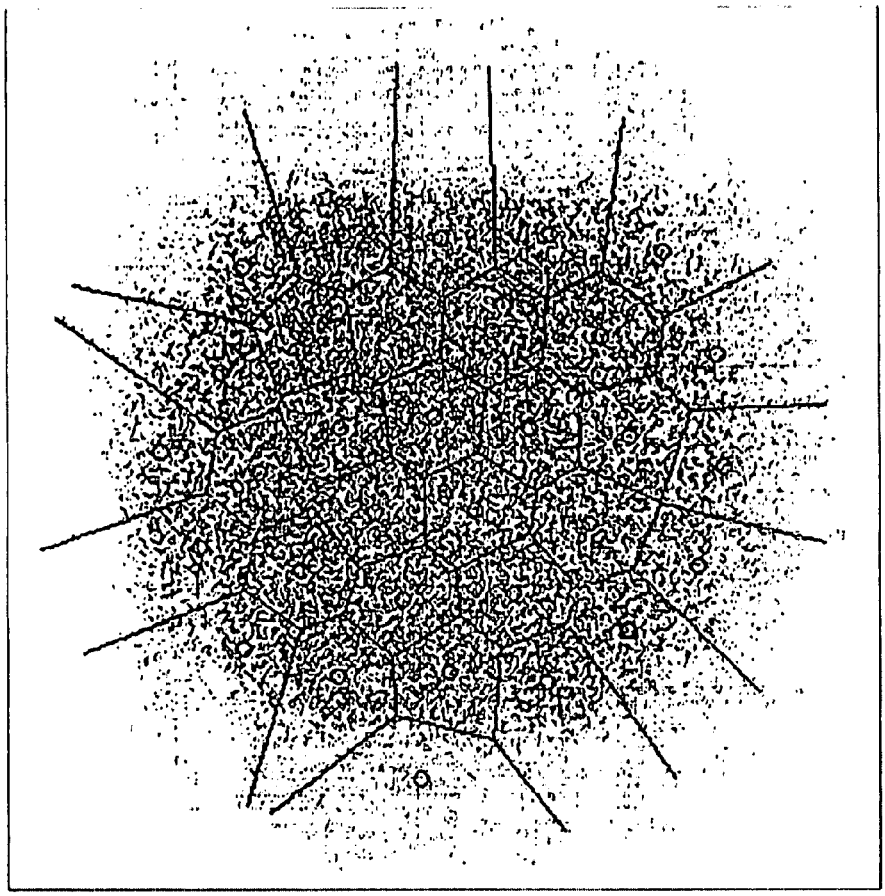
FIG. 27 illustrates the Voronoi cells and the codebook vectors designed using the tuning in FIG. 26.
Figure 28:
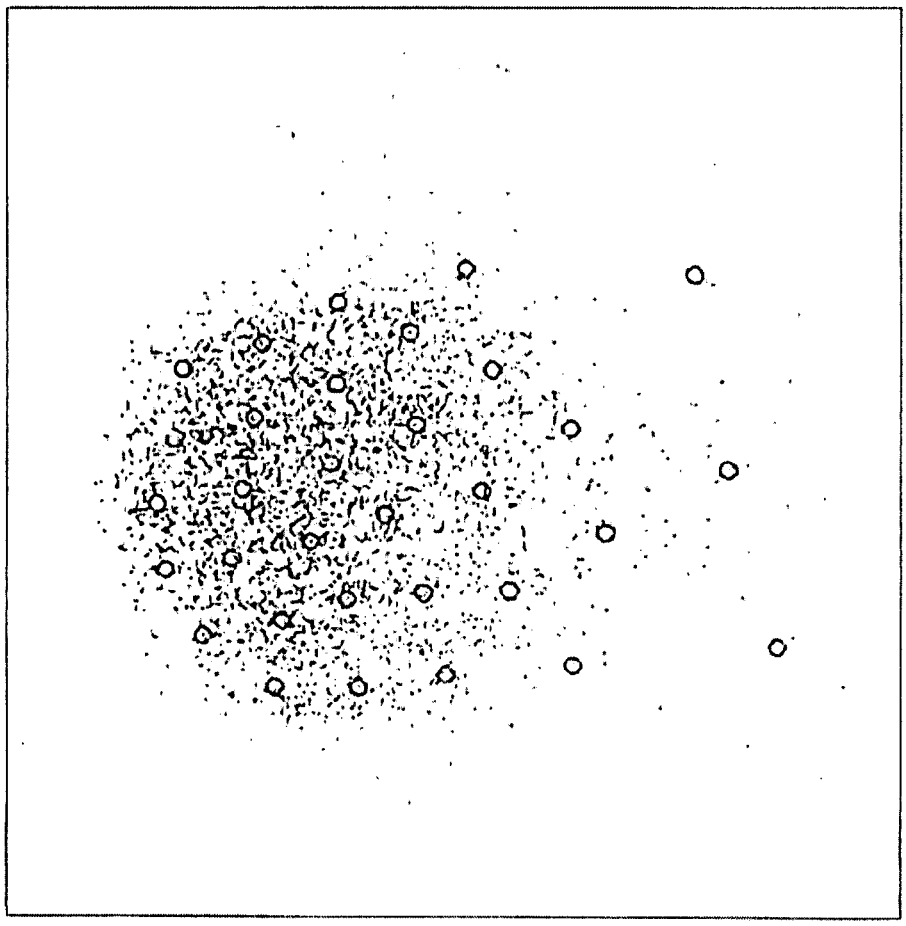
FIG. 28 shows the Voronoi cells and the codebook designed for the outer cells.

FIG. 25 shows the scatter plot of the "stacked" version of the rotated and scaled Voronoi regions for the inner cells in FIG. 24C in the embodiment when no hand-tuning (i.e., manual tuning) is done. FIG. 26 shows the same kind of scatter plot, except this time it is with manually tuned rotation angle and selection of inner cells. It can be seen that a good job is done in maximally aligning the boundaries of scaled Voronoi regions, so that FIG. 26 even shows a rough hexagonal shape, generally representative of the shapes of the inner Voronoi regions in FIG. 24C. The codebook designed using FIG. 26 is shown in FIG. 27. Experiments show that this codebook outperforms the codebook designed using FIG. 25. Finally, FIG. 28 shows the codebook designed for the outer cells. It can be seen that the codevectors are further apart on the right side, reflecting the fact that the pdf at the "tail end" of the outer cells decreases toward the right edge.

It will be apparent to people of ordinary skill in the art that several modifications of the general approach described above for improving the performance of multi-stage vector quantizers are possible, and would fall within the scope of the teachings of this invention. Further, it should be clear that applications of the approach of this invention to inputs other than speech and audio signals can easily be derived and similarly fall within the scope of the invention.

E. Miscellaneous (1) Spectral Pre-Processing

In accordance with a preferred embodiment of the present invention applicable to codecs operating under the ITU standard, in order to better estimate the underlying speech spectrum, a correction is applied to the power spectrum of the input speech before picking the peaks during spectral estimation. The correction factors used in a preferred embodiment are given in the following table:

| | |
|---|---|
| 0 < f < 150 | 12.931 |
| 150 < f < 500 | H(500)/H(f) |
| 500 < f < 3090 | 1.0 |
| 3090 < f < 3750 | H(3090)/H(f) |
| 3750 < f < 4000 | 12.779 |

where f is the frequency in Hz and H(f) is the product of the power spectrum of the Modified IRS Receive characteristic and the power spectrum of ITU low pass filter, which are known from the ITU standard documentation. This correction is later removed from the speech spectrum by the decoder.

In a preferred embodiment, the seevoc peaks below 150 Hz are manipulated as follows:

if (PeakPower[$n$]<(PeakPower[$n$+1]*0.707)

PeakPower[$n$]=PeakPower[$n$+1]*0.707, to avoid modelling the spectral null at DC that results from the Modified IRS Receive characteristic.

(2) Onset Detection and Voicing Probability Smoothing

This section addresses a solution to problems which occur when the analysis window covers two distinctly different sections of the input speech, typically at the speech onset or in some transition regions. As should be expected, the associated frame contains a mixture of signals which may lead to some degradation of the output signal. In accordance with the present invention, this problem can be addressed using a combination of multi-mode coding (see Sections B(2), B(5), C(5), D(3)) and using the concept of adaptive window placing, which is based on shifting the analysis window so that predominantly one kind of speech waveform is in the window at a given time. Following is a description of a novel onset time detector, and a system and method for shifting the analysis window based on the output of the detector that operate in accordance with a preferred embodiment of the present invention.

(a) Onset Detection

In a specific embodiment of the present invention, the voicing analysis is generally based on the assumption that the speech in the analysis window is in a steady-state. As known, if an input speech frame is in transient, such as from silence to voiced, the power spectrum of the frame signal is probably noise-like. As the result, the voicing probability of that frame is very low and the resulting whole sentence won't sound smoothly.

Some prior art, (see for example the Government standard 2.4 kb/s FS1015 LPC10E codec), shows the use of an onset detector. Once the onset is detected, the analysis window is placed after the onset. This window replacement approach requires large analysis delay time. Considering the low complexity and the low delay constraints of the codec, in accordance with a preferred embodiment of the present invention, a simple onset detection algorithm and window placement method is introduced which overcome certain problems apparent in the prior art. In particular, since in a specific embodiment the window has to be shifted based on the onset time, the phases are not measured at the center of the analysis frame. Hence the measured phases have to be corrected based on the onset time.

Figure 34:
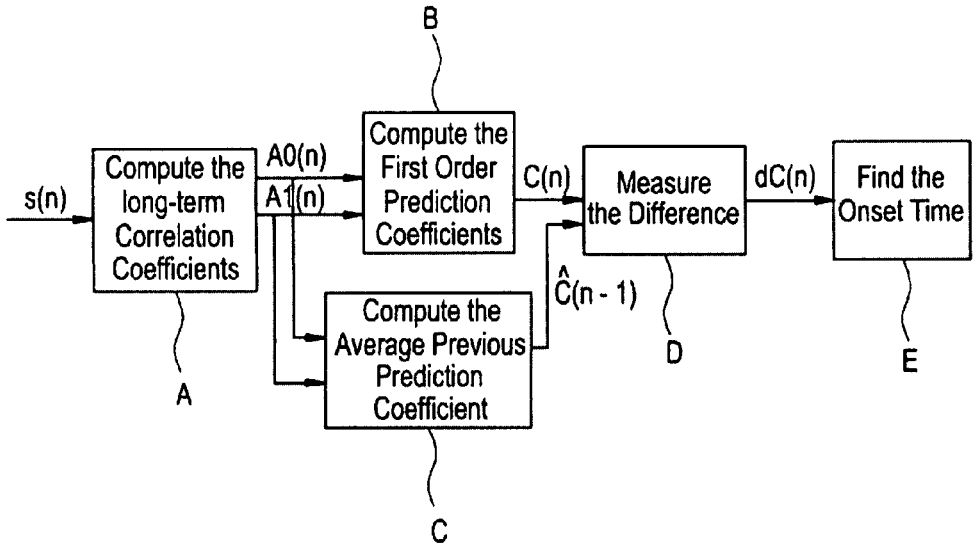
FIG. 34 is a block diagram of an onset detector used in a specific embodiment of the present invention.

FIG. 34 illustrates in a block diagram form the onset detector used in a preferred embodiment of the present invention. Specifically, in block A of the detector, for each sample of the 20 ms analysis frame (160 samples in 8000 Hz sampling rate), the zero lag and the first lag correlation coefficients, $A_0(n)$ and $A_1(n)$, are updated using the following equations:

$$A_0(n)=(1-\alpha)s(n)s(n)+\alpha A_0(n-1),$$

$$A_1(n)=(1-\alpha)s(n)s(n+1)+\alpha A_1(n-1),\ 0\leqq n\leqq 159,$$

where s(n) is the speech sample, and $\alpha$ is chosen to be 63/64.

Next, in block B of the detector, the first order forward prediction coefficient C(n) is calculated using the expression:

$$C(n)=A_1(n)/A_0(n),\ 0\leqq n\leqq 159.$$

The previous forward prediction coefficient is approximated in block C using the expression:

$$\hat{C}(n-1)=\frac{\sum A_1(n-j)}{\sum A_0(n-j)},\quad 1\leq j\leq 8,\quad 0\leq n\leq 159,$$

where $A_0(n-j)$ and $A_1(n-j)$ represent the previous correlation coefficients.

The difference between the prediction coefficients is computed in block D as follows:

$$dC(n)=|C(n)-\hat{C}(n-1)|,\ 0\leqq n\leqq 159.$$

For the stationary speech, the difference prediction coefficient dC(n) is usually very small. But at onset, dC(n) is greatly increased because of the large change in the value of C(n). Hence, dC(n) is a good indicator for the onset detection and is used in block E to compute the onset time. Following are two experimental rules used in accordance with a preferred embodiment of the present invention to detect an onset at the current frame:

(1) dC(n) should be larger than 0.16.

(2) n should be at least 10 samples away from the onset time of previous frame, K−1.

For the current frame, the onset time K is defined as the sample with the maximum dC(n) which satisfied the above two rules.

(b) Window Placement

Figure 35:
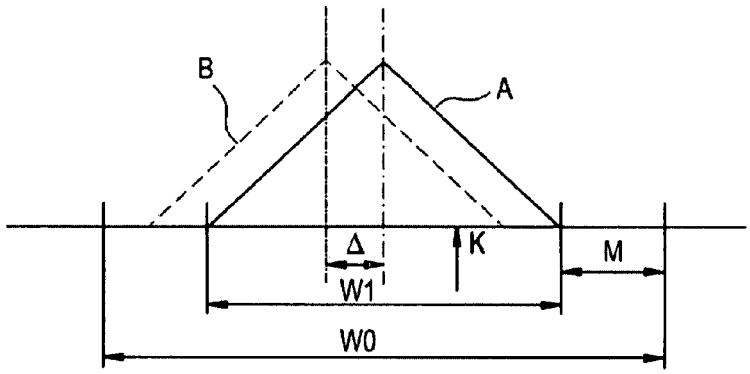
FIG. 35 is an illustration of the window placement used by a system with onset detection as shown in FIG. 34.

After the onset time K is determined, in accordance with this embodiment of the present invention the adaptive window has to be placed properly. The technique used in a preferred embodiment is illustrated in FIG. 35. Suppose that as shown in FIG. 35, the onset K happens at the right side of the window. Using the window placement technique of the present invention, the centered window A has to be shifted left (assuming the position of window B) to avoid the sudden change of the speech. Then, the signal in the analysis window B then is closer to being stationary than the signal in the original window A and the speech in the shifted window is more suitable for stationary analysis.

In order to find the window shifting A, in accordance with a preferred embodiment, the maximum window shifting is given as $M=(\omega_0-W_1)/2$. where $W_0$ represents the length of the largest analysis window, (which is 291 in a specific embodiment). $W_1$ is the analysis window length, which is adaptive to the coarse pitch period and is smaller than $W_0$.

Then the shifting $\Delta$ can be calculated by the following equations:

$$\Delta=-(M*K)/(N/2),\ \text{if } 0<K<N/2,\ (a)$$

$$\Delta=M*(N-K)/(N/2),\ \text{if } N/2\leqq K<N,\ (b)$$

where N is the length of the frame (which is 160 in this embodiment). The sign is defined as positive if the window has to be moved left and negative if the window has to be moved right. As shown in the above equation (a), if the onset time K is at the left side of the analysis window, the window shifts to the right side. If the onset time K is at the right side of the analysis window, the window will shift to the left side.

(c) The Measured Phases Compensation

In a preferred embodiment of the present invention, the phases should be obtained from the center of the analysis frame so that the phase quantization and the synthesizer can be aligned properly. However, if there is an onset in the current frame, the analysis window has to be shifted. In order to get the proper measured phases which are aligned at the center of the frame, the phases have to be re-calculated by considering the window shifting factor.

If the analysis window is shifted left, the measured phases should be too small. Then the phase change should be added to the measured values. If the window is shifted to the right, the phase change term should be subtracted from the measured phases. Since the left side change was defined as being positive and right side change as negative, the phase change values should inherit the proper sign from the window shift value.

Considering a window shift value $\Delta$ and a radian frequency of a harmonic k, $\omega(k)$, the linear phase change should be $d\Phi(k)=\Delta\cdot\omega(k)$. The radian frequency $\omega(k)$ can be calculated using the expression:

$$\omega(k) = \frac{2\pi}{P_0}k,$$

where $P_0$ is the refined pitch value of the current frame. Hence, the phase compensation values can be computed for each measured harmonics. And the final phases $\Phi(k)$, can be re-calculated by considering the measured phases $\hat{\Phi}(k)$, and the compensation values, $d\Phi(k)$:$\Phi(k)=\hat{\Phi}(k)+d\Phi(k)$.

(d) Smoothing of Voicing Probability

Generally, the voicing analyzer used in accordance with the present invention is very robust. However, in some cases, such as at onset or at formant changing, the power spectrum of the analysis window will be noise-like. If the resulting voicing probability goes very low, the synthetic speech won't sound smoothly. The problem related with the onset has been addressed in a specific embodiment using the onset detector described above and illustrated in FIG. 34. In this section, the enhanced codec uses a smoothing technique to improve the quality of the synthetic speech.

The first parameter used in a preferred embodiment to help correcting the voicing is the normalized autocorrelation coefficient at the refined pitch. It is well known that the time-domain correlation coefficient at pitch lag has very strong relationship with the voicing probability. If the correlation is high, the voicing should be relatively high, and vice visa. Since this parameter is necessary for the middle frame voicing, in this enhanced version, it is used for modifying the voicing of the current frame too.

The normalized autocorrelation coefficient at the pitch lag $P_0$ in accordance with a specific embodiment of the present invention can be calculated from the windowed speech, x(n) as follows:

$$C(P_0) = \frac{\sum x(n)x(n+P_0)}{\sqrt{\sum x(n)x(n)\sum x(n+P_0)x(n+P_0)}}, \quad 0 \le n < N - P_0,$$

where N is the length of the analysis window and $C(P_0)$ always has a value between −1 and 1. In accordance with a preferred embodiment, two simple rules are used to modify the voicing probability based on $C(P_0)$:

(1) The voicing is set to 0 if $C(P_0)$ is smaller than 0.01.

(2) If $C(P_0)$ is larger than 0.45, and the voicing probability is less than $C(P_0)-0.45$, then the voicing probability is modified to be $C(P_0)-0.45$.

In accordance with a preferred embodiment, the second part of the approach is to smooth the voicing probability backward if the pitch of the current frame is on the track of the previous frame. If in that case, the voicing probability of the previous frame is higher than that of the current frame, the voicing should be modified by:

$$\hat{P}_v=0.7*P_v+0.3*P_{v-1},$$

where Pv is the voicing of the current frame and Pv_1 represents the voicing of the previous frame. This modification can help to increase the voicing of some transient part, such as formant changing. The resulting speech sounds much more smoothly.

The interested reader is further pointed to "Improvement of the Narrowband Linear Predictive Coder, Part 1—Analysis Improvements". NRL Report 8654. By G. S. Kang and S. S. Everett, 1982, which is hereby incorporated by reference.

(3) Modified Windowing

In a specific embodiment of the present invention, a coarse pitch analysis window (Kaiser window with beta=6) of 291 samples is used, where this window is centered at the end of the current 20 ms window. From that center point, the window extends forward for 145 samples, or 18.125 ms. Therefore, for a codec built in accordance with this specific embodiment, the "look-ahead" is 18.125 ms. For the specific ITU 4 kb/s codec embodiment of the present invention, however, the delay requirement is such that the look-ahead time is restricted to 15 ms. If the length of the Kaiser window is reduced to 241, then the look-ahead would be 15 ms. However, such a 241-sample window will not have sufficient frequency resolution for very low pitched male voices.

Figure 8A:
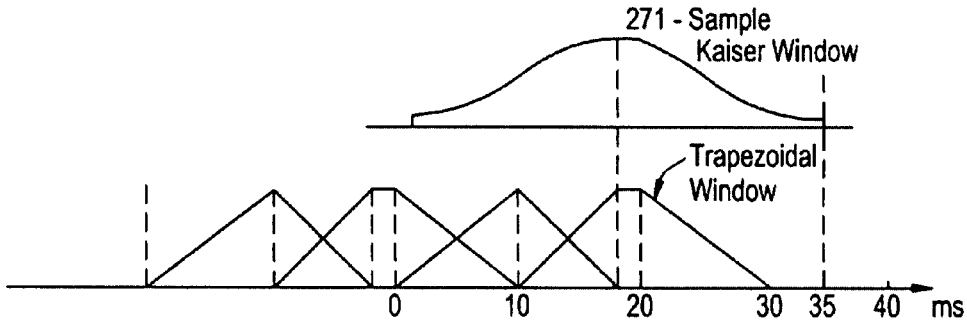
FIG. 8A is an illustration of a trapezoidal synthesis window used in a preferred embodiment of the present invention to reduce look-ahead time and coding delay for a mixed-phase codec design following ITU standards.

To solve this problem, in accordance with the specific ITU 4 kb/s embodiment of the present invention, a novel compromised design is proposed which uses a 271-sample Kaiser window in conjunction with a trapezoidal synthesis window for the overlap-add operation. If we were to center the 271-sample at the end of the current frame, then the look-ahead would have been 135 samples, or 16.875 ms. By using a trapezoidal synthesis window with 15 samples of flat top portion, and moving the Kaiser analysis window back by 15 samples, as shown in FIG. 8A, we can reduce the look-ahead back to 15 ms without noticeable degradation to speech quality.

(4) Post Filtering Techniques

The prior art, (Cohen and Gersho) including some by one of the co-inventors of this application introduced the concept of speech adaptive postfiltering as a means for improving the quality of the synthetic speech in CELP waveform coding. Specifically, a time-domain technique was proposed that manipulated the parameters of an allpole synthesis filter to create a time-domain filter that deepened the formant nulls of the synthetic speech spectrum. This deepening was shown to reduce quantization noise in those regions. Since the time-domain filter increases the spectral tilt of the output speech, a further time-domain processing step was used to attempt to restore the original tilt and to maintain the input energy level.

Figure 29:
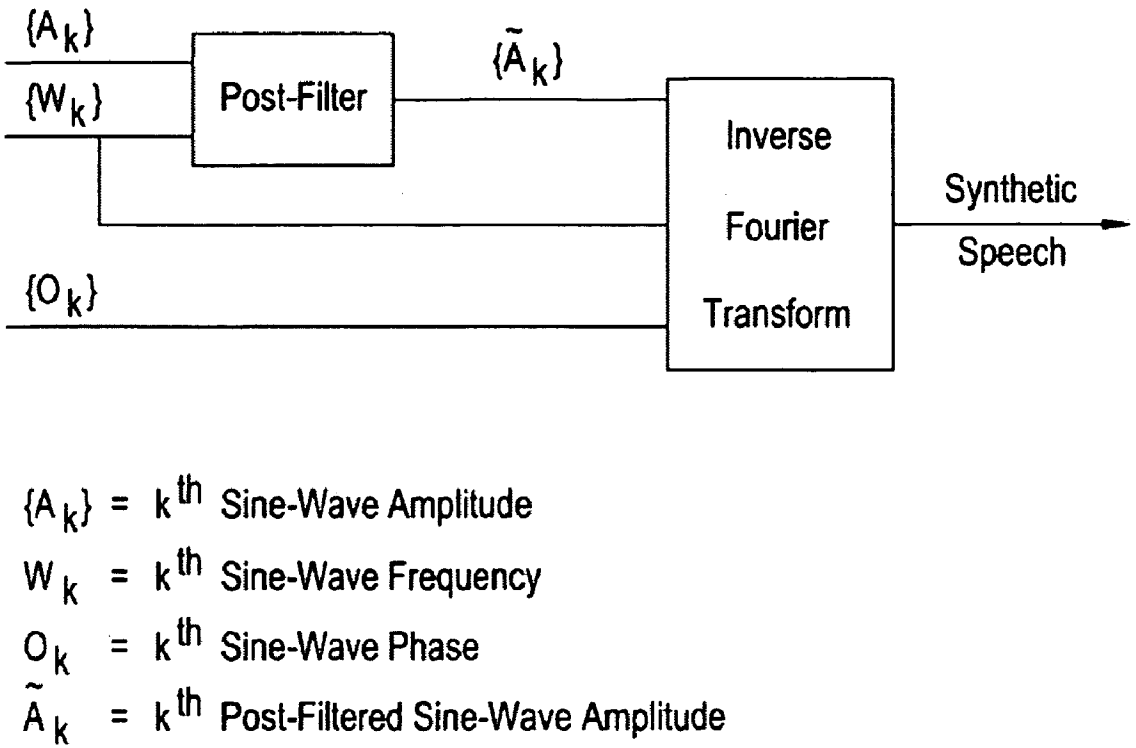
FIG. 29 is a block diagram of a sinusoidal synthesizer in a preferred embodiment using constant complexity post-filtering.

McAulay and Quatieri modified the above method so that it could be applied directly in the frequency domain to postfilter the amplitudes that were used to generate synthetic speech using the sinusoidal analysis-synthesis technique. This method is shown in a block diagram form in FIG. 29. In this case, the spectral tilt was computed from the sine-wave amplitudes and removed from the sine-wave amplitudes before the postfiltering method is applied. The postfilter at the measured sine-wave frequencies was computed by compressing the flattened sine-wave amplitudes using a gamma-root compression factor, (0.0<=gamma<=1). These weights are then applied to the amplitudes to produce the postfiltered amplitudes. These amplitudes were then scaled to conform to the energy of the input amplitude values.

Figure 30:
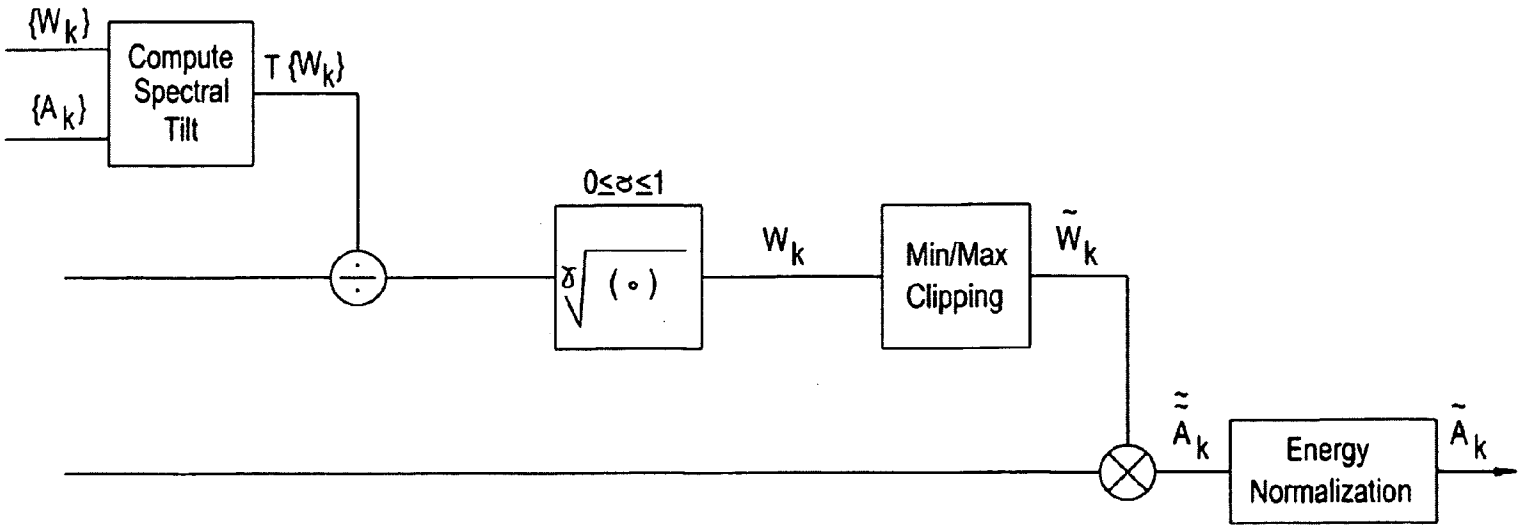
FIG. 30 illustrates the operation of a standard frequency-domain postfilter.

Hardwick and Lim modified this method by adding hard-limits to the postfilter weights. This allowed for an increase in the compression factor, thereby sharpening the formant peaks and deepening the formant nulls while reducing the resulting speech distortion. The operation of a standard frequency-domain postfilter is shown in FIG. 30. Notably, since the frequency domain approach computes the postfilter weights from the measured sine-wave amplitudes, the execution time of the postfilter module varies from frame-to-frame depending on the pitch frequency. Its peak complexity is therefore determined by the lowest pitch frequency allowed by the codec. Typically this is about 50 Hz, which over a 4 kHz bandwidth results in 80 sine-wave amplitudes. Such pitch-dependent complexity is generally undesirable in practical applications.

One approach to eliminating the pitch-dependency is suggested in a prior art embodiment of the sinusoidal synthesizer, where the sine-wave amplitudes are obtained by sampling a spectral envelope at the sine-wave frequencies. This envelope is obtained in the codec analyzer module and its parameters are quantized and transmitted to the synthesizer for reconstruction. Typically a 256 point representation of this envelope is used, but extensive listening test have shown that a 64-point representation results in little quality loss.

Figure 31:
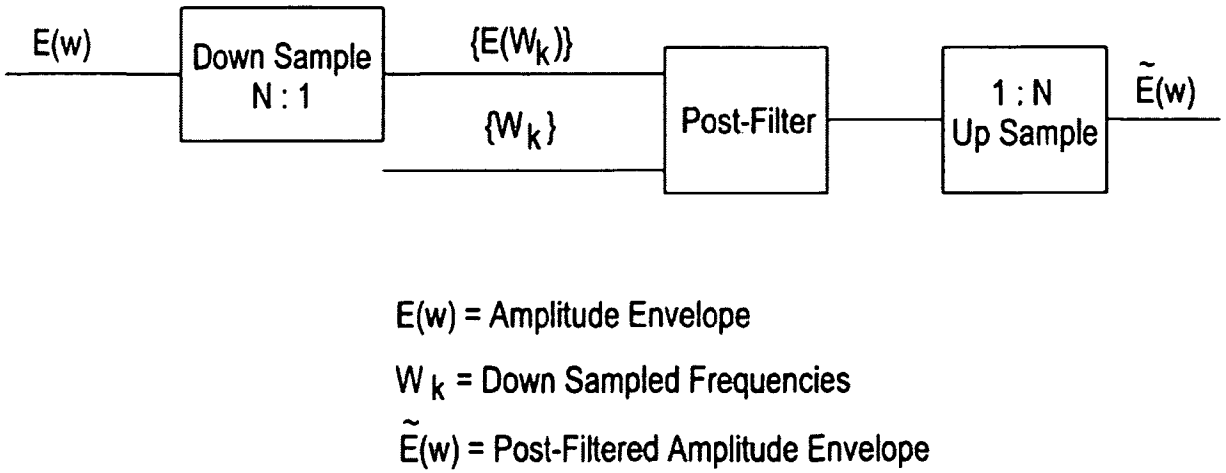
FIG. 31 is a block diagram of a constant complexity post-filter in accordance with a preferred embodiment of the present invention.

In accordance with a preferred embodiment of this invention, amplitude samples at the 64 sampling points are used as the input to a constant complexity frequency-domain postfilter. The resulting 64 postfilted amplitudes are then upsampled to reconstruct an M-point post-filtered envelope. In a preferred embodiment, a set of M=256 points are used. The final set of sine-wave amplitudes needed for speech reconstruction are obtained by sampling the post-filtered envelope at the pitch-dependent sine-wave frequencies. The constant-complexity implementation of the postfilter is shown in FIG. 31.

The advantage of the above implementation is that the postfilter always operates on a fixed number (64-point) downsampled amplitudes and hence executes the same number of operations in every frame, thus making the average complexity of the filter equal to its peak complexity. Furthermore, since 64-points are used, the peak complexity is lower than the complexity of the postfilter that operates directly on the pitch-dependent sine-wave amplitudes.

Figure 32:
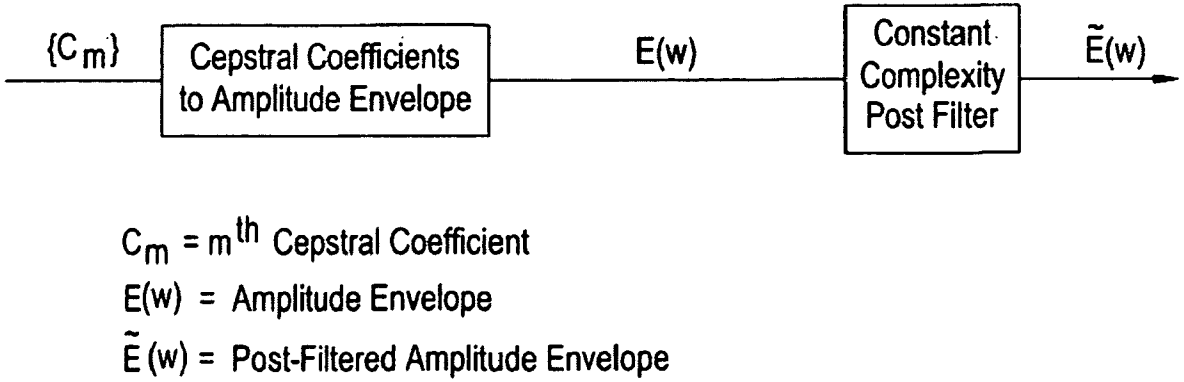
FIG. 32 is a block diagram of constant complexity post-filter using cepstral coefficients.
Figure 33:
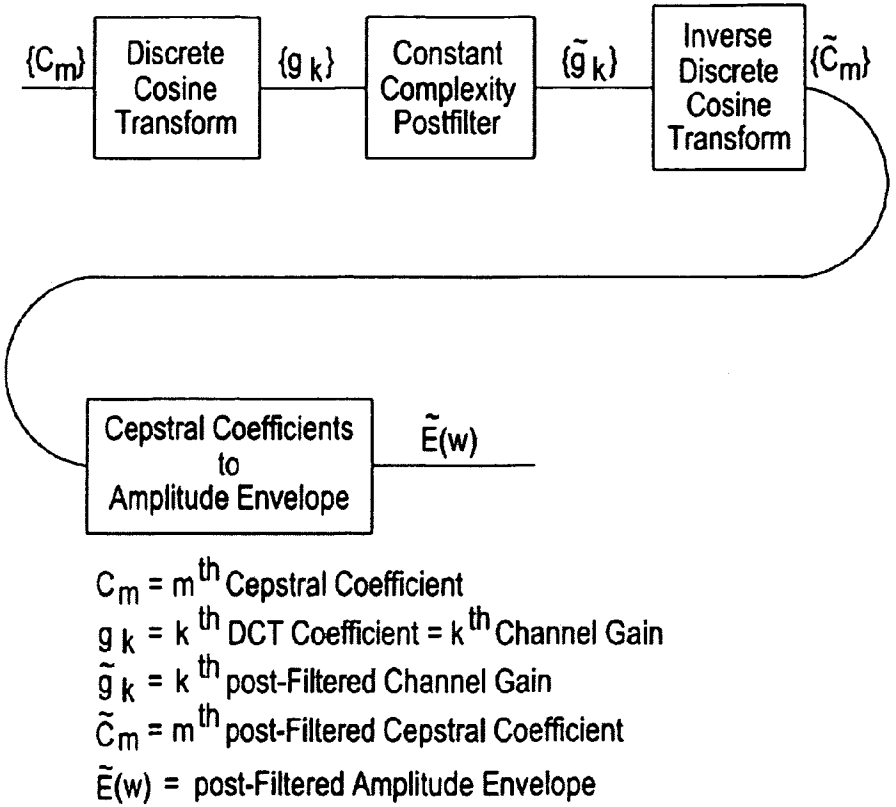
FIG. 33 is a block diagram of a fast constant complexity post-filter in accordance with a preferred embodiment of the present invention.

In a specific preferred embodiment of the coder of the present invention, the spectral envelope is initially represented by a set of 44 cepstral coefficients. It is from this representation that the 256-point and the 64-point envelopes are computed. This is done by taking a 64-point Fourier transform of the cepstral coefficients, as shown in FIG. 32. An alternative procedure is to take a 44-point Discrete Cosine Transform of the 44 cepstral coefficients which can be shown to represent a 44-point downsampling of the original log-magnitude envelope, resulting in 44 channel gains. Next, postfiltering can be applied to the 44 channel gains resulting in 44 post-filtered channel gains. Taking the inverse Discrete Fourier transform of these revised channel gains produces a set of 44 post-filtered cepstral coefficients, from which the post-filtered amplitude envelope can be computed. This method is shown in FIG. 33.

A further modification that leads to an even great reduction in complexity, is to use 32 cepstral coefficients to represent the envelope at very little loss in speech quality. This is due to the fact that the cepstral representation corresponds to a bandpass interpolation of the log-magnitude spectrum. In this case the peak complexity is reduced, since only 32 gains need to be postfiltered, but an additional reduction in complexity is possible since the DCT and inverse DCT can be computed using the computationally efficient FFT.

(5) Time Warping with Measured Phases

As shown in FIG. 6, in a preferred embodiment of the present invention, the user can insert a warp factor that forces the synthesized output signal to contract or expand in time. In order to provide smooth transitions between signal frames which are time modified, an appropriate warping of the input parameters is required. Finding the appropriate warping is a non-trivial problem, which is especially complex when the system uses measured phases.

In accordance with the present invention, this problem is addressed using the basic idea that the measured parameters are moved to time scaled locations. The spectrum and gain input parameters are interpolated to provide synthesis parameters at the synthesis time intervals (typically every 10 ms). The measured phases, pitch and voicing, on the other hand, generally are not interpolated. In particular, a linear phase term is used to compensate the measured phases for the effect of time scaling. Interpolating the pitch could be done using pitch scaling of the measured phases.

In a preferred embodiment, instead of interpolating the measured phases, pitch and voicing parameters, sets of these parameters are repeated or deleted as needed for the time scaling. For example, when slowing down the output signal by a factor of two, each set of measured phases, pitch and voicing is repeated. When speeding up by a factor of two, every other set of measured phases, pitch, and voicing is dropped. During voiced speech, a non-integer number of periods of the waveform are synthesized during each synthesis frame. When a set of measured phases is inserted or deleted, the accumulated linear phase component corresponding to the noninteger number of waveform periods in the synthesis frame must be added or subtracted to the measured phases in that frame, as well as to the measured phases in every subsequent frame. In a preferred embodiment of the present invention, this is done by accumulating a linear phase offset, which is added to all measured phases just prior to sending them to the subroutine which synthesizes the output (10 ms) segments of speech. The specifics of time warping used in accordance with a preferred embodiment of the present invention are discussed in greater detail next.

(a) Time Scaling with Measured Phases

The frame period of the analyzer, denoted Tf, in a preferred embodiment of the present invention, has a value of 20 milliseconds. As shown above in Section B.1, the analyzer estimates the pitch, voicing probability and baseband phases every Tf/2 seconds. The gain and spectrum are estimated every Tf seconds.

For each analysis frame n, the following parameters are measured at time t(n) where t(n)=n*Tf:

| | |
|---|---|
| Fo | pitch |
| Pv | voicing probability |
| Phi (i) | baseband measured phases |
| G | gain |
| Ai | all-pole model coefficients |

The following mid-frame parameters are also measured at time t_mid(n) where t_mid(n)=(n−0.5)*Tf:

| | |
|---|---|
| Fo_mid | mid-frame pitch |
| Pv_mid | mid-frame voicing probability |
| Phi_mid (i) | mid-frame baseband measured phases |

Speech frames are synthesized every Tf/2 seconds at the synthesizer. When there is no time warping, the synthesis sub-frames are at times t_syn(m)=t(m/2) (where m takes on integer values) The following parameters are required for each synthesis sub-frame:

| | |
|---|---|
| FoSyn | Pitch |
| PvSyn | voicing probability |
| PhiSyn (i) | baseband measured phases |
| LogMagEnvSyn (f) | log magnitude envelope |
| MinPhaseEnvSyn (f) | minimum phase envelope |

For m even, each time t_syn(m) corresponds to analysis frame number m/2 (which is centered at time t(m/2)). The pitch, voicing probability and baseband phase values used for synthesis are set equal to those values measured at time t_syn(m).

These are the values for those parameters which were measured in analysis frame m/2. The magnitude and phase envelopes for synthesis, LogMagEnvSyn(f) and MinPhase EnvSyn(f), must also be determined. The parameters G and Ai corresponding to analysis frame m/2 are converted to LogMagEnv(f) and MinPhaseEnv(f), and since t_syn(m)=t (m/2), these envelopes directly correspond to LogMagEnv Syn(f) and MinPhaseEnvSyn(f).

For m odd, the time t_syn(m) corresponds to the mid-frame analysis time for analysis frame (m+1)/2. The pitch, voicing probability and baseband phase values used for synthesis at time t_syn(m) (for m odd) are the mid-frame pitch, voicing and baseband phases from analysis frame (m+1)/2. The envelopes LogMagEnv(f) and MinPhaseEnv (f) from the two adjacent analysis frames, (m+1)/2 and (m−1)/2, are linearly interpolated to generate LogMagEnvSyn(f) and MinPhaseEnvSyn(f).

When time warping is performed, the analysis time scale is warped according to some function W( ) which is monotonically increasing and may be time varying. The synthesis times t_syn(m) are not equal to the warped analysis times W(t(m/2)), and the parameters can not be used as described above. In the general case, there is not a warped analysis time W(t(j)) or W(t_mid(j)) which corresponds exactly to the current synthesis time t_syn(m).

The pitch, voicing probability, magnitude envelope and phase envelopes for a given frame j can be regarded as if they had been measured at the warped analysis times W(t(j)) and W(t_mid(j)). However, the baseband phases cannot be regarded in that way. This is because the speech signal frequently has a quasi-periodic nature, and warping the baseband phases to a different location in time is inconsistent with the time evolution of the original signal when it is quasi-periodic.

During time warping, the magnitude and phase envelopes for a synthesis time t_syn(m) are linearly interpolated from the envelopes corresponding to the two adjacent analysis frames which are nearest to t_syn(m) on the warped time scale (i.e W(t(j−1))<=t_syn(m)<=W(t(j))).

In a preferred embodiment, the pitch, voicing and baseband phases are not interpolated. Instead the warped analysis frame (or sub-frame) which is closest to the current synthesis sub-frame is selected, and the pitch voicing and baseband phases from that analysis sub-frame are used to synthesize the current sub-frame. The pitch and voicing probability can be used without modification, but the baseband phases may need to be modified so that the time warped signal will have a natural time evolution if the original signal is quasi-periodic.

The sine-wave synthesizer generates a fixed number (10 ms) of output speech. When there is no warping of the time scale, each set of parameters measured at the analyzer is used in the same sequence at the synthesizer. If the time scale is stretched, (corresponding to slowing down the output signal) some sets of pitch, voicing and baseband phase will be used more than once. Likewise, when the time scale is compressed (speeding up of the output signal) some sets of pitch, voicing and baseband phase are not used.

When a set of analysis parameters is dropped, the linear component of the phase which would have been accumulated during that frame is not present in the synthesized waveform. However, the all future sets of baseband phases are consistent with a signal which did have that linear phase. It is therefore necessary to offset the linear phase component of the baseband phases for all future frames. When a set of analysis parameters is repeated, there is additional linear phase term accumulated in the synthesized signal, which term was not present in the original signal. Again, this must be accounted for by adding a linear phase offset to the baseband phases in all future frames.

The amount of linear phase which must be added or subtracted is computed as:

PhiOffset=2*PI*Samples/PitchPeriod where Samples is the number of synthesis samples inserted or deleted and PitchPeriod is the pitch period (in samples) for the frame which is inserted or deleted. Although in the current system, entire synthesis sub-frames are added or dropped, it is also possible to warp the time scale by changing the length of the synthesis sub-frames. The linear phase offset described above applies to that embodiment as well.

Any linear phase offset is cumulative since a change in one frame must be reflected in all future frames. The cumulative phase offset is incremented by the phase offset each time a set of parameters is repeated, i.e.,:

PhiOffsetCum=PhiOffsetCum+PhiOffset

If a set of parameters is dropped then the phase offset is subtracted from the cumulative offset, i.e.,:

PhiOffsetCum=PhiOffsetCum−PhiOffset

The offset is applied in a preferred embodiment to each of the baseband phases as follows:

PhiSyn($i$)=PhiSyn($i$)+$i$*PhioffsetCum

In general, any initial value for PhiOffsetCum can be used. However, if there is no time scale warping and it is desirable for the input and output time signals to match as closely as possible, the initial value for PhioffsetCum should be chosen equal to zero. This ensures that when there is no time scale warping that PhiOffsetCum is always zero, and the original measured baseband phases are not modified.

(6) Phase Adjustments For Lost Frames

This section discusses problems that arise when during transmission some signal frames are lost or arrive so far out of sequence that must be discarded by the synthesizer. The preceding section disclosed a method used in accordance with a preferred embodiment of the present invention which allows the synthesizer to omit certain baseband phases during synthesis. However, the method relies on the value of the pitch period corresponding to the set of phases to be omitted. When a frame is lost during transmission the pitch period for that frame is no longer available. One approach to dealing with this problem is to interpolate the pitch across the missing frames and to use the interpolated value to determine the appropriate phase correction. This method works well most of the time, since the interpolated pitch value is often close to the true value. However, when the interpolated pitch value is not close enough to the true value, the method fails. This can occur, for example, in speech where the pitch is rapidly changing.

In order to address this problem, in a preferred embodiment of the present invention, a novel method is used to adjust the phase when some of the analysis parameters are not available to the synthesizer. With reference to FIG. 7, block 755 of the sine wave synthesizer estimates two excitation phase parameters from the baseband phases. These parameters are the linear phase component (the OnsetPhase) and a scalar phase offset (Beta). These two parameters so can be adjusted so that a smoothly evolving speech waveform is synthesized when the parameters from one or more consecutive analysis frames are unavailable at the synthesizer. This is accomplished in a preferred embodiment of the present invention by adding an offset to the estimated onset phase such that the modified onset phase is equal to an estimate of what the onset phase would have been if the current frame and the previous frame had been consecutive analysis frames.

An offset is added to Beta such that the current value is equal to the previous value. The linear phase offset for the onset phase and the offset for Beta are computed according to the following expressions:

ProjectedOnsetPhase=OnsetPhase_1+π*Samples *(1/PitchPeriod+1/PitchPeriod_1)

LinearPhaseOffset=ProjectedOnsetPhase−fOnset-PhaseEst;

BetaOffset=Beta_1−BetaEst

OnsetPhase=OnsetPhaseEst+LinearPhaseOffset

Beta=BetaEst+BetaOffset where

OnsetPhaseEst is the onset phase estimated from the current baseband phases

BetaEst is the scalar phase offset (beta) estimated from the current baseband phases PitchPeriod is the pitch period (in samples) for the current synthesis sub-frame OnsetPhase_1 is the onset phase used to generate the excitation phases on the previous synthesis sub-frame Beta_1 is the scalar phase offset (beta) used to generate the excitation phases on the previous synthesis sub-frame PitchPeriod_1 is the pitch period (in samples) for the previous synthesis sub-frame Samples is the number of samples between the center of the previous synthesis sub-frame and the center of the current synthesis sub-frame It should be noted that OnsetPhaseEst and BetaEst are the values estimated directly from the baseband phases. OnsetPhase_1 and Beta_1 are the values from the previous synthesis sub-frame to which the previous values for LinearPhaseOffset and BetaOffset have been added.

The values LinearPhaseoffset and BetaOffset are computed only when one or more analysis frames are lost or deleted before synthesis, however, these values must be added to OnsetPhaseEst and BetaEst on every synthesis sub-frame.

The initial values for LinearPhaseOffset and BetaOffset are set to zero so that when there is no time scale warping the synthesized waveform matches the input waveform as closely as possible. However, the initial values for LinearPhaseOffset and BetaOffset need not be zero in order to synthesize high quality speech.

(7) Efficient Computation of Adaptive Window Coefficients

In a preferred embodiment, the window length (used for pitch refinement and voicing calculation) is adaptive to the coarse pitch value $F_{0C}$ and is selected roughly 2.5 times the pitch period. The analysis window is preferably a Hamming window, the coefficients of which, in a preferred embodiment, can be calculated on the fly. In particular, the Hamming window is expressed as:

$$W[n] = A - B * \cos\left(\frac{2\pi n}{N-1}\right), \quad 0 < n < N$$

where A 0.54 and B 0.46 and N is the window length.

Instead of evaluating each cosine value in the above expression from the math library, in accordance with the present invention, the cosine value is calculated using a recursive formula as follows:

$$\cos((x+n*h)+h)=2a\cos(x+n*h)-\cos(x+(n-1)$$

where a is given by: a=cos(h), and n is an integer and should be larger or equal to 1. So if cos (h) and cos(x) are known, then the value cos(x+n*h) can be evaluated.

Hence, for a Hamming window W[n], given $$a = \cos\left(\frac{2\pi}{N-1}\right),$$

cosine values for the filter coefficients can be evaluated using the following steps if Y[n] represents $$\cos\left(\frac{2\pi}{N-1}n\right):$$

$$Y[0]=1,\ W[0]=A-B*Y[0];$$

$$Y[1]=a,\ [1]=A-B*Y[1];$$

$$Y[2]=2a*Y[1]-Y0],\ W[2]=A-B*Y[2]$$

$$Y[n]=2a*Y[n-1]-Y[n-2],\ \overline{W}[n]=A-B*Y[n];$$

This method can be used for other type of window calculation which includes cosine calculation, such as Hanning window:

$$W[n]=0.5*(1-\cos\left(\frac{2\pi}{N+1}*(n+:.$$

Using $$a=\cos\left(\frac{2\pi}{N+1}\right),$$

A=B=0.5, Y[−1]=1, Y[0]=a, . . . , Y[n]=2a*Y[n− then window function can be easily evaluated as: W[n]=A−B*Y[n], where n is smaller than N.

(8) Others

Data embedding, which is a significant aspect of the present invention, has a number of applications in addition to those discussed above. In particular, data embedding provides a convenient mechanism for embedding control, descriptive or reference information to a given signal. For example, in a specific aspect of the present invention the embedded data feature can be used to provide different access levels to the input signal. Such feature can be easily incorporated in the system of the present invention with a trivial modification. Thus, a user listening to low bit-rate level audio signal, in a specific embodiment may be allowed access to high-quality signal if he meets certain requirements. It is apparent, that the embedded feature of this invention can further serve as a measure of copyright protection, and also to track the access to particular music.

Finally, it should be apparent that the scalable and embedded coding system of the present invention fits well within the rapidly developing paradigm of multimedia signal processing applications and can be used as an integral component thereof.

While the above description has been made with reference to preferred embodiments of the present invention, it should be clear that numerous modifications and extensions that are apparent to a person of ordinary skill in the art can be made without departing from the teachings of this invention and are intended to be within the scope of the following claims.

What is claimed is:

1. A system for processing audio signals comprising:

(a) a splitter for dividing an input audio signal into a first and one or more secondary signal portions, which in combination provide a complete representation of the input signal, wherein the first signal portion contains information sufficient to reconstruct a representation of the input signal;

(b) a first encoder for providing encoded data about the first signal portion including phase information associated with select sinusoids when a frame of the signal portion is in a transition mode, and one or more secondary encoders for encoding said secondary signal portions, wherein said secondary encoders receive input from the first signal portion and are capable of providing encoded data regarding the first signal portion; and (c) a data assembler for combining encoded data from said first encoder and said secondary encoders into an output data stream.

2. The system of claim 1 wherein dividing the input signal is done in the frequency domain, and the first signal portion corresponds to the base band of the input signal.

3. The system of claim 1 wherein said signal portions are encoded at sampling rates different from that of the input signal.

4. The system of claim 1 wherein said first encoder and said secondary encoders are embedded encoders.

5. The system of claim 1 wherein said splitter is a filter bank.

6. The system of claim 1 further comprising a decoder for reconstructing the input signal from information in said first signal portion.

7. The system of claim 6 further comprising one or more secondary decoders for decoding information encoded by said secondary encoders.

8. The system of claim 1 wherein said output data stream comprises data packets suitable for transmission over a packet-switched network.

9. The system of claim 8 wherein said data packets are prioritized in accordance with the signal portion they represent.

10. The system of claim 8 wherein said data packets are assembled as to represent said two or more signal portions of the input signal.

11. The system of claim 1 wherein said splitter is a Fast Fourier Transform (FFT) computing device.

12. The system of claim 11 wherein said splitter divides the input signal into M octave bands.

13. The system of claim 12 further comprising M1 decoders, $1 \leqq M1 \leqq M$, for providing an output signal that reconstructs the input signal from information in M1 signal portions of the input signal.

14. The system of claim 13 wherein the output signal has sampling frequency that is $2^{M1}$ times lower than the sampling frequency of the input signal.

15. A method for processing audio signals comprising:

(a) dividing an input audio signal into a first and one or more secondary signal portions, which in combination provide a complete representation of the input signal, wherein a first signal portion contains information sufficient to reconstruct a representation of the input signal;

(b) providing first encoded data about the first signal portion including phase information associated with select sinusoids when a frame of the signal portion is in a transition mode, and secondary encoded data about at least one secondary signal portion, wherein said secondary encoded data further comprises information about the first signal portion; and (c) combining said first encoded data and said secondary encoded data into an output data stream.

16. The method of claim 15 further comprising the step of decoding the output data stream to reconstruct the input signal.

17. The method of claim 15 wherein said signal portions are encoded at sampling rates different from that of the input signal.

18. The method of claim 15 wherein said dividing is performed as a Fast Fourier Transform (FFT) computation.

19. The method of claim 18 further comprising the step of decoding the output data stream using M1 decoders, $1 \leqq M1 \leqq M$, for providing an output signal that reconstructs the input signal from information in M1 signal portions of the input signal.

20. The method of claim 19 wherein the output signal has sampling frequency that is $2^{M1}$ times lower than the sampling frequency of the input signal.

* * * * *